US007730925B1

(12) United States Patent
Pereira

(10) Patent No.: US 7,730,925 B1
(45) Date of Patent: Jun. 8, 2010

(54) COLLAPSABLE SCREEN AND DESIGN METHOD

(76) Inventor: Carlos E. Pereira, P.O. Box 186, Claryville, NY (US) 12725

( * ) Notice: Subject to any disclaimer, the term of this patent is extended or adjusted under 35 U.S.C. 154(b) by 384 days.

(21) Appl. No.: 11/746,192

(22) Filed: May 9, 2007

(51) Int. Cl.
*A47H 23/04* (2006.01)

(52) U.S. Cl. ..... 160/84.04; 160/348

(58) Field of Classification Search ..... 160/84.04, 160/84.01, 243, 135, 351, 352, 38, 348, 405
See application file for complete search history.

(56) References Cited

U.S. PATENT DOCUMENTS

| | | | | |
|---|---|---|---|---|
| 451,068 | A | 4/1891 | Park | |
| 1,321,800 | A * | 11/1919 | Andress et al. | 160/84.01 |
| 2,164,966 | A * | 7/1939 | Tutein | 493/295 |
| 2,247,260 | A * | 6/1941 | Stone | 160/84.04 |
| 2,254,820 | A * | 9/1941 | Donner | 160/84.04 |
| 2,299,060 | A * | 10/1942 | Sarran et al. | 160/133 |
| 2,567,256 | A | 9/1951 | Toti | |
| 2,604,155 | A * | 7/1952 | Junkunc | 160/38 |
| 2,922,239 | A | 1/1960 | Glynn | |
| 3,883,924 | A * | 5/1975 | Grabman | 16/94 D |
| 3,939,615 | A | 2/1976 | Sorkin | |
| 3,946,788 | A * | 3/1976 | Van Muyen | 160/84.04 |
| 4,224,974 | A | 9/1980 | Anderson | |
| 4,502,711 | A | 3/1985 | Muth | |
| 4,727,920 | A * | 3/1988 | Siegler | 160/84.04 |
| 4,777,994 | A * | 10/1988 | Nederveld | 160/84.04 |
| 5,104,469 | A | 5/1990 | Colson | |
| 5,273,097 | A * | 12/1993 | Siegler | 160/84.01 |
| 5,313,998 | A | 5/1994 | Colson | |
| 5,533,560 | A | 7/1996 | Morris | |
| 6,173,753 | B1 | 1/2001 | Laster-Bivens et al. | |
| 6,347,658 | B1 * | 2/2002 | Judkins | 160/84.04 |
| 6,431,245 | B1 | 8/2002 | Shen | |
| 6,431,247 | B1 | 8/2002 | Harrison et al. | |
| 6,935,997 | B2 * | 8/2005 | Kling | 493/356 |
| D510,224 | S | 10/2005 | Yu et al. | |
| 2006/0289130 | A1 | 12/2006 | Zimmer | |

FOREIGN PATENT DOCUMENTS

| | | |
|---|---|---|
| GB | 1170785 | 11/1969 |
| GB | 2119825 | 11/1983 |
| WO | 01/81821 A1 | 11/2001 |

OTHER PUBLICATIONS

Kenneway, Complete Origami, 1987, p. 57, St. Martin's Press, New York, NY.
Cipra, "In the Fold: Origami Meets Mathematics", SIAM News, 2001, ff.1-4, vol. 34, No. 8.
Forte, "Packaging Material Innovation: 3-D Folded Structures", IPTA Essay Competition, Mar. 2005.
Hull, "Counting Mountain—Valley Assignments for Flat Folds", Ars Combinatoria, 2002.
Hull, "The Combinatorics of Flat Folds: a Survey", Proceedings of the Third International Meeting of Origami Science, Mathematics, and Education, 2002, A.K. Peters.
Hull, "in search of a practical map fold", Math Horizons, Feb. 2002, pp. 22-24.
Lang, Origami Design Secrets, 2003, A.K. Peters.

* cited by examiner

*Primary Examiner*—David Purol

(57) ABSTRACT

Several embodiments of a collapsible screen employing novel folding structures have many possible uses: window shade, room divider, decorative backdrop, wall hanging, and others. A disclosed method allows its user to design many embodiments of the screen. The method incorporates three modifiable sets or databases: a set (220) of patterns, a set (221) of criteria by which a possible embodiment is evaluated for practicability, and a set (222) of transformations which can be applied to the possible embodiment to improve it with respect to the criteria (221). The sets can change to reflect new assumptions, design characteristics, and hardware.

14 Claims, 27 Drawing Sheets

COLLAPSABLE SCREEN AND DESIGN METHOD

CROSS-REFERENCE TO RELATED APPLICATIONS

NONE

FEDERALLY SPONSORED RESEARCH

N/A

SEQUENCE LISTING

N/A

BACKGROUND

1. Field of Invention

This invention relates to window shades, collapsible partitions, folding screens, and the like.

2. Prior Art

Among the product categories within the window coverings industry are various types of curtains; Roman shades or blinds; Venetian blinds; pleated shades; roll-up or roller shades; vertical blinds; and others. In terms of functional typology, this list can account for almost all the products on the market at present and at any time in the past. This list of categories has remained unchanged for 50 years or more. The most recent category is vertical blinds, which were invented in the 1890s, but were not commercially popular until the 1940s. The rest of the categories have existed for hundreds of years.

Based on a review of prior art, the vast majority of improvements to window coverings have been detail-oriented rather than aesthetically based. Toti et al. (U.S. Pat. No. 2,567,256) disclose a Venetian blind with parallel undulating slats to provide a drapery like appearance. Toti recognizes that "the great objection to the use of Venetian blinds in artistic homes and buildings is that they contribute a barred window effect which is jail-like in its mechanical precision" which is overcome by Toti's undulating, rather than rigid, slats. Recent improvements in Venetian blinds have changed their overall visual effect very little. The same is true of the pleated shade and its most recent incarnation called the "cellular shade", which is essentially a pair of parallel-pleated webs of material glued together at every second pleat as exemplified by U.S. Pat. No. 5,104,469 and by U.S. Pat. No. 5,313,998, both by Colson, disclosing an expandable window covering in which a non-pleated fabric is attached to a pleated panel.

In addition, some other categories of window coverings have their own disadvantages. Curtains and Roman-type shades made of textiles are generally labor-intensive and thus costly to produce. Roll-up shades usually add little aesthetic effect to their surrounding environment, except for that contributed by the textile from which it is made. Vertical blinds, Venetian blinds, and pleated shades cannot be better described than by Toti as cited above.

Origami

Origami, the art of paper folding, has been practiced perhaps for as many centuries as paper has existed. Its basic tenets are that a square piece of paper is folded (typically not cut, glued, or otherwise transformed) into abstract representations of animals, objects, or geometrical shapes. Origami makes use of a large body of standard "base" fold-patterns and various styles of folding such as box pleating, modular origami, pictorial origami, and others. Origami has been practiced almost exclusively without lucrative or utilitarian ends.

Models exist for such things as slippers, dishes, cups, lampshades (traditional Chinese lanterns and Scandinavian designs of the 1960s), and folded maps (as in U.S. Pat. No. 4,502,711, "Sheet folding method and product", Muth, 1985, which is an improvement on an origami map fold). Patents have been issued for purely decorative objects that exhibit origami folds: U.S. Pat. No. 2,164,966 (Tutein, 1939) discloses a "pleated material and method" that is essentially a tessellation of folds, and U.S. Pat. No. 2,922,239 ("Decorative ornament", Glynn, 1960) is an improvement on an origami model called a flexagon which was first folded by Arthur Stone in the UK in 1939 (Kenneway, E., *Complete Origami*, New York, St. Martin's Press, 1987, p. 57).

Origami-type folds have been used in materials other than paper and for uses other than decorative. An example is Nojima's published application No. WO 01/081821 of 2001 entitled "Structure with folding lines, folding line forming mold, and folding line forming method", which suggests the formation of collapsible objects in flexible plastic, such as PET bottles, making use of patterns of folds known to the field of origami.

Furthermore, structures based on origami folds, or based on models folded in paper to simulate large-scale structures, take advantage of the fact that the rigidity or stiffness of a sheet material can be increased by the addition of folds. Examples include GB Patent 1,170,785 (Quarmby, 1966) titled "Foldable building units", GB Patent 2,119,825 (Singh et al., 1982) titled "Erecting folded-plate structure", and U.S. Pat. No. 3,939,615 (Sorkin, 1976) titled "Foldable roof construction element". The rarity of such structures in commerce today might show that they rely on material strength characteristics that go beyond what is possible in a sufficiently large dimension, or that problems associated with cost remain unsolved. Also, such models gain rigidity through folding, but they do not gain stability; their stability is largely dependent on their anchor points on the ground.

Origami Mathematics and Computational Origami

Mathematicians, physicists, and other scientists have interested themselves in origami in recent years. One interest is to represent the folding of paper mathematically, in order to analyze and predict the folding of paper (or other sheet materials) for applications in engineering, chemistry and medicine on a molecular scale, and other sciences. Exemplary articles include:

Cipra, Barry A., "In the Fold: Origami Meets Mathematics", *SIAM News*, Vol. 34, No. 8, ff. 1-4.

Hull, Thomas, "Counting Mountain-Valley Assignments for Flat Folds", *Ars Combinatoria,* 2002.

Hull, Thomas, "The Combinatorics of Flat Folds: a Survey", *The Proceedings of the Third International Meeting of Origami Science, Mathematics, and Education*, A. K. Peters, 2002.

There has been recent interest in a relatively new type of origami called the tessellation, a geometric pattern of concave and convex fold lines, imparted and repeated ad infinitum into a planar sheet. Examples include US Patent application 2005/0113235 by B. Basily and E. Elsayed entitled "Technology for continuous folding of sheet materials" and US Patent application 2002/0094926 by D. Kling titled "Patterning technology for folded sheet structures", both of which apply to the manufacture of tessellated webs or continuous sheets of material intended for use in structural hollow-core building materials, and US Patent application 2004/0098101 by Z. You and K. Kuribayashi entitled "Deployable Stent" is an origami-based medical implant that unfolds inside the human body. Tessellations of folds or hinges have also been used to design a deployable Fresnel lens for use in a space telescope.

No Prior Combination of Origami and Window Coverings

With reference to all the above cited examples of concentrated study and practical application of origami, as well as countless other examples not referenced herein, a thorough search of relevant prior art has revealed no examples of origami folds being applied to a functional window covering.

In Japan, although paper has long been used to cover shoji screens and sliding doors, it has always been used passively, glued to the rigid frame, despite the Japanese invention of the art of origami. US and foreign Patents for window shades have been observed wherein paper was once a commonly used material, yet the shades were always folded with parallel folds. The very common "pleated window shade" always makes use of parallel pleats, even when its inventor seeks to create some different aesthetic effect on the window. For example, Park's U.S. Pat. No. 451,068 of 1891 entitled "Window Shade" discloses a way in which a typical pleated window shade can be raised on one side, creating an arc across the window so that it is "draped artistically as by a lace curtain or lambrequin". Another example is U.S. Pat. No. 6,431,245 (Shen, 2002), disclosing a hinged bottom stave which causes the pleated material to form a semicircular bottom edge when raised, once again using the standard parallel pleats.

Still other Patents for pleated window shades reflect alterations of shape imposed by the architectural opening in which they are to be installed: Schnebly's U.S. Pat. No. 4,934,436 (1990) discloses pleated shades and their mechanisms for semicircular and other nonrectangular windows, every example showing parallel pleats. Zimmer's US Patent Application 2006/0289130 is entitled "Window Origami Panels and the Like", but focuses mainly on fastening the fabric panels to a plurality of fasteners by a number of holes near the edges of the panels; the relevance of origami is only in the visual effect of how the panels are hung.

SUMMARY

According to one embodiment, a light-controlling device comprises a plurality of panels and at least one origami fold. The origami fold(s) form axes around which their adjacent panels may pivot, and at least two such axes form an angle between zero and 180 degrees. The interconnected panels and folds form a relationship in which they are constrained to collapse and expand unitedly.

According to another embodiment, a design method allows its user to create a product (a collapsible screen) which meets specific objectives. The method entails selecting a base area which is to be obscured by the lowered screen, selecting or creating patterns, imparting the patterns as folds into a model sheet, analyzing or evaluating the result according to a set of criteria, and modifying the model sheet to improve it with respect to one or more of the criteria. The imparting of patterns, analyzing of the model sheet, and modification of the model sheet occurs until the model sheet represents a solution or a partial solution which may meet the initial objectives, at which point the design solution becomes a range of product specifications.

DRAWINGS

Figure 21:
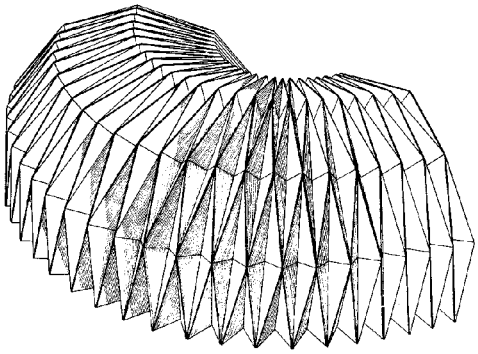

FIG. 21 is a prior art perspective view of an embodiment of the same tessellation partially collapsed (U.S. Pat. No. 3,524,288 FIG. 9).

Figure 19:
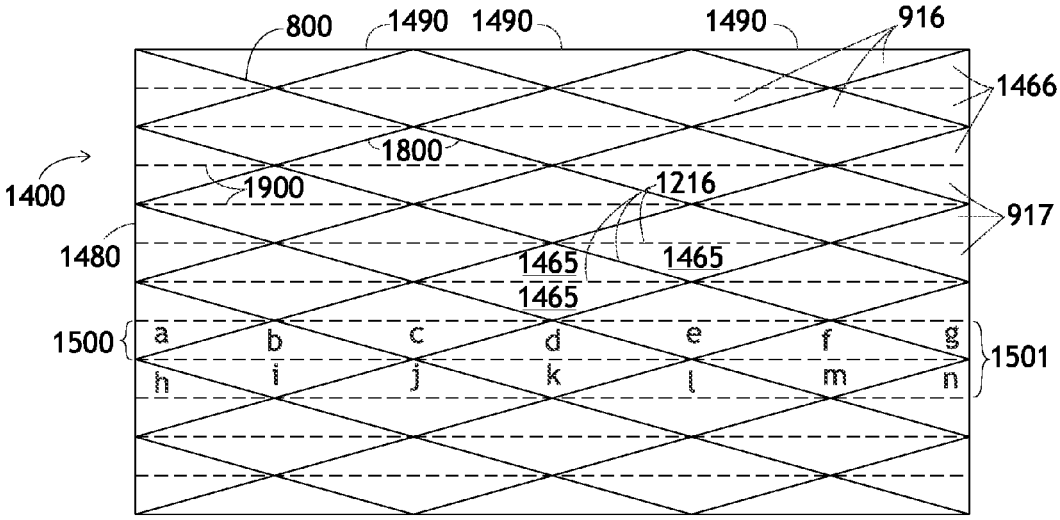
FIG. 19 is a schematic view of a tessellation comprising the tessellation cells of FIG. 18 repeated within a planar rectangle.
Figure 22:
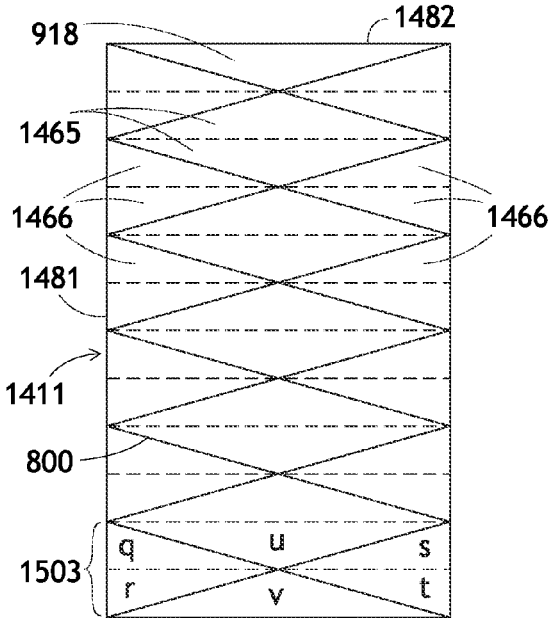

FIG. 22 is an elevation view of a model sheet containing the tessellation of FIG. 19.

Figure 23:
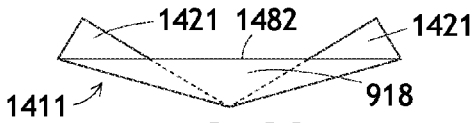

FIG. 23 is a plan view of the model sheet of FIG. 22 when folded and fully collapsed.

Figure 24:
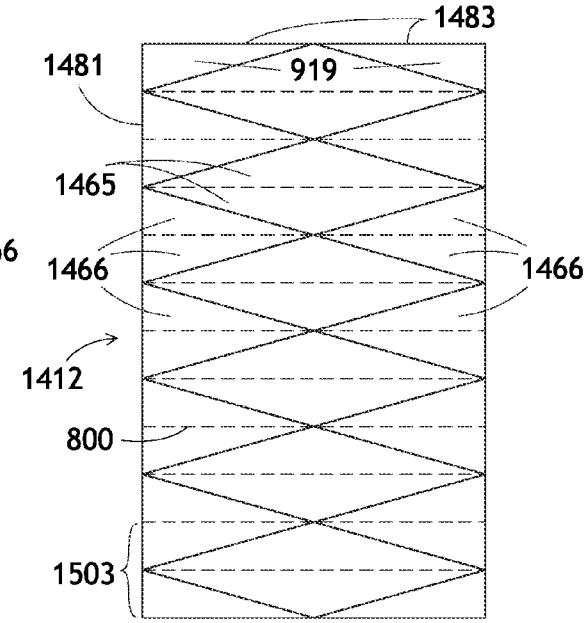

FIG. 24 is an elevation view of a model sheet containing the tessellation of FIG. 19 with a different relation to the model sheet's top edge.

Figure 25:
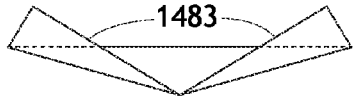

FIG. 25 is a plan view of the fully collapsed model sheet of FIG. 24.

Figure 26:
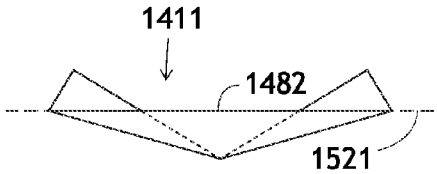

FIG. 26 is a plan view showing the location of an additional fold imparted into the stacked layers of the fully collapsed model sheet of FIG. 22.

Figure 27:
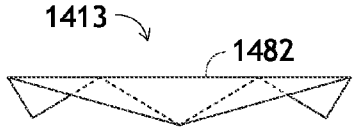

FIG. 27 is a plan view of the model sheet of FIG. 26 after the additional fold has been imparted.

Figure 28:
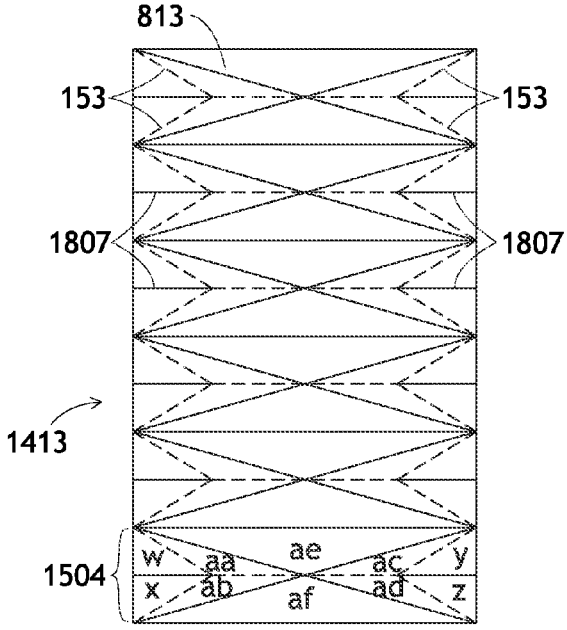

FIG. 28 is an elevation view of the model sheet of FIG. 27 fully expanded, showing the resultant additional fold lines.

Figure 29:
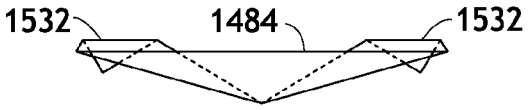

FIG. 29 is a plan view of a fully collapsed material illustrating the result of imparting an additional fold into the model sheet of FIG. 27 at a different position.

Figure 30:
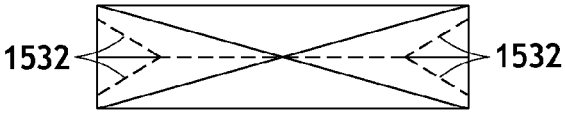

FIG. 30 is an elevation view of the fully expanded model sheet of FIG. 29.

Figure 31:
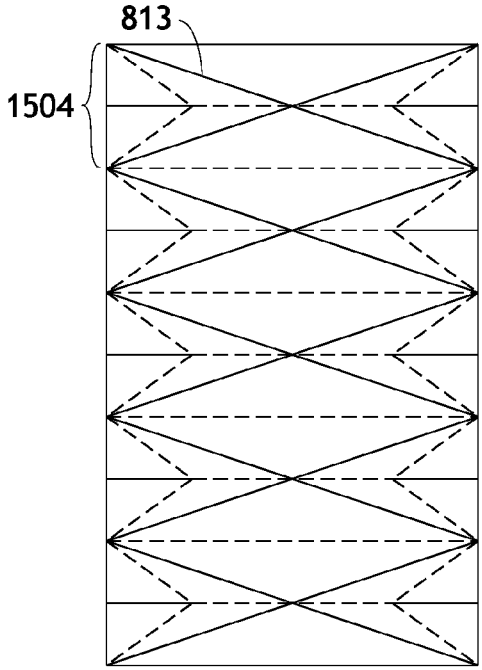

FIG. 31 is a model sheet having a module of taller proportion than that of FIG. 28.

Figure 32:
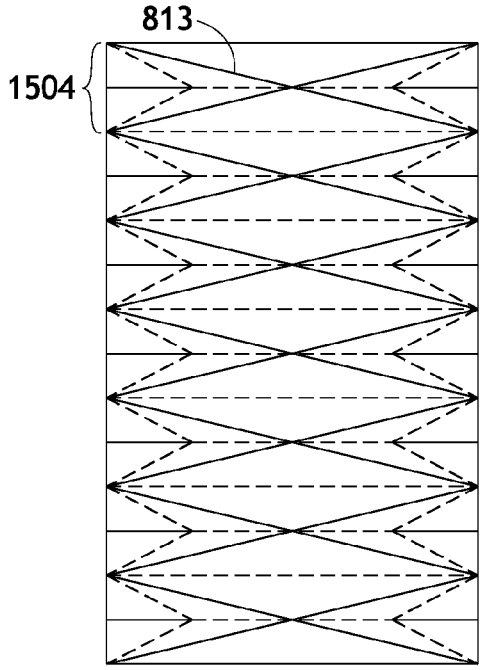

FIG. 32 is a model sheet having a module of shorter proportion than that of FIG. 28.

Figure 33:
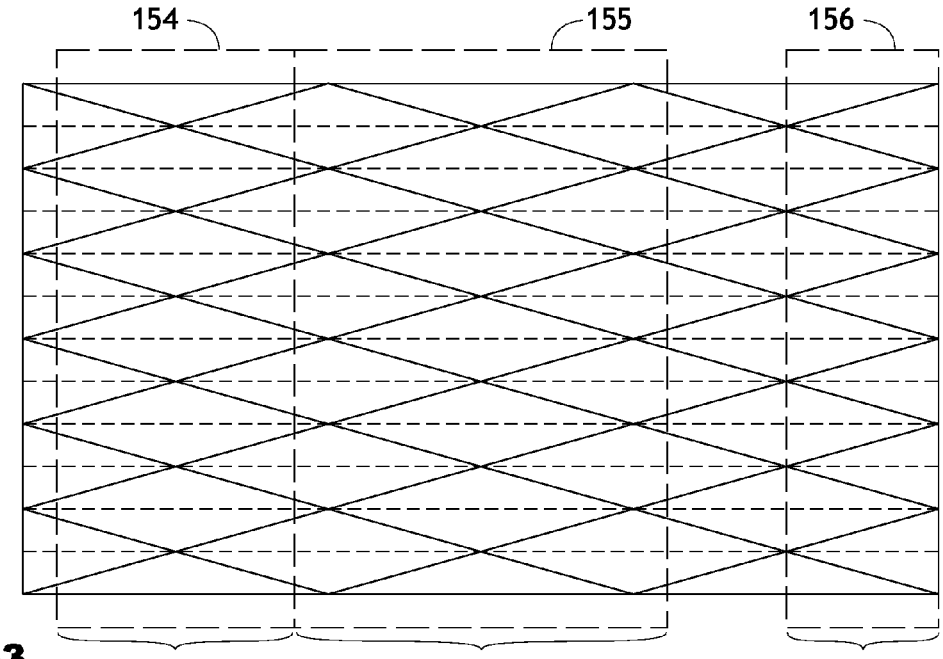

FIG. 33 is the tessellation of FIG. 19 illustrating other possible embodiments.

Figure 34:
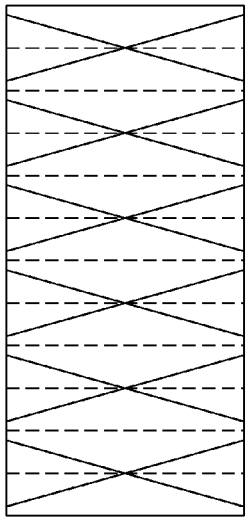

FIG. 34 is a model sheet of width less than that of a single tessellation cell.

Figure 35:
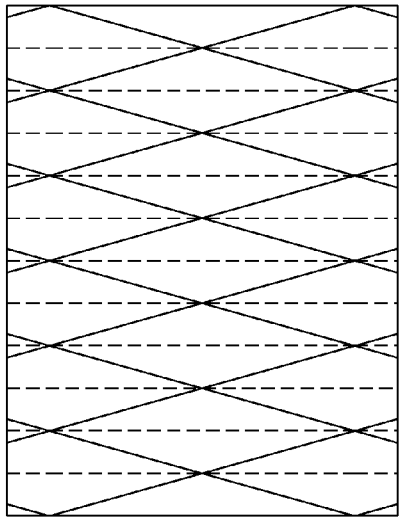

FIG. 35 is a model sheet of width greater than that of a tessellation cell.

Figure 36:
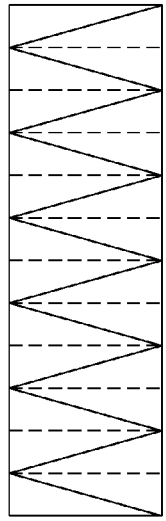

FIG. 36 is a model sheet of width half that of a single tessellation cell.

Figure 37:
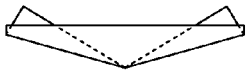

FIG. 37 is a plan view of the model sheet of FIG. 34 fully collapsed.

Figure 38:
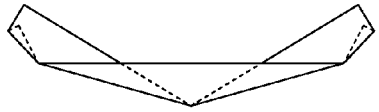

FIG. 38 is a plan view of the model sheet of FIG. 35 fully collapsed.

Figure 39:
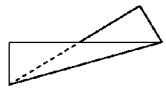

FIG. 39 is a plan view of the model sheet of FIG. 36 fully collapsed.

Figure 40:
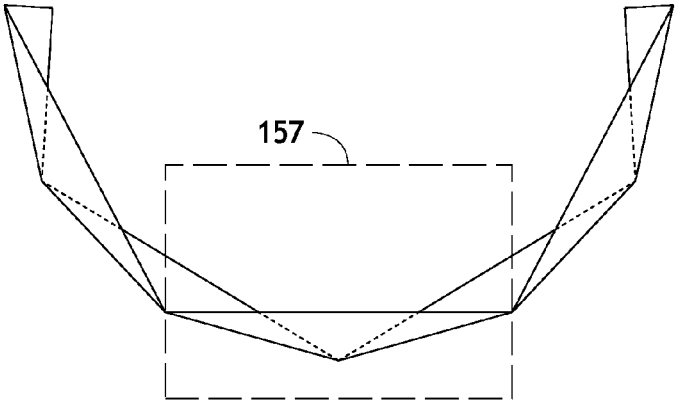
Figure 41:
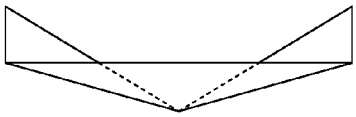

FIG. 40 is a plan view of a fully collapsed model sheet like FIG. 33 where a long-dashed box locates the fully collapsed plan view of the model sheet of FIG. 41.

FIG. 41 is a plan view of a fully collapsed model sheet.

Figure 42:
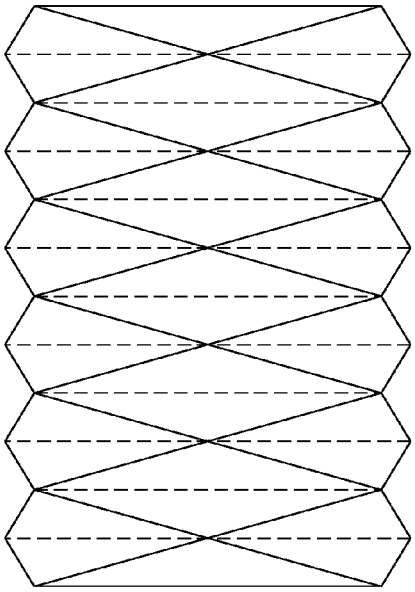

FIG. 42 is an elevation view of the fully expanded model sheet of FIG. 41.

Figure 43:
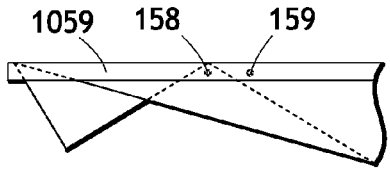

FIG. 43 is a cutaway plan view of the collapsed model sheet of FIG. 28 showing the relation of pull cord holes to a top rail and to the model sheet.

Figure 44:
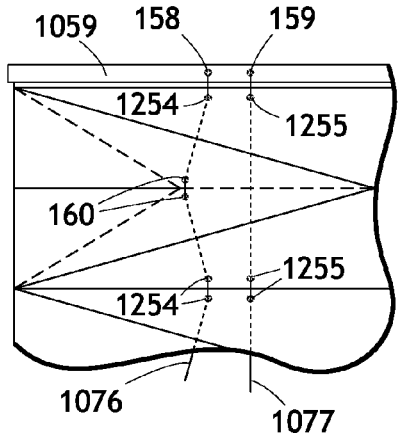

FIG. 44 is a cutaway elevation view of the expanded model sheet of FIG. 43 with pull cord holes in its panels.

Figure 45:
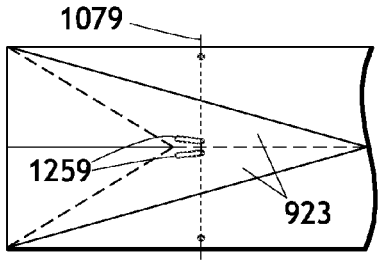

FIG. 45 is a cutaway elevation view of an alternative model sheet to FIG. 44, wherein some pull cord holes are elongated.

Figure 46A:
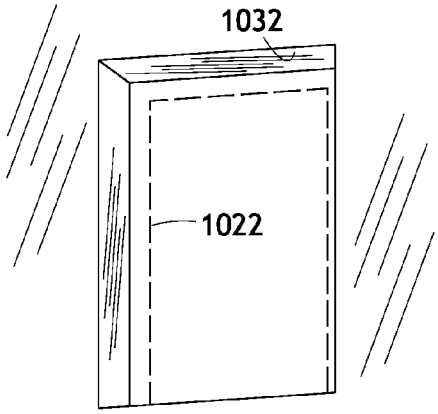

FIG. 46A is a perspective view of a possible location for an embodiment.

Figure 46B:
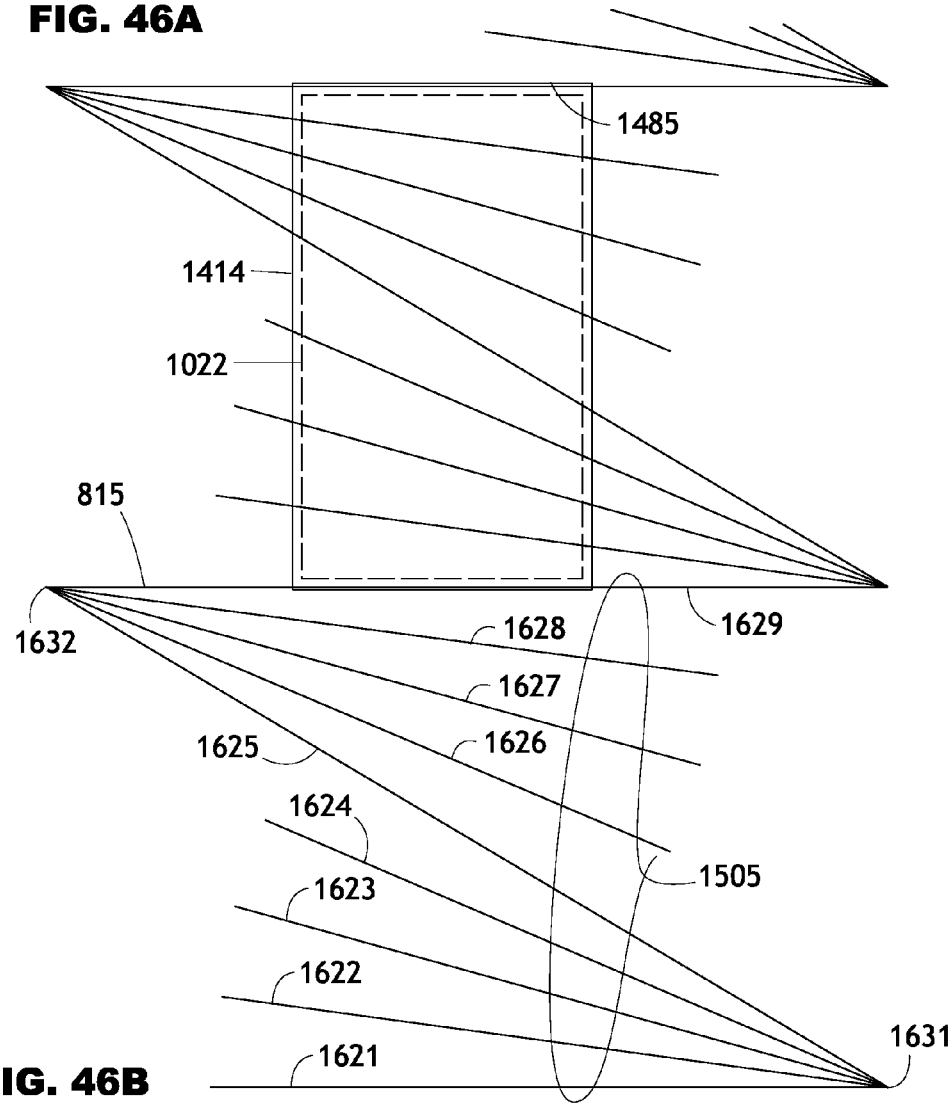

FIG. 46 FIG. 46B is an elevation view of a vertically repeated pattern of radial fold lines and a rectangular planar shape in which the pattern is imparted.

Figure 47:
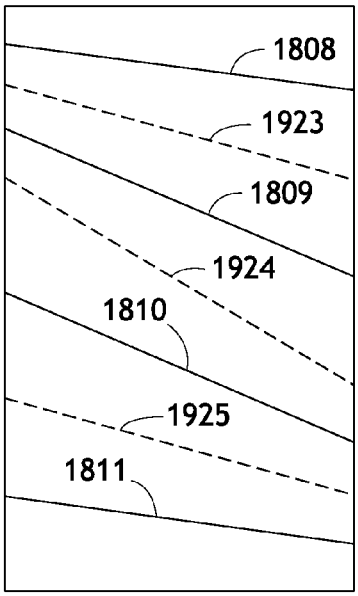

FIG. 47 is a fully expanded elevation view of a model sheet according to FIG. 46B.

Figure 48:
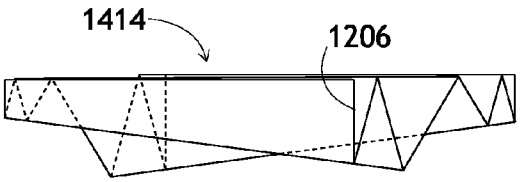

FIG. 48 is a plan view of the embodiment of FIG. 47 in a fully collapsed state.

Figure 49:
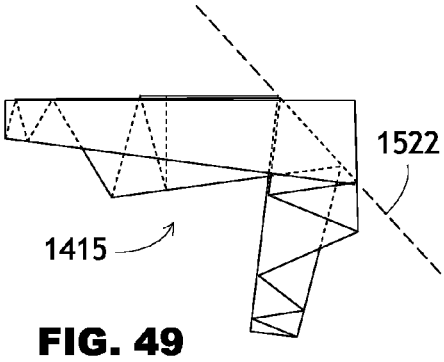

FIG. 49 is a plan view showing the location of an additional fold imparted into the stacked layers of the fully collapsed model sheet of FIG. 48.

Figure 50:
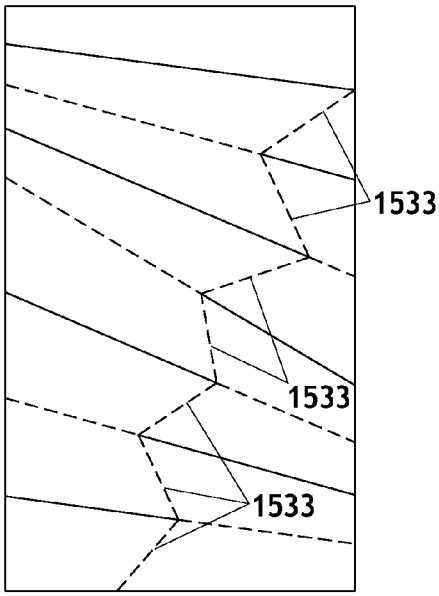

FIG. 50 is a fully expanded elevation view of the model sheet of FIG. 49.

Figure 50A:
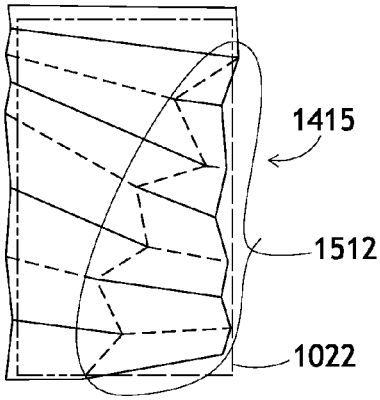

FIG. 50A is a perspective view of the model sheet of FIG. 50, showing that the additional imparted folds create a concave shape in the material.

Figure 51:
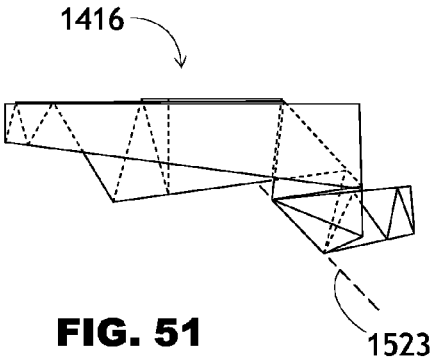

FIG. 51 is a plan view showing the location of an additional fold imparted into the stacked layers of the fully collapsed model sheet of FIG. 50.

Figure 52:
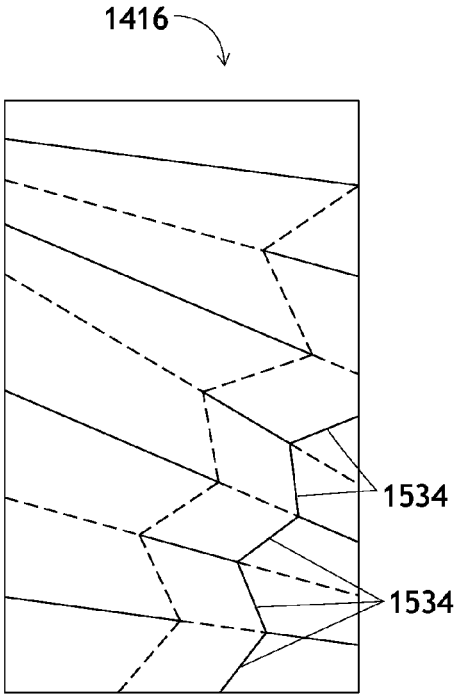

FIG. 52 is a fully expanded elevation view of the model sheet of FIG. 51.

Figure 53:
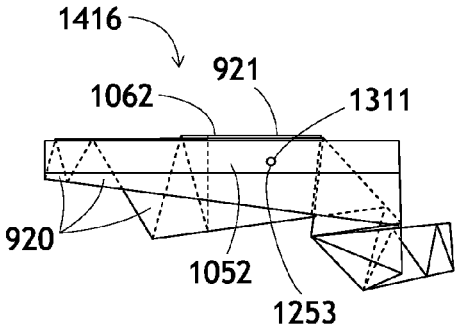

FIG. 53 is a plan view of the fully collapsed model sheet of FIGS. 51-52, with the addition of frame members and a hole.

Figure 54:
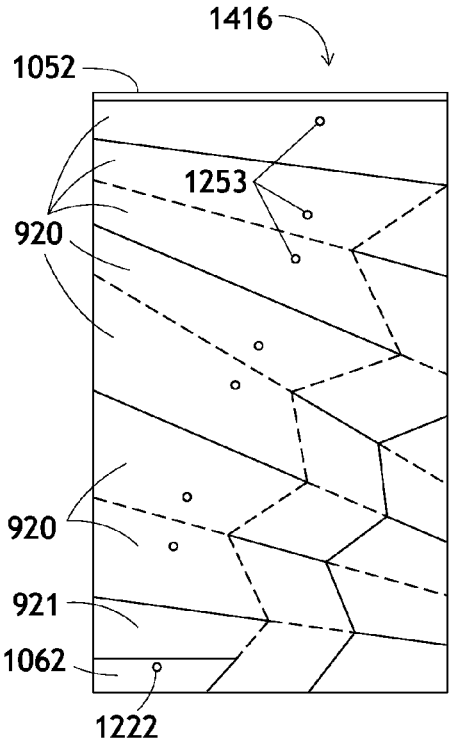

FIG. 54 is an expanded elevation view of the model sheet of FIG. 53 showing the pattern of holes which result from propagating the hole of FIG. 53 into the stacked layers of the collapsed model sheet.

Figure 10:
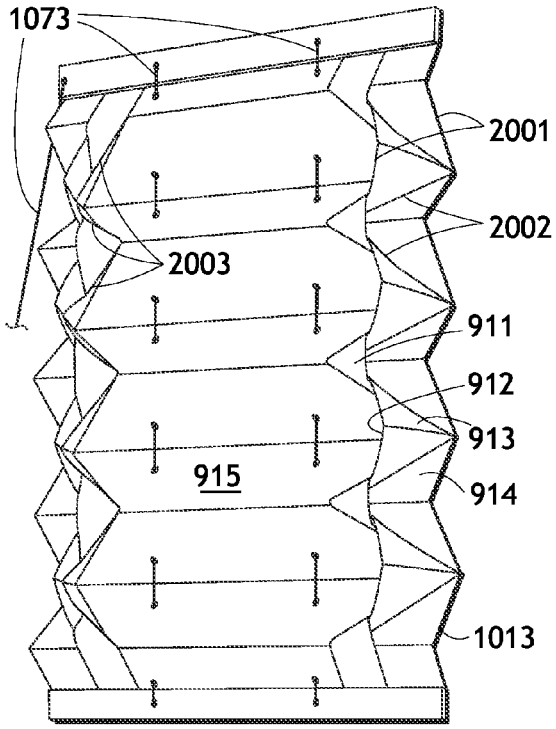
FIGS. 10-10B are perspective views of a third embodiment in various states of operation from fully expanded (FIG. 10) to fully collapsed (FIG. 10B).
Figure 55:
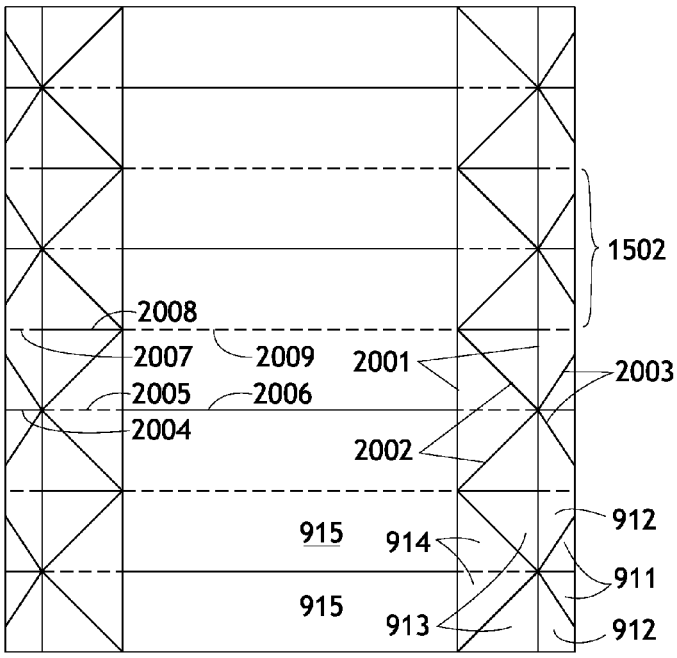

FIG. 55 is a model sheet comprising the panels of the embodiment of FIG. 10.

Figure 56:
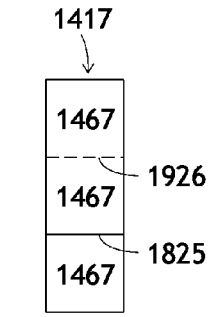

FIG. 56 is an elevation view of a model sheet having two folds and three panels.

Figure 57:
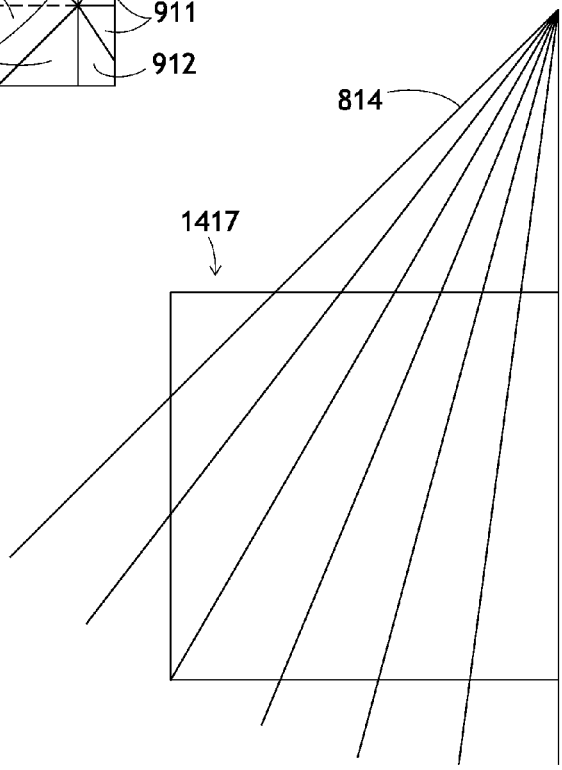

FIG. 57 is a set of radial folds to be imparted into the collapsed model sheet of FIG. 56.

Figure 58:
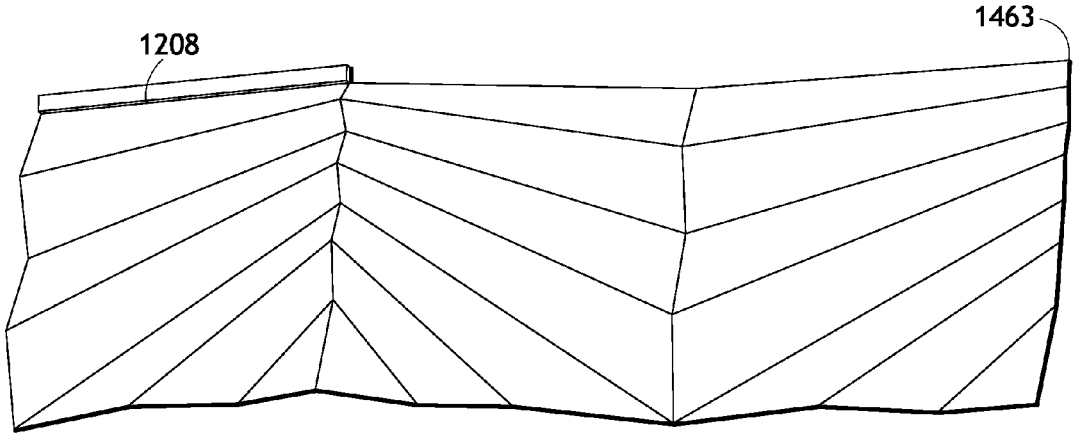

FIG. 58 is a perspective view of the model sheet of FIG. 57 in a fully expanded state.

Figure 58A:
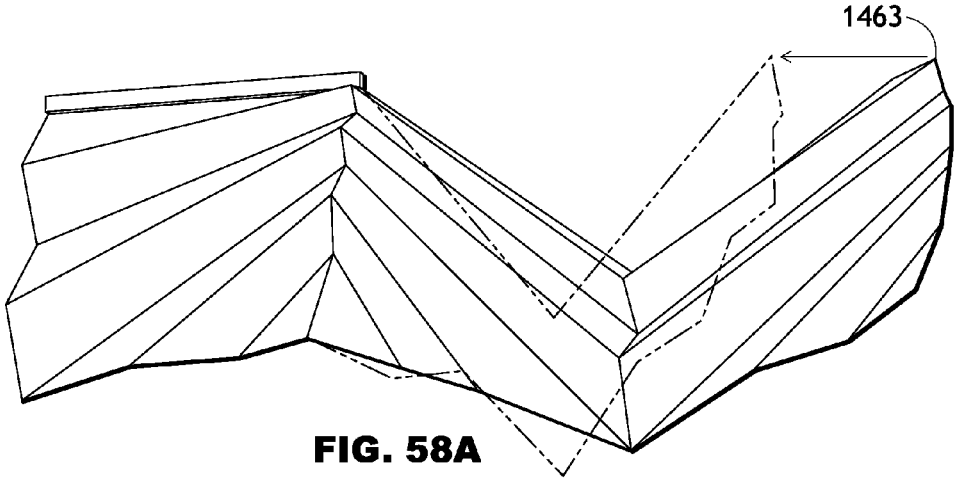
Figure 58B:
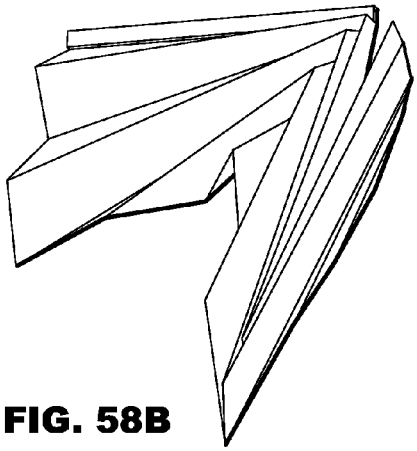
Figure 58C:
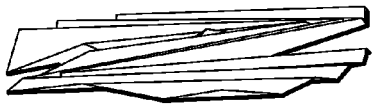

FIGS. 58A-58C are perspective views of the model sheet of FIG. 58 in various states from partially collapsed (FIG. 58A) to fully collapsed (FIG. 58C).

Figure 11:
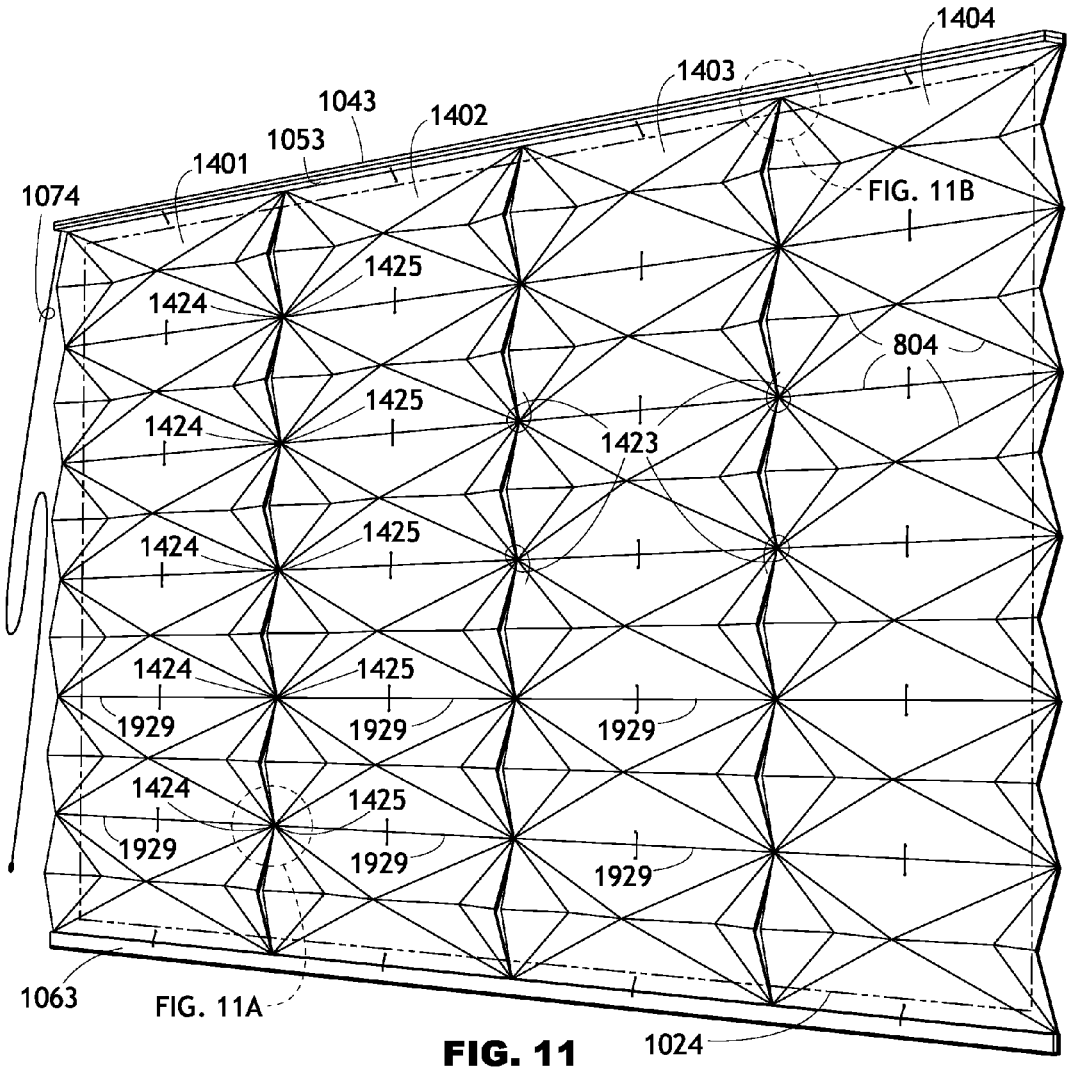
FIG. 11 is a perspective view of a fourth embodiment in the expanded (lowered) state.
Figure 59:
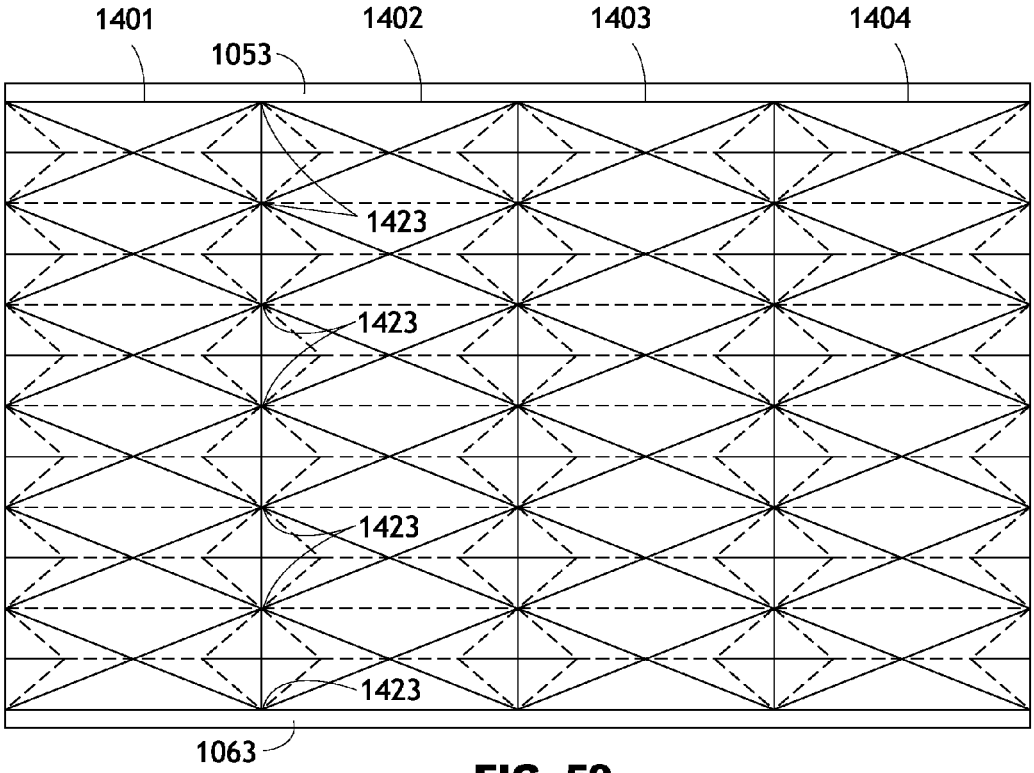

FIG. 59 is an elevation view of the embodiment of FIG. 11 in its fully expanded state.

Figure 60:
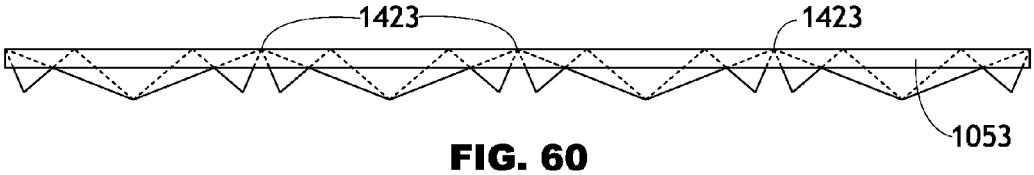

FIG. 60 is a plan view of the embodiment of FIG. 11 in its fully collapsed state.

Figure 61:
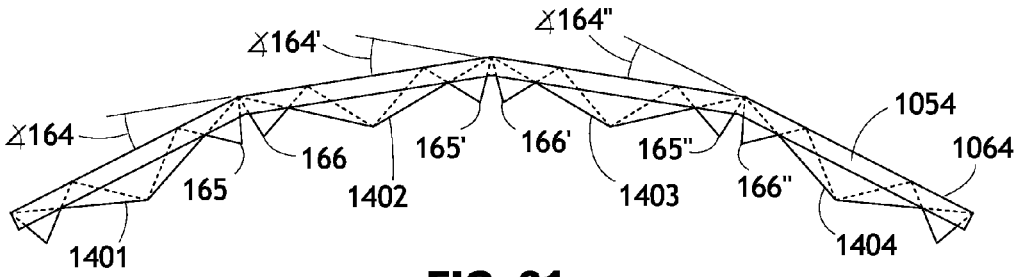

FIG. 61 is an alternative plan view to FIG. 60 wherein the collapsible materials are disposed along a curved surface.

Figure 62:
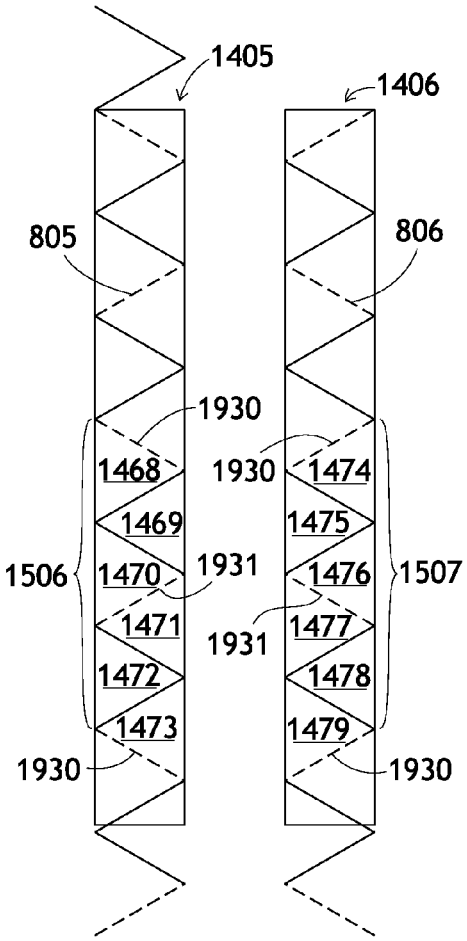

FIG. 62 shows a pair of collapsible materials exhibiting limiting relationships.

Figure 63:
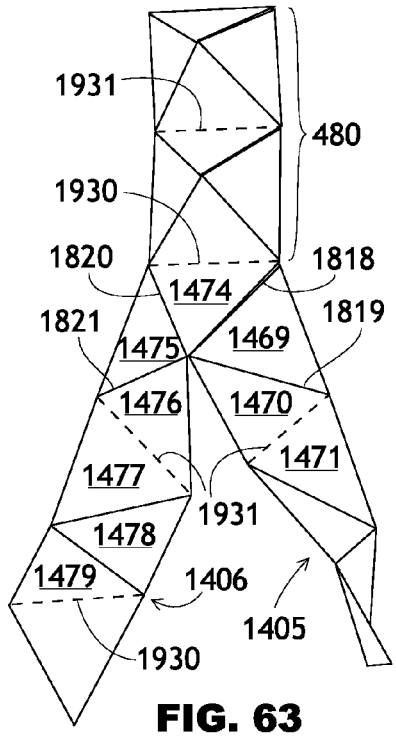
Figure 64:
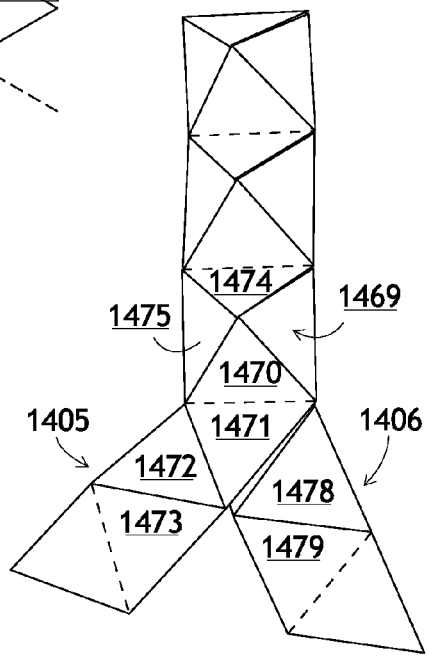

FIGS. 63-64 are perspective views of the two materials of FIG. 62 as they are intertwined to form limiting relationships among the panels.

Figure 65:
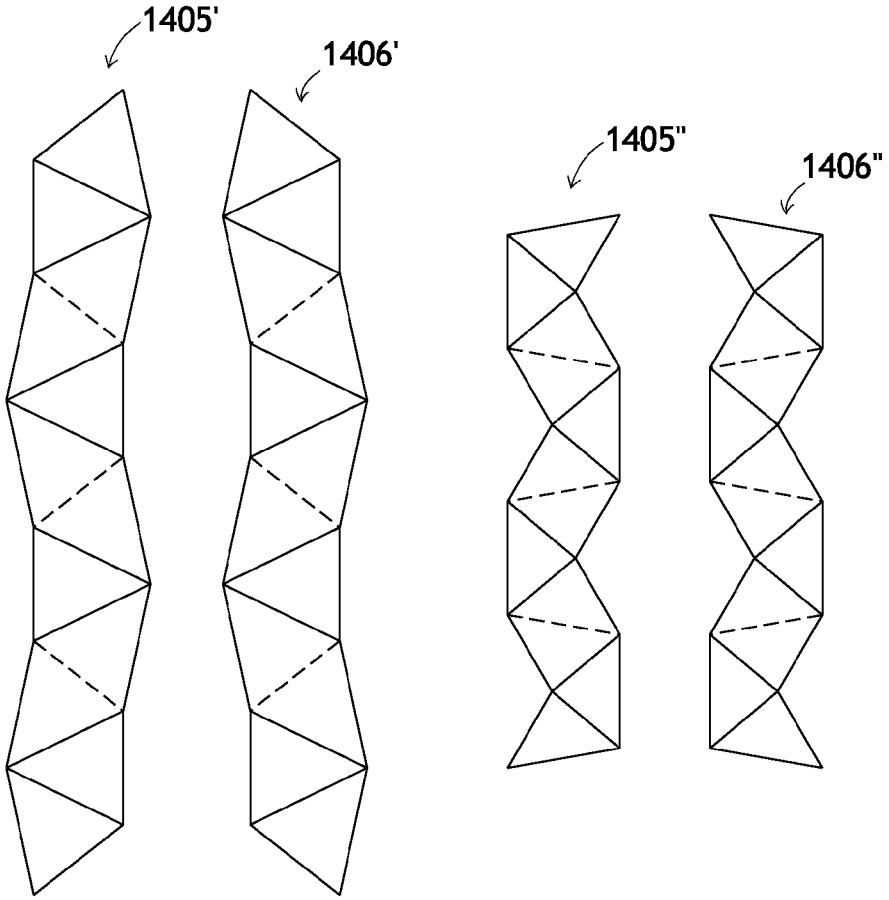

FIG. 65 is a plan view of two alternative pairs of limiting collapsible materials.

Figure 12:
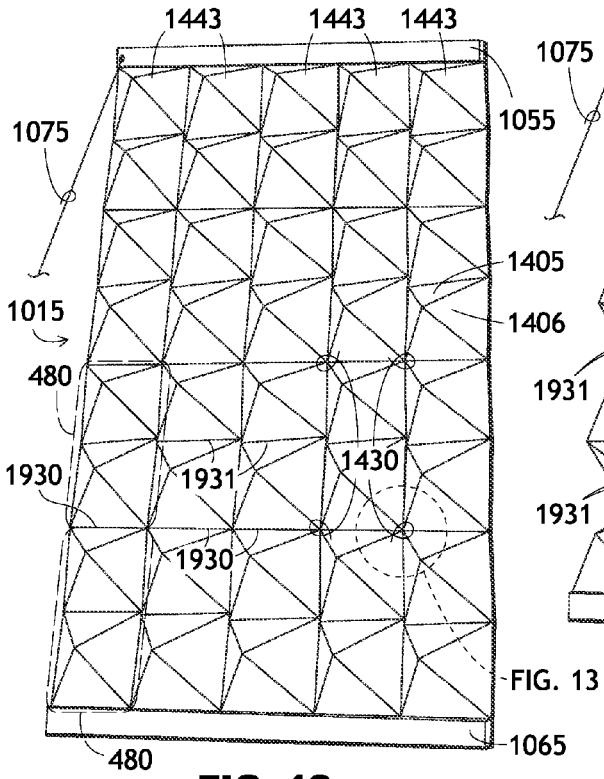
FIGS. 12-12C are perspective views of a fifth embodiment in various states of operation from fully expanded (FIG. 12) to fully collapsed (FIG. 12C).
Figure 66:
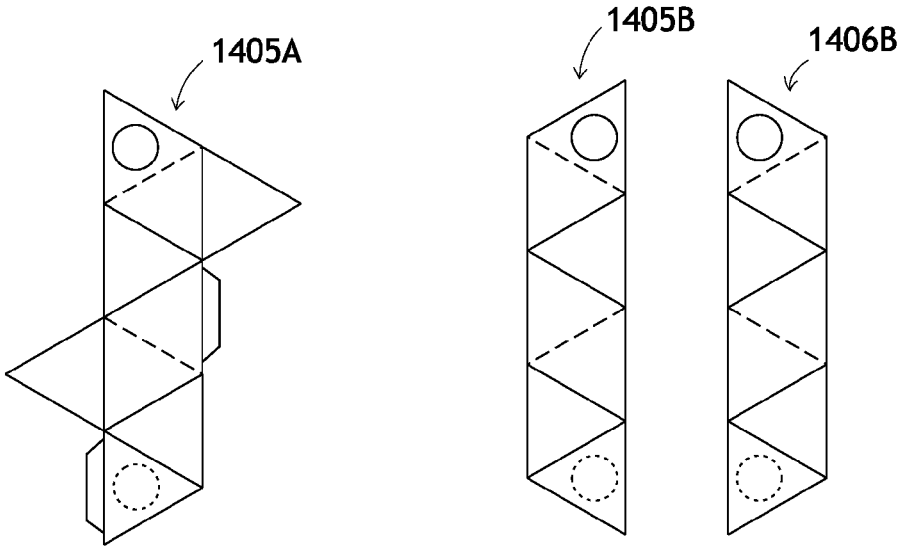

FIG. 66 is a plan view of two alternative configurations of panels including gluing panels that could achieve the same functional arrangement as shown in FIG. 12.

Figure 67:
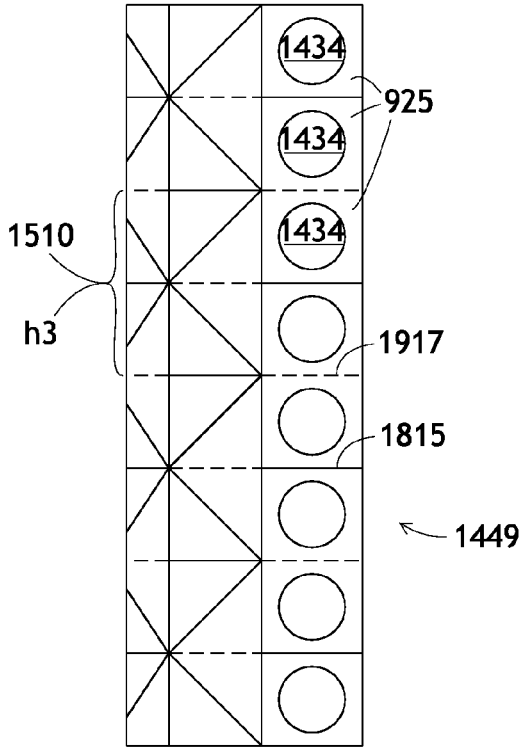
Figure 69:
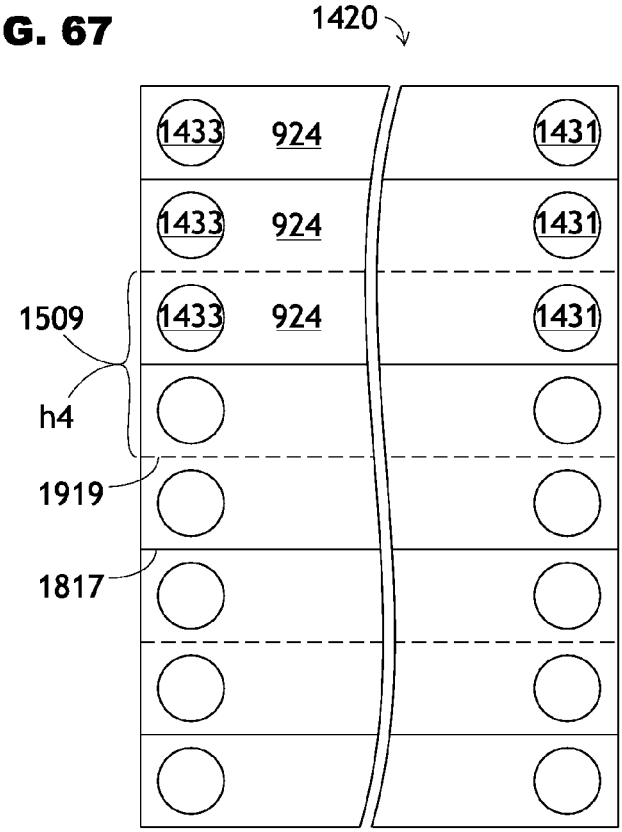

FIG. 67 is an elevation view of a collapsible material in which encircled regions correspond to encircled regions of the panels of the material of FIG. 69.

Figure 68:
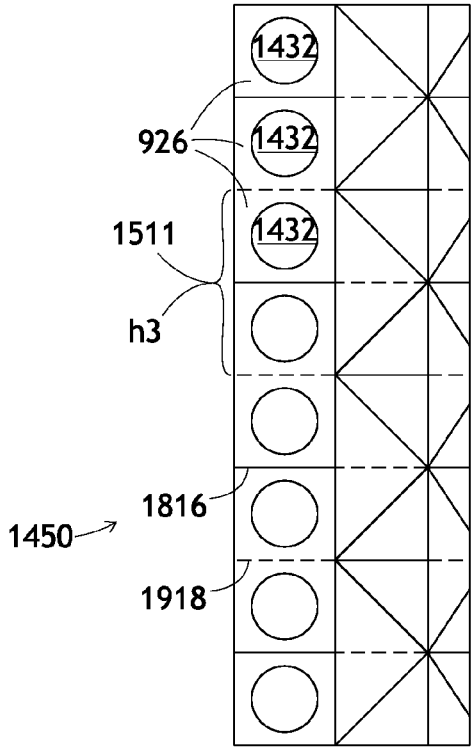

FIG. 68 is an elevation view of a collapsible material symmetric to that of FIG. 67.

Figure 15:
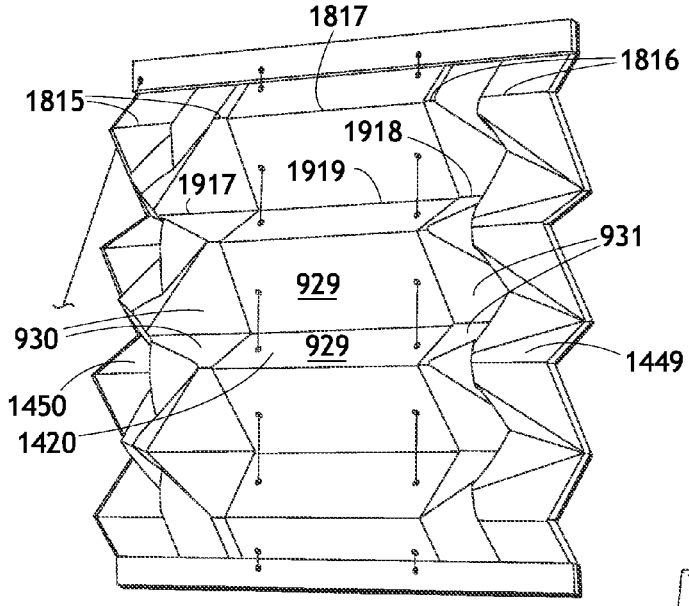
FIG. 15 is a perspective view of a seventh embodiment in the expanded state, which is an alternative embodiment to that of FIG. 10.

FIG. 69 is an elevation view of a collapsible material in which encircled gluing regions correspond to encircled regions of FIGS. 67-68, these three materials together forming the panels of the embodiment of FIG. 15.

Figure 70:
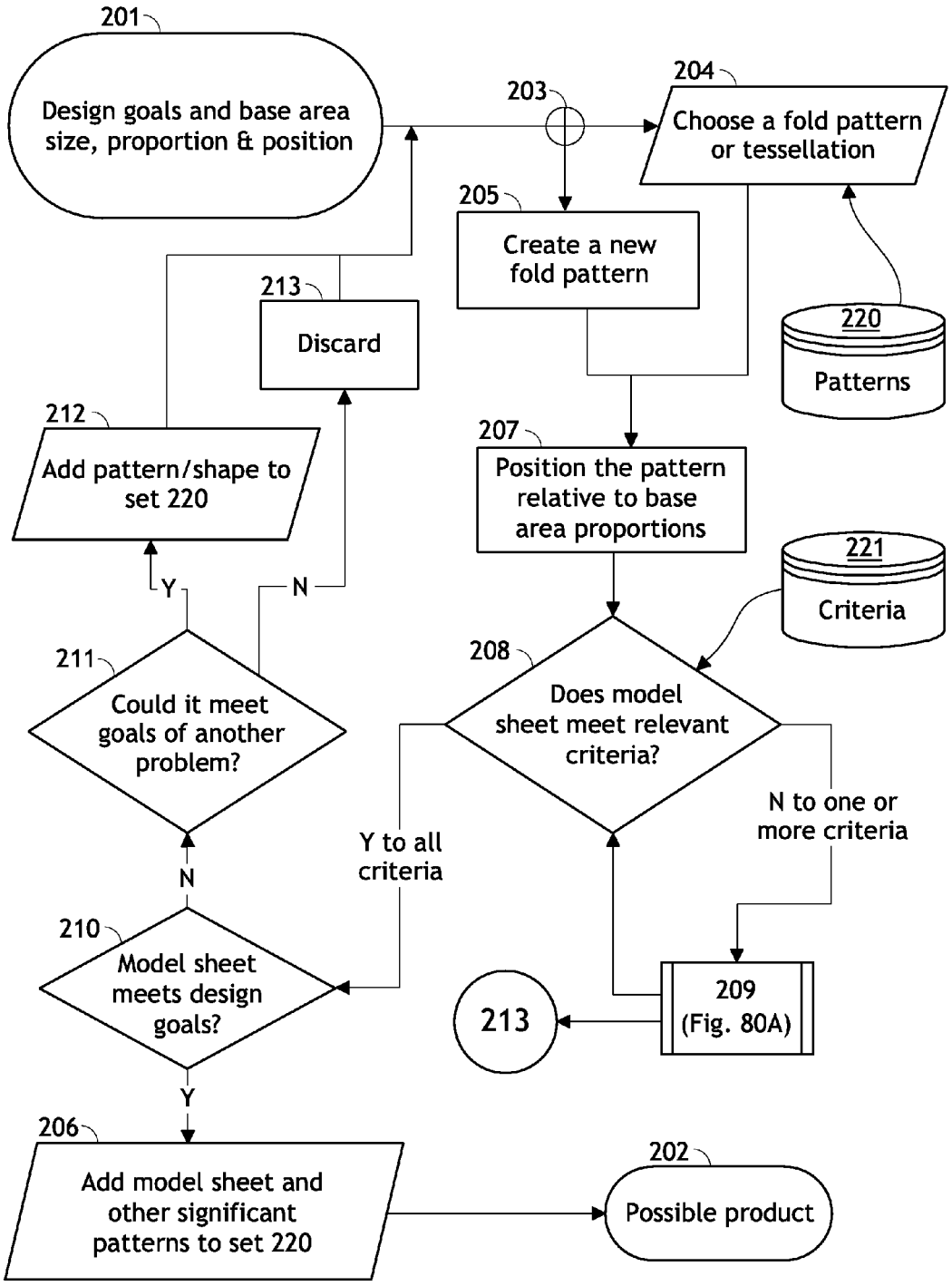
Figure 70A:
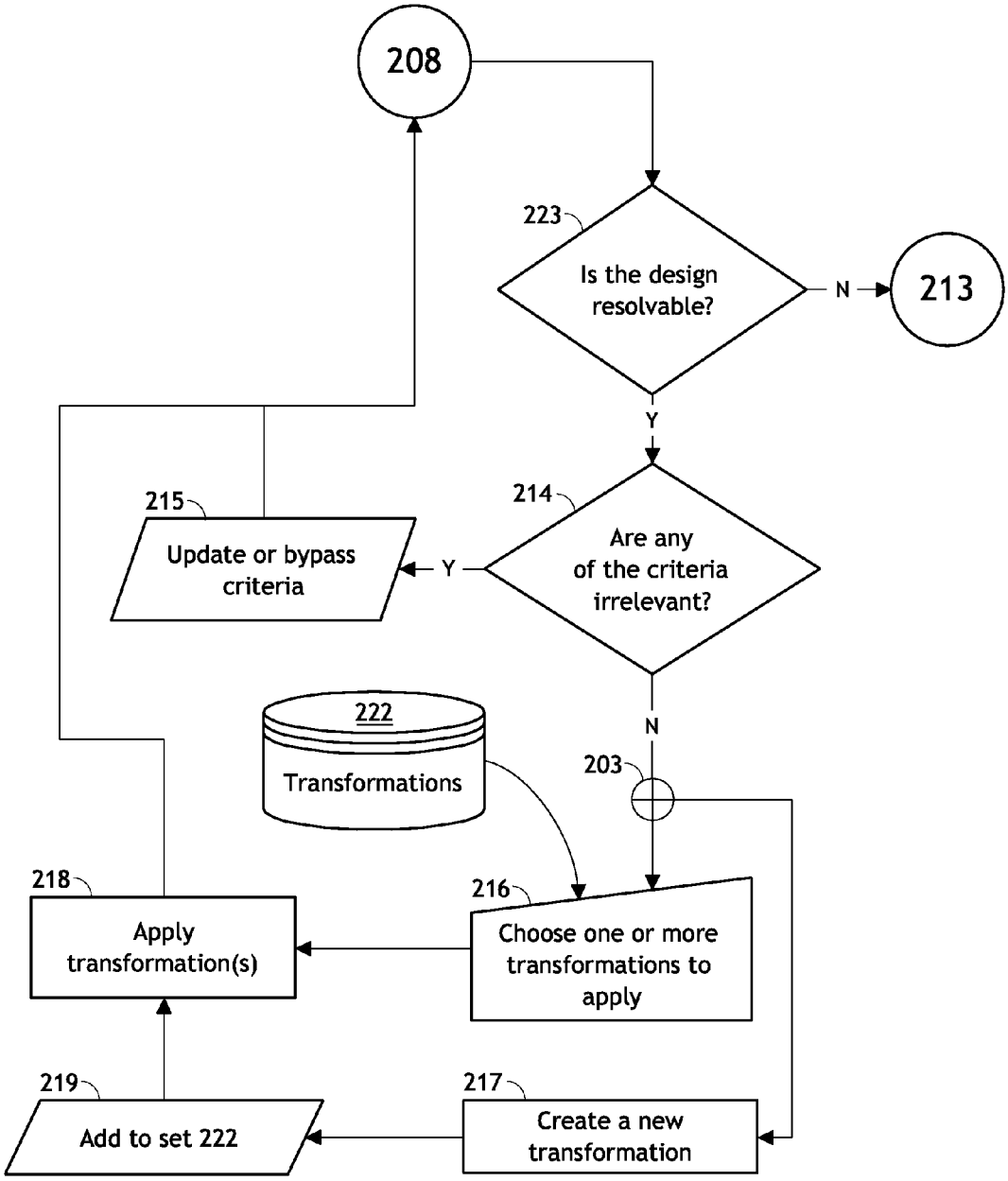

FIGS. 70-70A show a flowchart describing a method for designing new embodiments.

GLOSSARY

ANCHOR POINT—A point on a light-controlling device, or on a bottom rail attached to the light-controlling device, substantially distant from a frame, at which a pull cord is fixedly attached.

BASE AREA—A) a curved or planar two dimensional convex surface of any predetermined shape located in a space between a first region of that space and a second region of that space, occupied, covered, or obscured by one or more collapsible material(s) to control the amount of light passing through the base area to the second region from the first region. B) A planar or non-planar geometric surface, having proportions defined by its dimensions, intended to be occupied, covered, or obscured by a light-controlling device, panels, or collapsible material(s) in an expanded state.

COLLAPSED—A fold is said to be in a collapsed state when regions of the panels adjacent to the fold are displaced, by rotation about the fold's axis, away from their relative positions in an expanded state. A collapsible material is said to be collapsed when its panels are moved relatively farther from their fully expanded states.

COLLAPSIBLE MATERIAL—A) A discrete set of hingedly interconnected panels. B) A sheet of stiff material which has had one or more origami folds imparted into it in such a way that its folds collapse and expand when forces are applied to two or more of its points or edges.

CONCAVE—A fold is said to be concave when two regions adjacent to the fold may rotate through up to 180 degrees toward the viewer as the fold collapses, but the fold resists rotation beyond a state in which the fold approaches a convex (q.v.) state.

CONVEX—A fold is said to be convex when the regions adjacent to the fold may rotate through up to 180 degrees away from the viewer's perspective as they collapse, but resist rotation beyond a state in which they approach a concave fold relationship.

CROSS-LINKED—Two series of panels, each series comprising a set of points, folds, or panels, corresponding elements of each such set following the same paths while the two series of panels collapse or expand at the same rate, are cross-linked when corresponding elements are attached to each other by any connection such as a fold, hinge, linkage, seam, stitch, glue, staple, rivet, etc. Two series of panels can comprise for example two separate sheets of collapsible material, one series of panels belonging to each sheet, each series having a set of points corresponding elements of which are stitched together. Another example might be a single sheet of collapsible material comprising all of the following: two adjacent sets of panels cross-linked by folds between corresponding elements (panels), and other panels not belonging to either aforementioned set of panels.

ELEMENT—Any of the real or conceptual entities of which a set is composed; an entity that satisfies the criterion or criteria used to define a set.

EXPANDED—A hinge or fold is expanded when adjacent regions of panels form an included angle relatively closer to 180 degrees. A collapsible material is said to be expanded when its panels are moved relatively closer to their fully expanded states. An embodiment is in its fully expanded state when its collapsible material(s) are as close to a fully expanded state as they can be, given the materials' patterns of folds and given any attachments to any frame, filament, cross-linking, or any other attachment considered a functional part of that embodiment.

FILAMENT—An elongated member that exhibits no stiffness.

FOLD—A linear or curved hinge between two panels, at which a collapsible material can be collapsed or expanded with the application of forces within a plane perpendicular to the axis of the hinge.

FOLD, CURVED—A concave or convex fold comprising a locus of points that defines a curve; a fold represented by a curvilinear fold line.

FOLD DIRECTION—The direction of a fold with respect to the front of a collapsible material, either concave or convex, the front of the collapsible material being visible from an observer's perspective.

FOLD LINE—A mathematical line, line segment, or curve serving as a representation of a concave or a convex fold in a collapsible material.

FOLD, MOUNTAIN—A convex fold. This is a term used in the field of origami.

FOLD, VALLEY—A concave fold. This is a term used in the field of origami.

FRAME—A stiff or rigid member, such as a top rail, connected fixedly to an immobile support such as a wall, ceiling, etc., and supporting a light-controlling device and one or more pull cords.

LIGHT-CONTROLLING DEVICE—One or more collapsible materials.

LIMITING and LIMITED—A first set of panels is termed limiting collapsible material (or a limiting set of panels) and a second set of panels is termed limited collapsible material (or a limited set of panels) when the second series is unable to expand as much as if the first series were not present, because of its being cross-linked (q.v.) to the first series.

MATERIAL, STIFF—A material that can bend, but that tends to return to its previous shape when the bending forces are removed from the material. A stiff material will bend at one or more folds in the material if forces are applied in a plane normal to the fold line, and will resist bending forces at other points within the sheet material.

MEANS OF OPERATION—One or more pull cords for collapsing and expanding an embodiment.

MODEL SHEET—A) A representation or model of part or all of a possible embodiment having a proportion similar to that of an intended base area of a desired or intended embodiment whose pattern(s) of folds are being designed or are being modified to arrive at a representation of an embodiment. B) Any other reasonable representation of a possible embodiment or part thereof, including for example a mathematical model, a computerized graphical representation, or other tangible or intangible representation.

ORIGAMI FOLD or FOLDS—A) A fold or a set of folds in a stiff material, at least one panel created by which rotates on at least two axes as the fold collapses or expands. B) One or more folds in a collapsible material wherein at least two lines, each perpendicular to one such fold at a point on the fold, form an angle substantially between zero and 180 degrees.

PANEL—A) An area of a stiff material containing no folds (or hinges) and bounded by three or more edges of the material and/or folds. B) A physical embodiment or representation of a theoretical tessellation cell (q.v.).

PANEL, SPACING—A panel hingedly attached to a second panel whose purpose is to offset the second panel from a frame (q.v.) member, thereby allowing the panels to rotate about adjacent folds without interference by the frame.

PANEL, GLUING—A panel adjacent to a spacing panel (q.v.) and hingedly attached thereto, fixedly attached to a frame (q.v.).

PANEL, LIGHT-CONTROLLING—A panel forming part of a collapsible material, as distinguished from a gluing panel or a spacing panel.

PATTERN—A) A combination of lines and/or curves forming a consistent or characteristic arrangement thereof. B) A combination of folds and/or panels, forming a consistent or characteristic arrangement within a collapsible material or a part thereof. C) A distinctive style, model, or form of folds and/or panels forming a collapsible material or a part thereof.

POSSIBLE EMBODIMENT—the object of the disclosed design method, to which criteria and transformations are applied with the intention of making the object more practicable.

PROPORTION—A ratio of an embodiment's or a possible embodiment's dimensions in the elevation view, such as its width relative to its height. If the ratio of horizontal dimension to vertical dimension of a given embodiment is equal to the same ratio of another embodiment (whatever its dimensions), the two embodiments have equal proportion.

PULL CORD—A filament, attached at a first end to an anchor point, passing across a frame and having a second end for manual or mechanical operation.

PULL CORD END or ENDS—The end(s) of pull cord(s) opposite their anchor-point-attached ends, typically gathered into some tassel or fob for ease of handling, pulled away from or allowed to retract toward the embodiment in order to operate the embodiment.

REGION—An extensive, continuous part of a space, surface, or body.

SCREEN—A collapsible and expandable opaque, transparent, or translucent device, having a scale and proportion similar to a base area's scale and proportion, the base area being the intended focus or location for the screen, the screen comprising one or more collapsible materials supported by a frame near the base area such that the screen, in an expanded state, covers the base area and to some extent obscures or modifies the view and/or passage of light across (through) the base area.

SET—A) A number of things grouped together according to a system of classification. B) An assemblage of distinct entities or elements which satisfy certain specified conditions.

SPACE—A portion or extent of the unlimited three-dimensional expanse in which all material objects are located.

SUBSET—A set all the elements of which are contained in another set.

SURFACE—Any combination of geometric elements having only two dimensions.

TESSELLATION—A geometric pattern of tessellation modules (q.v.) which repeat ad infinitum in one or more directions.

TESSELLATION CELL—A geometric shape bounded by at least three tessellation lines, and containing no tessellation lines, serving as a geometric representation of a panel.

TESSELLATION LINE—A geometric line or curve, or a segment thereof, serving as a representation of a fold or a fold line (q.v.).

TESSELLATION MODULE—A finite set of tessellation lines and/or tessellation cells.

DETAILED DESCRIPTION

FIGS. 1, 5, and 6-17 are perspective views of several embodiments of the screen. None of these Figs. is intended to limit the scope of the invention to the specific embodiment shown therein; they are used to illustrate the various design concepts that underlie the invention, and to illustrate the structures that are common to all of its embodiments.

First Embodiment

FIGS. 1-8

Figure 1:
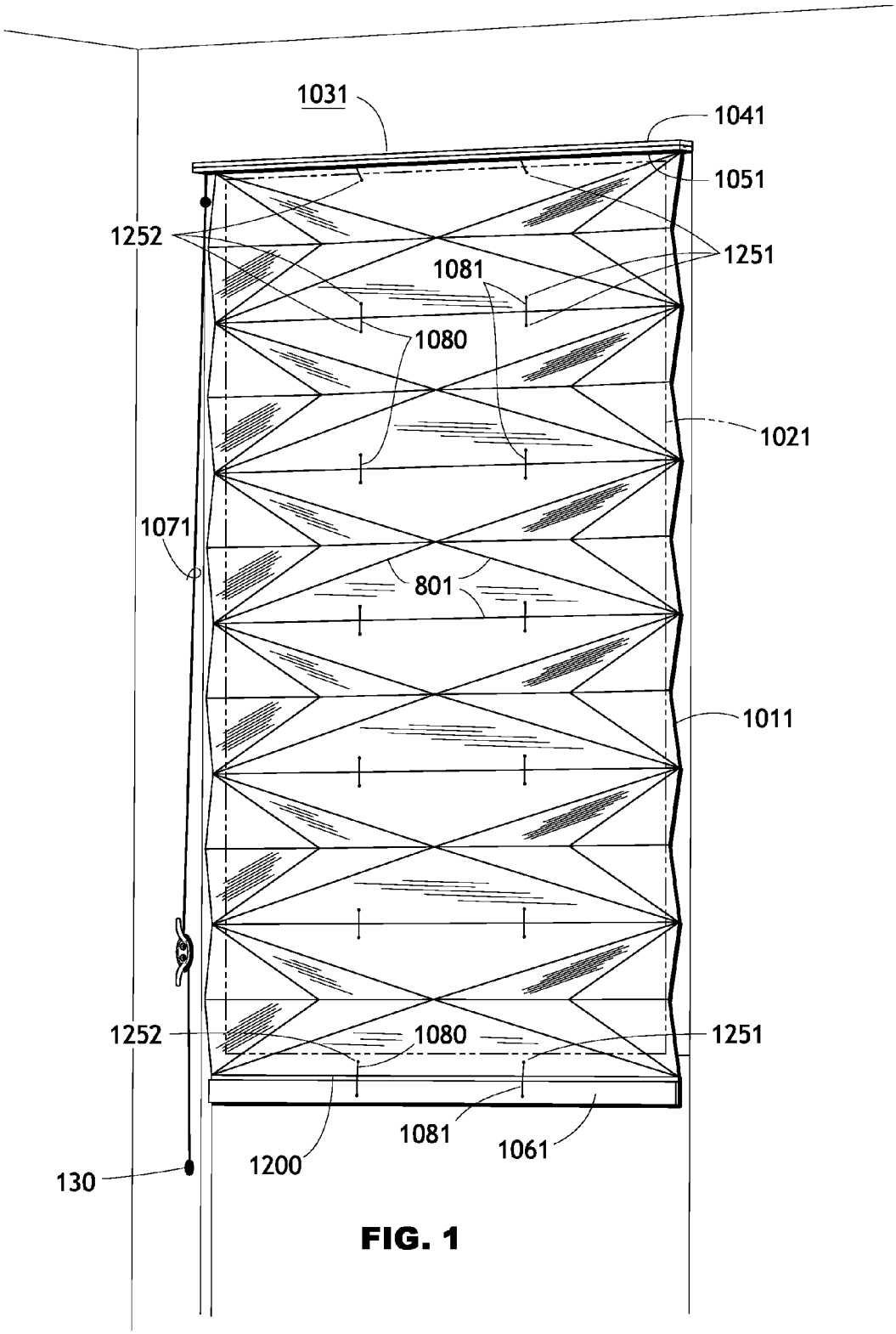
FIG. 1 is a perspective view of a first embodiment in its fully expanded (lowered) state.

FIG. 1 shows a perspective view of a first embodiment in its fully expanded, or lowered, state. A collapsible material 1011, forming a light-controlling device, covers or occupies a theoretical base area 1021 (indicated by a long-dashed rectangle) and hides the base area from view if the material is opaque, or somewhat obscures the base area if the material is translucent or transparent, when the collapsible material is in its fully expanded state. The base area can be for example a rectangle corresponding to and slightly offset from the panes of a window. In this embodiment the base area 1021 is several centimeters smaller in each dimension than the boundary of the collapsible material 1011.

Description of Mounting Device and Means of Operation

In FIG. 1, the embodiment is attached to the surface 1031 of a window casement, ceiling, window frame, wall, or other relatively immobile structure by way of a mounting device comprising a mounting rail 1041 and an adjacent top rail 1051. A bottom rail 1061 is attached to a lower edge 1200 of the collapsible material 1011.

Figure 2:
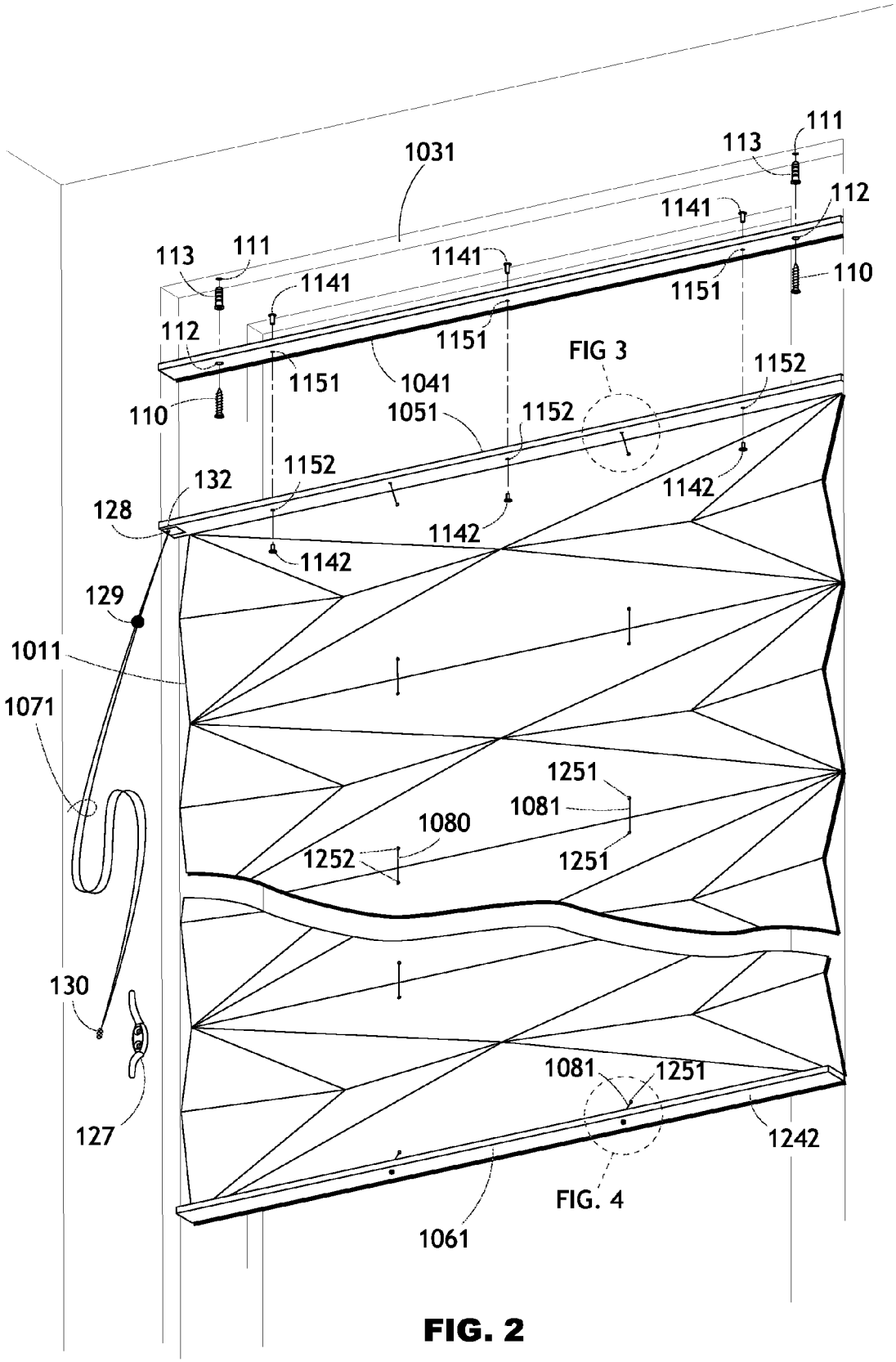
FIG. 2 is an exploded view of the embodiment of FIG. 1.

FIG. 2 illustrates the attachment of the mounting rail 1041 to the window casement 1031 by mounting screws 110, which pass through holes 112 in the mounting rail, optional mounting anchors 113, and holes 111 in the casement. The stationary top rail 1051 is attached to the mounting rail 1041 by binder posts 1141 inserted into holes 1151 in the mounting rail 1041 and binder screws 1142 inserted into holes 1152 in the top rail 1051. Each binder screw screws into its corresponding binder post so that the top rail 1051 aligns with and is adjacent to the mounting rail 1041.

In FIG. 2, an operating device comprises two pull cords 1080 and 1081. The pull cords are attached to the bottom rail 1061. The pull cords then pass through sets 1251 and 1252 of holes in the collapsible material 1011, pass through the top rail 1051, and cross over to one end of the top rail 1051 to hang together at the side of the embodiment.

Figure 3:
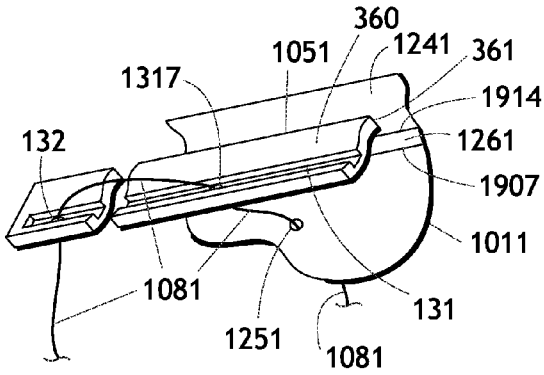
FIG. 3 is a cutaway exploded view of the top rail of FIG. 2.
Figure 4:
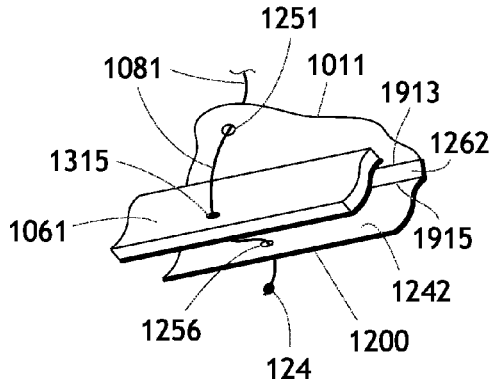
FIG. 4 is a cutaway exploded view of the bottom rail of FIG. 2.

In detail in FIG. 4, the pull cord 1081 is anchored permanently to the bottom rail 1061 by a pull cord stop, ferrule, or knot 124. The pull cord 1081 may or may not pass through a hole 1256 in a gluing panel 1242, and passes through a hole 1315 (whose diameter is smaller than that of the ferrule 124) in the bottom rail 1061. The pull cord 1081 then passes through the series 1251 of holes (shown in FIGS. 2, 3, and 4) and, in FIG. 3, through a hole 1317 in the top rail 1051. The pull cord 1081 emerges from the hole 1317 into a channel 131, where it travels along the length of the rail and then passes through an exit hole 132. The position within the rail of the groove, and the position of the groove, are arbitrary and can be changed to accommodate the configuration and position of the series 1251 of holes in the light-controlling device. Similar relationships exist between the pull cord 1080 and the bottom rail, light-controlling device and top rail as detailed in FIGS. 3 and 4. In FIG. 2, the pull cords 1080 and 1081 emerge from the hole 132, may pass through a brake 128, and end at a pull cord tassel, counterweight, or fob 130, collectively forming pull cord ends 1071. The term "pull cord ends" (e.g. 1071) is used to refer collectively to the pull cords (such as 1080 and 1081 in this embodiment) as they hang together and are used as one object. The brake 128 may be installed on the stationary top rail 1051 over the exit hole 132. Optionally, instead of the cord brake 128, a cleat 127 may be affixed to the wall. Optionally a pull cord child safety release mechanism 129 may be installed on the pull cords between the top rail 1051 and the pull cord tassel 130.

Figure 7A:
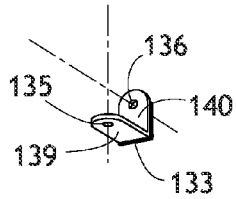
FIG. 7A is a detail view of FIG. 7 showing parts of a mounting device in relation to a wall.
Figure 7:
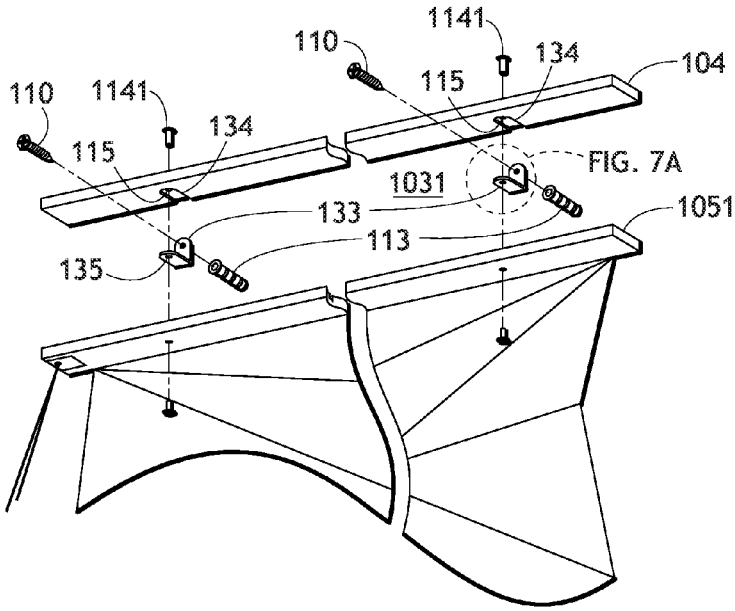
FIG. 7 is an exploded view of an alternate embodiment of an upper mounting rail.
Figure 8:
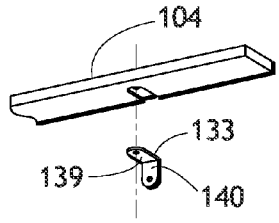
FIG. 8 is a cutaway exploded view of an alternate configuration of FIG. 7.

The mounting device illustrated in the FIGS. 1-4 is shown installed on a horizontal surface (such as a ceiling or the top of a window casement), but some embodiments may require that the mounting device be attached to a surface (such as a wall) that has a vertical orientation. To this end, FIGS. 7-8 show two alternative embodiments of the mounting device which may be used. In FIG. 7, the mounting rail 1041 is secured to a vertical wall (for example) by L shaped brackets 133, any reasonable number of which may be used (usually 2-4), each having (FIG. 7A) a first flange 140 secured to any vertical surface and a second flange 139 secured horizontally as in FIG. 7 to the bottom of a mounting rail 104 in a recess 134. The brackets 133 may be held in place by friction when inserted in the hidden recesses 134 as well as by the binder posts 1141 inserted in holes 115 in the rail 104 and passing through corresponding holes 135 in the brackets 133. As compared to the embodiment in FIG. 2, the holes 112 in the mounting rail 1041 are not necessary in rail 104, as the mounting screws 110 now pass horizontally through holes 136 (FIG. 7A) in the L brackets, optionally through the wall anchors 113 (FIG. 7) and into the vertical wall 1031. FIG. 8 shows the same relationships between parts detailed in FIGS. 7-7A except that the L brackets are installed upside down, so that the vertical flanges 140 point downward rather than upward, and are thus hidden behind and below the rail 1041 and behind the collapsible material.

Description of Light-Controlling Device

In FIG. 3, a gluing panel 1241 is glued or otherwise attached to an upper side 360 of the top rail 1051. A spacing panel 1261 has approximately the same width as a back edge 361, and may pivot at a concave fold 1914 to lay against the back edge 361 to allow the collapsible material 1011 to pivot freely, at a concave fold 1907, up toward the top rail by offsetting the top rail's thickness. In FIG. 4, the bottom rail 1061 is permanently attached by glue to the panel 1242, which is connected to the collapsible material 1011 by way of a concave fold 1915, a spacing panel 1262, and a concave fold 1913, similar in function to the folds and the panel 1261 as already described.

Figure 1A:
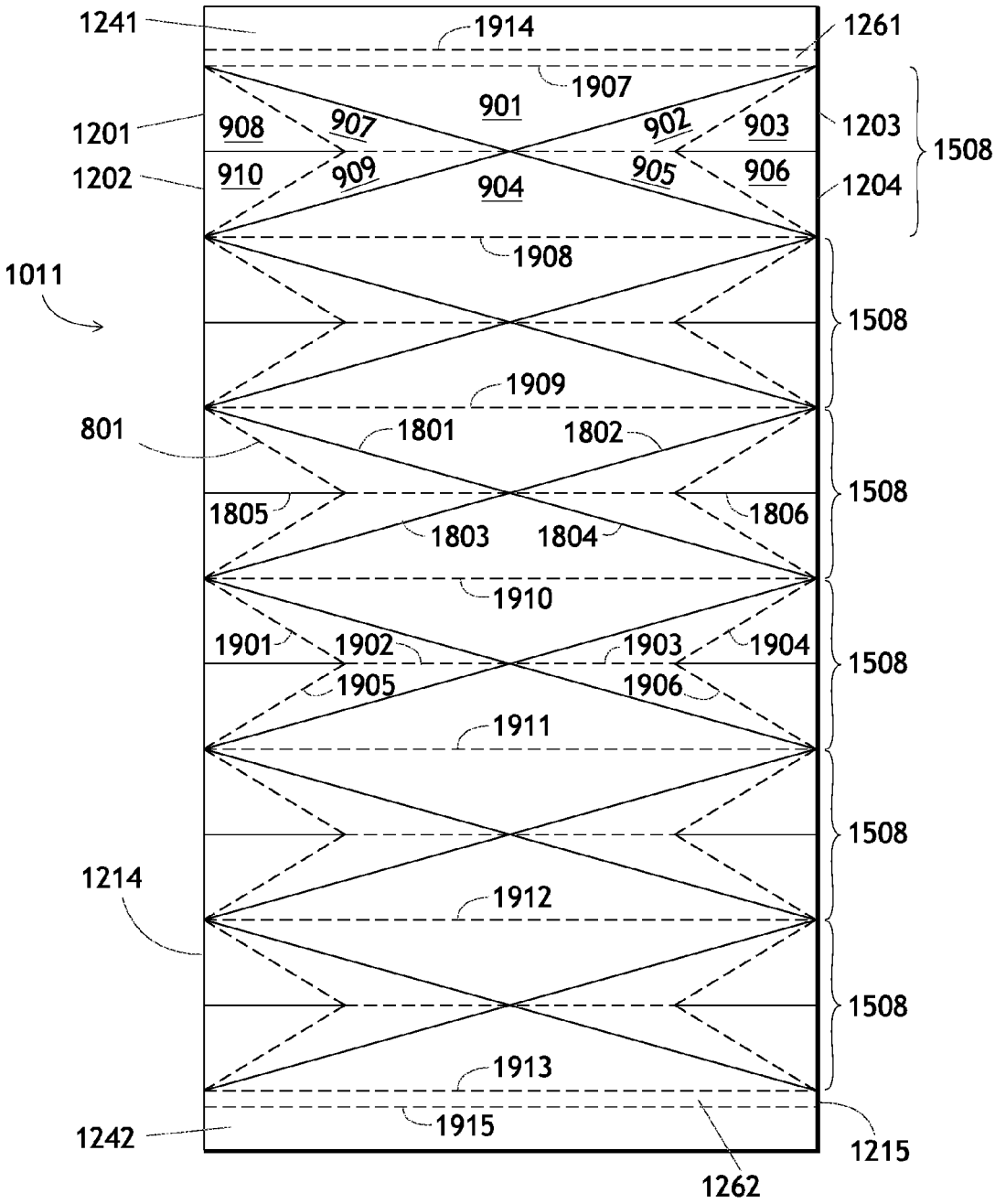
FIG. 1A is a schematic view of the collapsible material of the embodiment in FIG. 1.

FIG. 1A is a schematic view of the collapsible material 1011 which illustrates the correspondence of the theoretical aspects of a pattern of lines representing folds with the physical embodiment of the collapsible material 1011. The collapsible material contains three main parts: 1) the gluing panels 1241 and 1242, which provide surfaces for attaching the collapsible material 1011 to the top rail 1051 and to the bottom rail 1061 (respectively, as previously described); 2) the spacing panels 1261 and 1262, connected to the gluing panels by way of the folds 1914 and 1915 respectively, which allow the other panels of the collapsible material 1011 to pivot freely around the thickness of each rail 1051 and 1061 by way of the folds 1907 and 1913 respectively; and 3) a light-controlling device comprising a tessellation 801 formed by a theoretically infinite pattern embodied in a finite set of origami folds and panels in the collapsible material. In this particular embodiment, the tessellation 801 is made up of a tessellation module 1508 which occurs six times in vertical repetition. Each module 1508 comprises 10 tessellation cells embodied by panels 901-910, 18 tessellation lines embodied by 14 folds of which 6 are convex (1801-1806) and 8 are concave (1901-1908), and 4 panel edges 1201-1204. The panel edges of the six modules form entire side edges 1214 and 1215 of the collapsible material 1011, and each contiguous pair of modules has a boundary concave fold in common (1908-1912).

Figure 5:
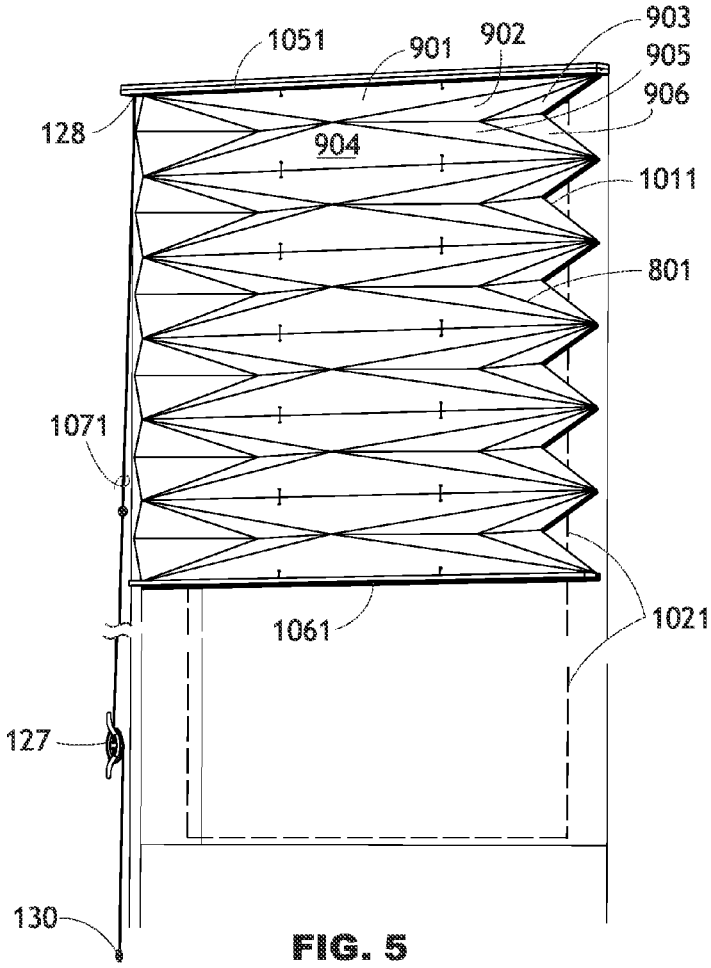
FIG. 5 is an isometric view of the embodiment of FIG. 1 partially collapsed (raised).
Figure 6:
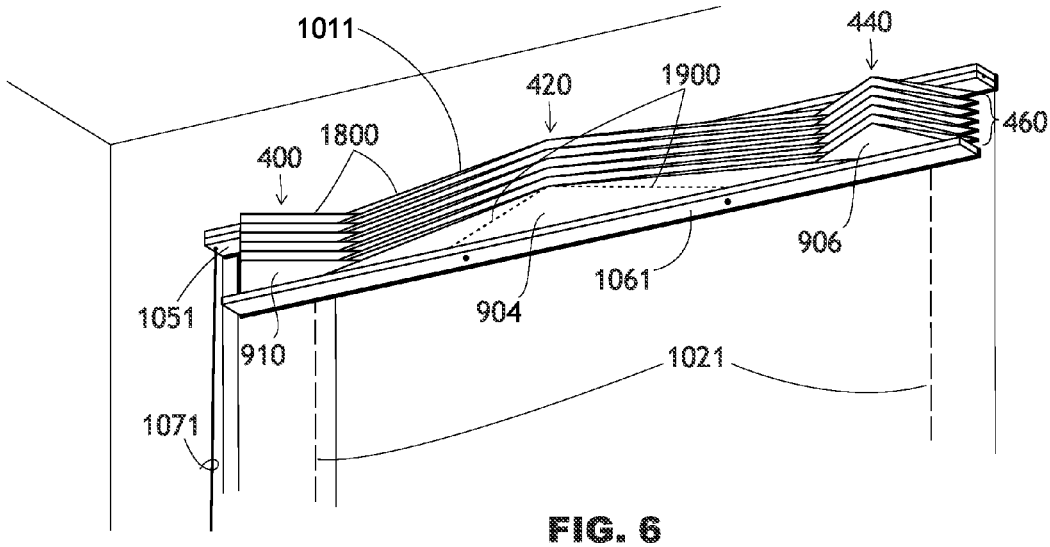
FIG. 6 is an isometric view of the embodiment of FIG. 1 fully collapsed.

When an embodiment is "drawn", "up", raised, or opened as in perspective view FIG. 6, it is in a fully collapsed state, in reference to the embodiment's folds and adjacent panels being closed or bent. In this state, adjacent panels cannot be brought any closer to one another, are overlying one another and may be contiguous to each other in stacks such as those shown in FIG. 6. A stack 460 comprises three arrays 400, 420, and 440 of like panels arranged in symmetrical fashion. The array 400 is a series of six panels 908 and six panels 910, all panels 908 facing upward (not visible in FIG. 6) and all panels 910 facing downward (one of which is labeled). The array 420 is a series of 6 each of the panels 901, 902, 904, 905, 907, and 909 totaling 36 panels (one visible panel 904 is labeled). The array 440 is a series of 6 each of the panels 903 and 906 (one visible panel 906 is labeled). The folds 1801-1806 and 1901-1913 are oriented in substantially parallel planes at different angles and directions with respect to one another according to their original orientation in the partially expanded state of FIG. 5 or the fully expanded state of FIG. 1. The planes of the stacked panels may be at slightly different angles relative to each other.

Materials

The folds or other hinges of an embodiment are sufficiently stiff and fatigue-resistant to support the weight of the lower portion of the collapsible material and bottom rail without stretching, elongating, or unfolding. Furthermore, the material's hinges should resist opening beyond 180 degrees, their specific required bending strength being dependent on the weight of the materials below a hinge. This relationship between bending strength and weight of the embodiment implies that there would be a maximum height for an embodiment, given a specific material choice. However, some embodiments obviate these limits by the configurations of their panels, such as the embodiments of FIGS. 10, 12, and 14.

In general, the collapsible materials may be made of stiff paper, plastic, textile, or other stiff sheet material, or any of these materials laminated, impregnated, or treated so as to improve their stiffness, fatigue life, ability to retain creases, water resistance, ultraviolet light resistance, color, texture, etc. There are numerous types of papers and plastics available commercially that are sufficiently stiff to meet the criteria of the present invention. An engineer or technician familiar with materials relevant to the fields of packaging or of pleated window shades may select such a material with minimal effort, as materials with such crease-holding characteristics are well known. For example, any aesthetically pleasing paper, textile, or other sheet material can be laminated on one or both sides with a standard polyester thermal laminating film having a polyethylene adhesive. Laminates such as polyethylene (in thicknesses of 15-300 microns), polyester (12-50 microns), polypropylene (20-150 microns), and the like can be used to enhance greatly the strength, fatigue life, and tear resistance of the material. Furthermore, certain paper materials have excellent strength and bending qualities of their own, which can reduce the need for laminating, coating, or impregnating the material. Examples of such papers would be mulberry papers and rag papers in unlaminated thicknesses of 50-400 microns and in laminated thicknesses of 25-200 microns, both of which exhibit very long and stiff fibers well suited for living hinges.

Operation of the First Embodiment—FIGS. 5-6

To operate the embodiment (FIG. 5), the pull cord ends 1071 are pulled at or slightly above the tassel 130, released from the cord brake 128 or the wall-mounted cleat 127. By pulling the pull cords, the bottom rail 1061 moves up and closer to the top rail 1051. While the bottom rail is raised in this way, all the panels of the collapsible material 1011 move and rotate, pivoting at all adjacent convex (mountain) folds and concave (valley) folds simultaneously, thereby occupying a smaller portion of the base area 1021 (shown as a long-dashed box). Due to the stiffnesses of the panels and directional bias of the folds imparted in the collapsible material, the material collapses according to the intended directions of the imparted folds. The rigid panels 902, 903, 905, 906, and 907-910 (FIG. 1A) are constrained to move with the panels 901 and 904 by propagation of forces through rotation around their adjacent folds. Their motion can be described with engineering terminology as having zero degrees of freedom.

By pulling the pull cords further, the material collapses from a partially collapsed state such as that shown in FIG. 5 to a fully collapsed state such as that shown in FIG. 6. In FIG. 6 the bottom rail 1061 is at its nearest point to the stationary top rail 1051, separated by the combined thicknesses of all the panels folded into the stack 460. The panels are stacked in closest proximity to each other. The base area 1021 may be entirely visible.

A base area is a convenient theoretical geometric shape to which an embodiment, such as the aforementioned first embodiment, can be related in order to determine functionality with respect to controlling the passage of light through that base area. The embodiment as a whole need not have exactly the same size or proportion of its corresponding base area; the base area can be larger or smaller than its corresponding embodiment's final dimensions, so long as the embodiment's ultimate size and place of installation do not cause nearby objects to become impediments or obstacles to the embodiment's operation.

The discussion regarding the embodiment of FIGS. 1-8 also applies to the embodiments of FIGS. 9-17 with respect to common structures such as mounting devices, operating devices, light-controlling devices, origami folds, the expanding and collapsing of the patterns formed by the origami folds, and their operation by any number of pull cords and any common device useful as a mounting device. Spacing and gluing panels will be omitted from discussion of other embodiments, as their effect is mainly on the mounting device and minor portions of adjacent panels. Where the aforementioned details appear in Figs. hereinafter, their operation is implied to be similar to that just described, unless otherwise described.

Second Embodiment

Description—FIGS. 9-9C, 53, 54

Figure 9:
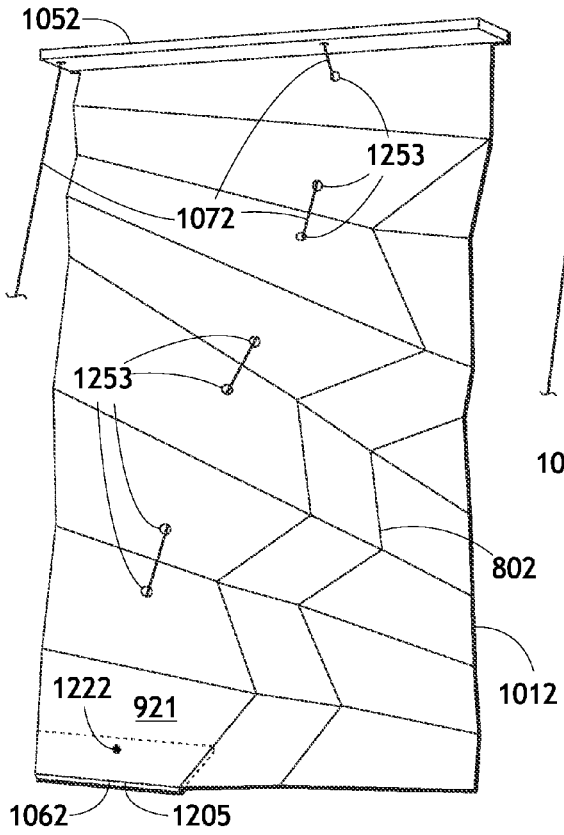
FIGS. 9-9C are perspective views of a second embodiment in various states of operation from fully expanded (FIG. 9) to fully collapsed (FIG. 9C).

A second embodiment is shown in FIG. 9 in its fully expanded state. In this embodiment, a single pull cord 1072 is present. A bottom rail 1062 is attached to the back side of a panel 921 within a tessellation 802 of panels and folds forming a collapsible material 1012. The pull cord 1072 passes through a series or pattern of holes 1253 and is anchored to the bottom rail 1062 by way of a ferrule or knot 1222. The series of holes causes the pull cord to follow a curved path on the collapsible material 1012. The bottom rail 1062's length is less than the material's full width, as it occupies the length of an edge segment 1205, which is one of three segments forming the bottom edge of the collapsible material.

In the embodiment's fully collapsed state (perspective view FIG. 9C and plan view FIG. 53), the panel 921 lies parallel to and as near as possible to a top rail 1052, underlying an array of folded panels 920 (visible in FIGS. 53 and 54). In the embodiment's fully collapsed state FIG. 53, all the holes 1253 and the ferrule 1222 are substantially stacked concentrically and adjacent to one another.

Figure 9A:
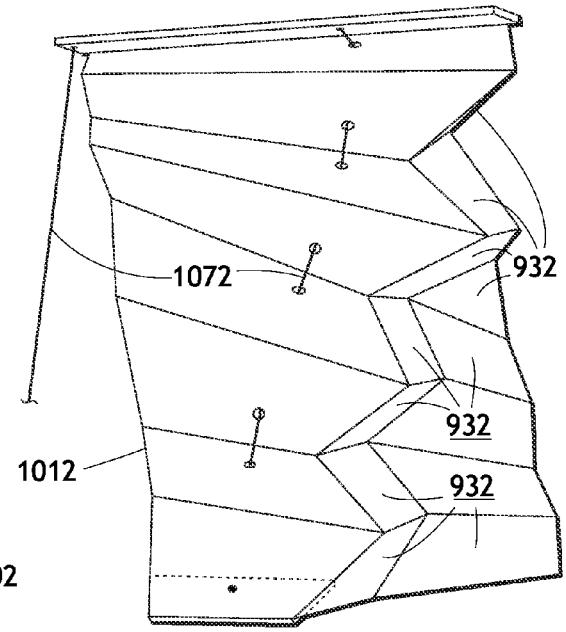
Figure 9B:
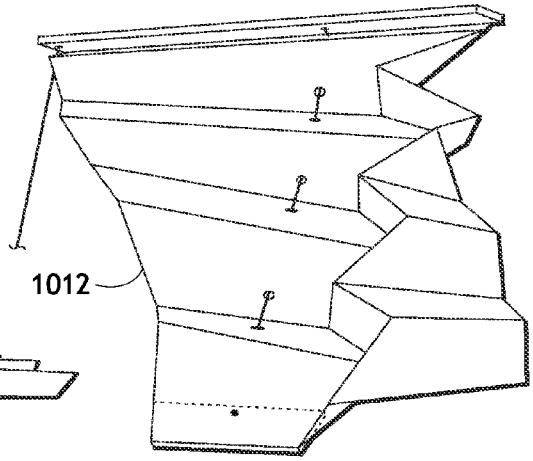
Figure 9C:
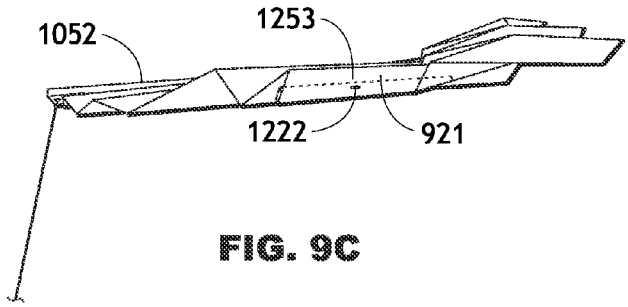

Operation of the Second Embodiment—FIGS. 9-9C

The second embodiment operates in much the same way as the first embodiment. In FIG. 9, by virtue of the directions of the fold lines of the tessellation 802, part of the collapsed embodiment lies beyond the area immediately in front of the top rail 1052. Because of the interdependence of the folds that make up the pattern (perspective FIG. 9A), the pulling force on the bottom rail propagates to multiple rigid panels 932 not directly guided by the pull cord 1072. In other words, the rigid panels 932 are not free-floating; their movement is constrained by the network of adjacent panels and thus move in a predetermined path with all the other rigid panels of the pattern. FIGS. 9A and 9B show the embodiment in perspective in progressively collapsed states, and in FIG. 9C the embodiment is fully collapsed.

Third Embodiment

Description—FIGS. 10, 55

In perspective FIG. 10 a third embodiment is shown in its fully expanded state. Each of two symmetrically disposed series of panels in a collapsible material 1013 contain limiting and limited sets of panels, corresponding to a relationship among rigid panels 911-915 in which panels 911 overlap panels 912, panels 912 overlap panels 913, and panels 913 overlap panels 914, and panels 914 overlap panels 915, permanently under normal operating conditions. An operating device comprises a pair of pull cords 1073, which have an arrangement similar to other pull cord embodiments previously described.

The aforementioned panels are also shown in FIG. 55 in a schematic representation of the collapsible material 1013 comprising the panels of the embodiment. The geometry shown is a tessellation comprising a tessellation module 1502, the module repeated along a vertical axis four times in this Fig. Likewise, sets of tessellation lines 2001-2009 are also repeated, as are tessellation cells 911-915. The limiting panels 911-914 in FIG. 10 correspond to tessellation cells 911-914 respectively in FIG. 55, and the limited panels 915 in FIG. 10 correspond to tessellation cells 915 in FIG. 55.

Figure 10A:
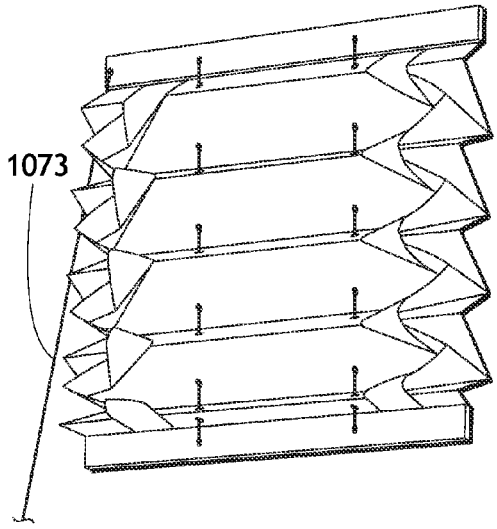
Figure 10B:
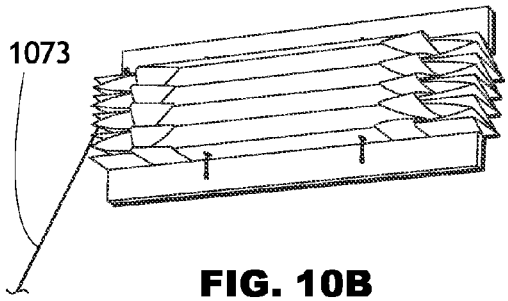

Operation of the Third Embodiment—FIGS. 10-10B

The third embodiment operates in the same way as those previously described. By pulling the pull cord ends 1073, the embodiment is raised (collapsed), changing from a fully expanded state as in FIG. 10 to a partially collapsed state such as that shown in FIG. 10A and finally to a fully collapsed state as shown in FIG. 10B. As the embodiment is lowered (expanded), the expansion of the panels 915 stops when adjacent pairs of panels 915 reach a maximum included angle of approximately 90 degrees. This angle can vary, depending on the exact measurements and shapes of the panels 911-914 and the distances between the various folds. The collapsible material is substantially not planar (substantially three-dimensional) in its fully expanded state.

Fourth Embodiment

Description—FIGS. 11-11B, 59-61

Figure 11A:
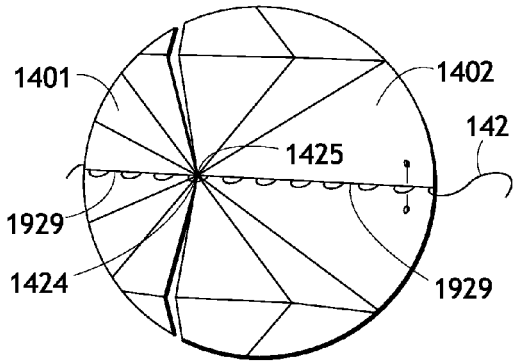
FIG. 11A is a detail view of FIG. 11 illustrating a linkage by which the collapsible materials are attached at corresponding horizontal concave folds.
Figure 11B:
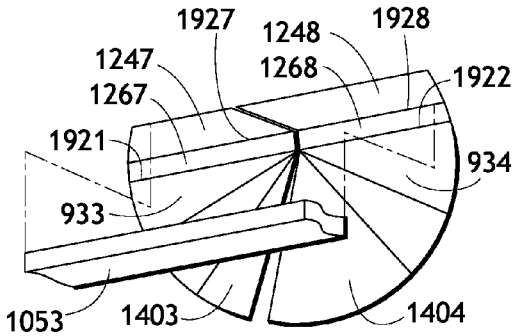
FIG. 11B is a detail view of FIG. 11 illustrating the attachment of a single top rail to multiple gluing panels of multiple collapsible materials.

FIG. 11 shows a fourth embodiment in its fully expanded state. An operating device comprises pull cords 1074, which have an arrangement similar to other pull cord embodiments previously described. A light-controlling device comprises four sheets of collapsible material 1401-1404, each sheet having imparted into it a tessellation of origami folds 804 similar to the tessellation 801 except reduced in horizontal scale. This embodiment has a mounting rail 1043, a top rail 1053, and a bottom rail 1063 that span the widths of all of the sheets of material. In FIG. 11B, showing for example the materials 1403 and 1404, each sheet of material is attached to the top surface (hidden from view) of the top rail 1053 by its own gluing panels e.g. 1247 and 1248 respectively, these gluing panels being connected through concave folds 1927 and 1928 to spacing panels 1267 and 1268 (respectively). The spacing panels 1267 and 1268 are connected in turn to respective concave folds 1921 and 1922, and finally to respective upper panels 933 and 934, in the same relationships as shown by FIG. 3 of the first embodiment. Each sheet 1401-1404 is attached in a similar way to the top rail 1053 so that the sheets are arranged adjacent to one another as shown in perspective view FIG. 11 and in elevation view FIG. 59. The sheets

1401-1404 are attached to the bottom rail 1063 in a similar way (not shown). Each sheet 1401-1404 hides a portion of a base area 1024 (shown as a hidden rectangle in FIG. 11) from view so that when the embodiment is fully expanded, its entire base area is hidden. Note once again that the embodiment as a whole need not have exactly the same size or proportion of its corresponding base area.

In FIG. 11, the sheets of material 1401-1404 are cross-linked at 15 common points 1423 (of which 4 are indicated in the Fig.). In FIGS. 11 and 59, the cross-linked points are located on the pattern of fold lines 804 at each place where a horizontal concave fold 1929 meets the material's edge. In FIG. 11A, the cross-link is achieved by a stitch 142, seam, staple, or other device for connecting the materials at a point, so that a point 1424 at the edge of one material is aligned with a point 1425 at the edge of another material (in this example, the materials 1401 and 1402 respectively) at corresponding folds 1929 in each.

FIG. 60 shows the embodiment's collapsed plan view. When the embodiment is collapsed, all of the cross-linked points 1423 are substantially stacked adjacent to one another in 3 stacks between the 4 materials as shown. FIG. 61 shows another possible collapsed plan view of the fourth embodiment, in which a top rail 1054 and a bottom rail 1064 have a curved shape. This is possible for the embodiment shown because the collapsible materials 1401-1404 in their collapsed state will not interfere with each other if each of three angles 164-164" between adjacent base areas is less than that at which corresponding series of points 165-165" and 166-166" would be brought into contact.

Operation of the Fourth Embodiment—FIGS. 11-11A, 60

The operation of the embodiment is the same as that of previous embodiments. In FIG. 11, the pull cord ends 1074 are pulled, thereby raising the bottom rail 1064 and collapsing the embodiment until it is fully collapsed, at which point the bottom rail 1064 is as near as possible to the top rail 1054. FIG. 60 is a top view of the fully collapsed embodiment. The sheets 1401-1404 collapse and expand unitedly as the bottom rail is raised and lowered.

In FIG. 11, the cross-linked points 1423 have paths of motion that are the same during expanding and collapsing of the embodiment. For example, the two series 1424 and 1425 of points remain adjacent to each other throughout the travel of the sheets 1401 and 1402 as the sheets collapse unitedly, and are cross-linked to ensure that the columns of material do not separate from each other in any direction perpendicular to the path of motion. In detail FIG. 11A, the path of one such point 1424 on the sheet 1401 follows exactly the path of an adjacent such point 1425 on the adjacent sheet 1402 as the sheets collapse unitedly.

Fifth Embodiment

Description—FIGS. 12-12C, 13, 62-66

FIG. 12 shows a fifth embodiment having many similar features with similar relationships between parts as previously described in other embodiments, such as a top rail 1055, a bottom rail 1065, pull cord ends 1075, and a light-controlling device 1015. The light-controlling device comprises several collapsible materials 1443, or columns of pyramidal arrangements of panels hingedly interconnected. Each column is composed of two long, narrow sheets folded in opposite ways such that some limiting panels of one such sheet limit the expansion of adjacent limited panels in the other such sheet. The columns 1443 are thus substantially not planar in the embodiment's fully expanded state. For example, FIG. 62 shows a partial view of two such sheets 1405 and 1406. Patterns of origami folds 805 and 806 are mirror images of each other and form two repeated, opposite-handed tessellation modules 1506 and 1507 of triangular panels. Each pair of such modules is intertwined together (FIGS. 63-64) to form a pair 480 of pyramidal shapes. Two folds 1931 lay permanently adjacent to each other between the two pyramids forming any pair 480. Pairs of panels which permanently overlap are 1468 and 1474, 1476 and 1470, 1477 and 1471, and 1473 and 1479. Panels 1469, 1475, 1472, and 1478 overlap no other panel in either module and each forms a side of a pyramid not contiguous with any fold 1930 or 1931. For example, the panel 1469 (FIG. 63) is attached to the panel 1468 (hidden) by a convex fold 1818 and to the panel 1470 by a convex fold 1819; the panel 1475 is attached to the panel 1474 by a convex fold 1820 and to the panel 1476 by a convex fold 1821. Although in FIG. 12 only 20 pairs 480 of pyramids is shown (of which 2 pairs are indicated), an arbitrary number of columns 1443 can be made of an arbitrary number of pairs 480.

In FIG. 12, each column 1443 is attached to the top rail 1055 and to the bottom rail 1065 by its own gluing panels and spacing panels as previously described in the first and fourth embodiments.

In FIG. 12, the columns of panels are cross-linked at 12 linkages 1430 (of which 4 are indicated). The linkages 1430 occur at each pair of coincident endpoints of horizontal concave folds 1930. The folds 1930 are those which lie above and below each pair 480 of pyramidal configurations. The folds 1930 can be seen also in FIGS. 12A, 62, and 63. The linkages 1430 can comprise, as in detail FIG. 13, stitches 1422 which provide loops 450 through which pull cords 1082 can pass at the back side of the collapsible material. The linkages 1430 could also be made with a device such as a strip of cord or cloth comprising a metal or plastic pull cord ring connected to the strip's midpoint, with the strip being attached to each adjacent fold 1930.

In addition, the columns of panels can have other similar shapes while maintaining the same functional characteristics and relationships: the material sheets 1405 and 1406 could have shapes like sheets 1405' and 1406', 1405" and 1406", etc., as in FIG. 65, forming pyramids of different heights. Also, instead of the panels being intertwined, the pyramids could be composed of several material sheets linked together by stitching, gluing, etc., as in the configurations shown in FIG. 66. Sheet 1405A is an example of a sheet that could be used to form a pair of pyramidal configurations of panels. Sheets 1405B and 1406B could be intertwined in a similar way to the sheets 1405 and 1406, forming one pair of pyramidal configurations, the panels shown with encircled areas on front or back surfaces being used to attach multiple sheets 1405B in one chain and multiple sheets 1406B in another chain, to form columns of such pairs. Any number of other similar panel configurations could be used to achieve the same functional result.

Figure 12A:
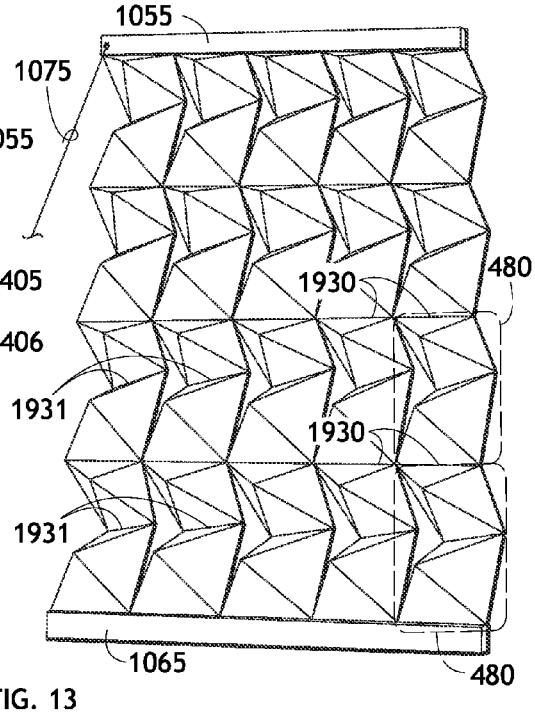
Figure 13:
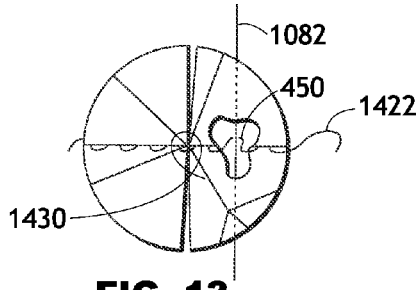
FIG. 13 is a cutaway detail view of FIG. 12.
Figure 12B:
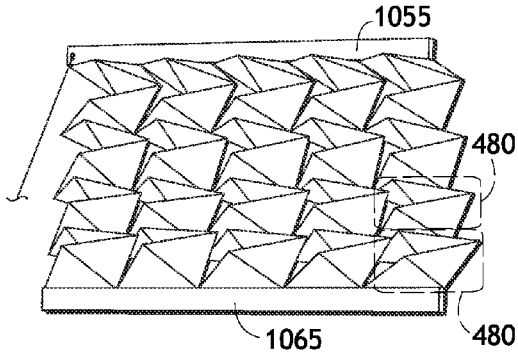
Figure 12C:
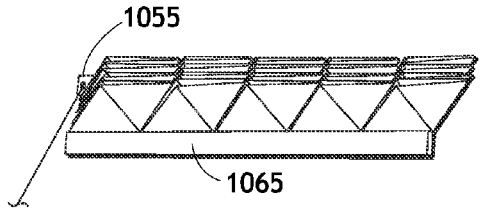

Operation of the Fifth Embodiment—FIGS. 12-12C, 63

The fifth embodiment operates similarly to previously described embodiments. In FIG. 12, the embodiment is in a fully expanded state. In FIG. 12A, the embodiment has been partially collapsed by pulling the pull cord ends 1075. In FIG. 12B, the embodiment has been collapsed further, and in 12C it is shown fully collapsed. In FIGS. 12-12C, each of the 20 pairs 480 of pyramids collapses with a sideways twisting motion of the horizontal concave fold 1931 in the middle of the pair, away from a base area (not shown), as the bottom rail 1065 is raised. (The folds 1930 and 1931 are hidden from view in FIGS. 12B and 12C.) Because the columns 1443 operate unitedly, and because the folds 1930 move in a purely vertical direction while the pairs 480 collapse, the endpoints of the folds 1930 can be hingedly connected by the linkages 1430 as described above. The purpose of the linkages 1430 is to ensure that the columns of material do not separate in any direction perpendicular to the path of motion while the embodiment is in operation.

In FIG. 63, the two sets of panels 1506 and 1507 comprise limiting and limited material as follows. As the materials are expanded, they reach a fully expanded state when the panel 1475 stops the expansion of the folds 1818 and 1819, and the panel 1469 stops the expansion of the folds 1820 and 1821. These two limiting relationships, as well as similar ones within the panels 1471-1473 and the panels 1477-1479, also limit the travel of the folds 1931 so that in the embodiment, the folds 1931 have a maximum angle of about 70 degrees between the adjacent panels 1470-1471 (and the panels 1476-1477). The same applies to the folds 1930 with respect to the adjacent panels 1479-1474 and 1473-1468.

Sixth Embodiment

Figure 14:
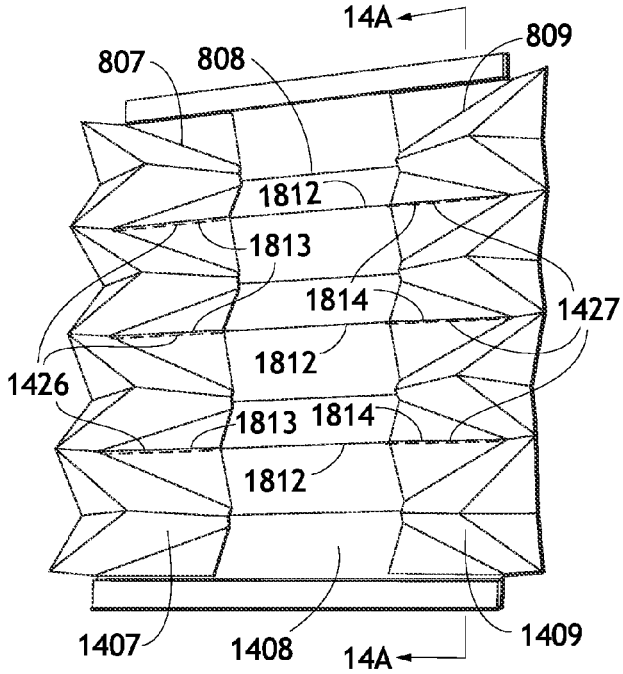
FIG. 14 is a perspective view of a sixth embodiment in the expanded state.
Figure 14A:
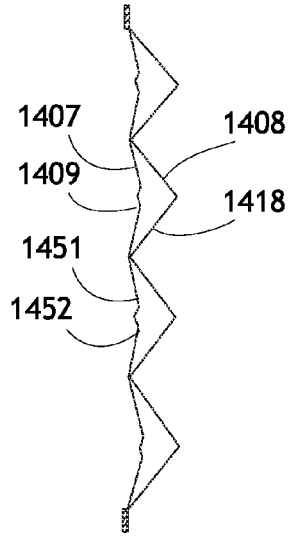
FIG. 14A is a section view of the embodiment of FIG. 14.
Figure 14B:
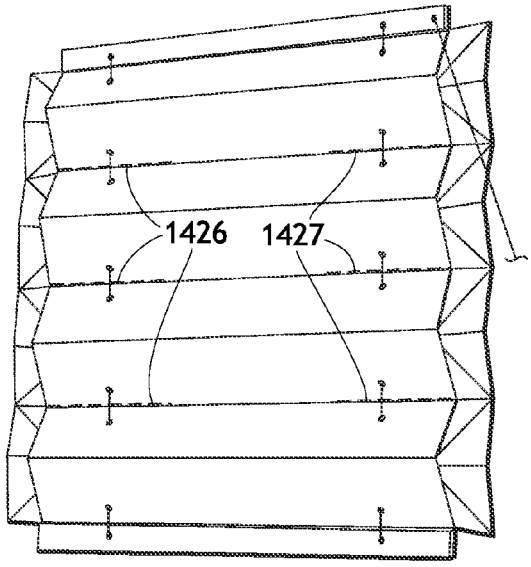
FIG. 14B is a rear perspective view of the embodiment of FIG. 14, in the fully expanded state.
Figure 14C:
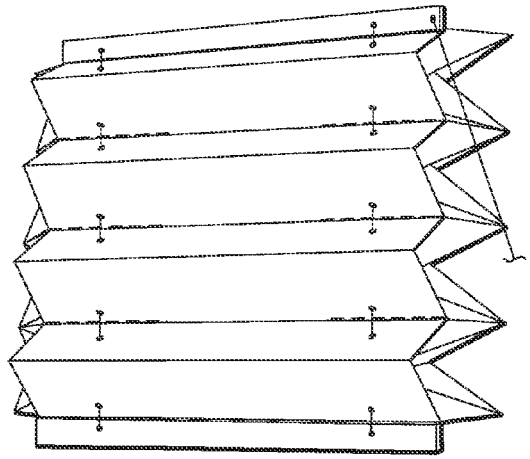
FIG. 14C is a rear perspective view of the embodiment of FIG. 14 in a partially collapsed state.

Description—FIGS. 14-14C

A sixth embodiment is shown in frontal perspective view FIG. 14 in its fully expanded state, and in a rear perspective view in the same expanded state in FIG. 14B. It is similar in construction and operation to the embodiments described above, except that it consists of three collapsible materials or series of panels 1407, 1408, and 1409, FIG. 14, each imparted with a pattern of origami folds 807, 808, and 809 respectively. The materials 1407 and 1408 are linked together by three linkages 1426 at common horizontal convex folds 1812 and 1813, and materials 1408 and 1409 are cross-linked by three linkages 1427 at common horizontal convex folds 1812 and 1814. As seen in section view FIG. 14A, in the embodiment's fully expanded state the material 1408 is substantially not planar and its panels are collectively termed limited material 1418, because the full expansion of their connecting folds is limited by cross-links to the other materials 1407 and 1409. The materials 1407 and 1409 are substantially spread out or flat in appearance in their fully expanded position, and thus constitute limiting materials 1451 and 1452. The sixth embodiment may obviate the strength requirements of the folds in the limited material 1408 which depends from the limiting materials 1407 and 1409, so that the materials 1407 and 1409 may require higher strengths than the material 1408 to resist unfolding.

Operation of the Sixth Embodiment—FIGS. 14B, 14C

The embodiment's other details of construction and operation are substantially similar to those of other embodiments in all other respects as previously described.

When the embodiment is operated, its limited and limiting materials collapse unitedly due to the coinciding paths of travel of their folds connected by the linkages 1426 and 1427 as the embodiment collapses from a fully expanded state (FIG. 14B) into a partially collapsed state (FIG. 14C) and into a fully collapsed state (not shown).

Seventh Embodiment

Description—FIGS. 15, 55, 67-69

A seventh embodiment, shown in its fully expanded state in perspective view FIG. 15, is very similar to the third embodiment (FIGS. 10-10B) explained above. The embodiment of FIG. 15 is characterized by another type of cross-linking whereby three separate collapsible materials 1420, 1449, and 1450 (FIGS. 69, 67, and 68 respectively) are cross-linked (FIG. 15) at coincident series of panels 929, 930, and 931 respectively. The tessellation module 1502 in FIG. 55 correlates to three sets of panels in FIGS. 67, 68, and 69: limiting panels of a tessellation module 1510 in FIG. 67, limited panels of a module 1511 in FIG. 68, and limited panels of a module 1509 in FIG. 69. For the seventh embodiment to function identically to the third embodiment, a height h4 (FIG. 69) of the module 1509 and corresponding heights h3 (FIGS. 67-68) of the modules 1510 and 1511, comprising the coincident series of fold lines and panels, must be equal where the surfaces are to be cross-linked (unless partial bending occurs within these panels). The three materials 1420, 1449, and 1450 can be connected by linkages between corresponding series of fold lines 1918-1919 and 1917-1919 (FIGS. 67-69) or by linkages between corresponding series of folds 1816-1817 and 1815-1817, by methods already described. The convex folds 1815-1817 and the concave folds 1917-1919 are also indicated in FIG. 15. Alternatively, the three materials 1420, 1449, and 1450 can be connected by linkages between corresponding series of panels 924-925 and 924-926 by gluing, fusing, stitching, or another method of permanent attachment at corresponding regions or areas 1433 to 1434 and areas 1431 to 1432 (these regions are indicated by encircled portions of the panels on which they lie), respectively, resulting in the arrangement as shown in FIG. 15.

Operation of the Seventh Embodiment—FIGS. 67-69

The limiting collapsible materials 1449 and 1450 limit the travel of the limited material 1420 such that each pair of panels 924 within the module 1509 of the limited material 1420 expand to a maximum included angle of about 90 degrees when the embodiment reaches its fully expanded state. The explanation of the relationships between limiting and limited panels is like that in the description of the third embodiment. Because the rigid panels 924, 925, and 926 are cross-linked as described above, the three materials 1420, 1449, and 1450 (FIGS. 69, 67, and 68) expand and collapse unitedly.

The operation of the embodiment is otherwise the same as that of previously described embodiments.

Eighth Embodiment

Figure 16:
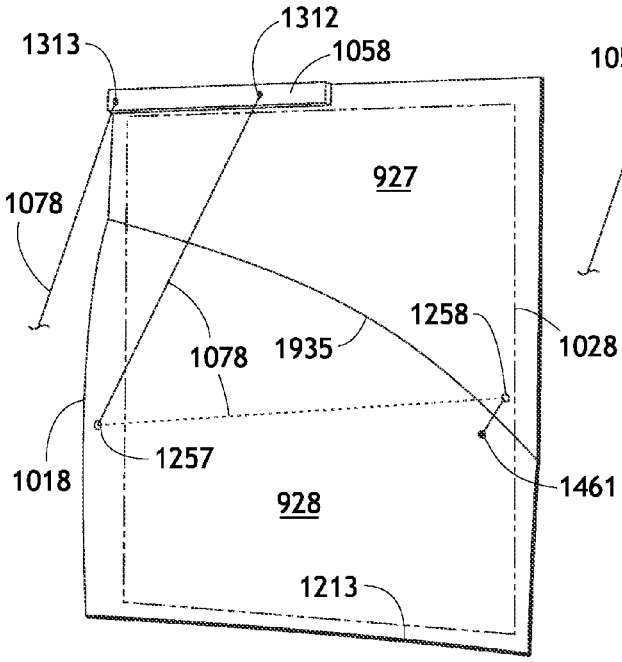
FIG. 16 is a perspective view of an eighth embodiment in the fully expanded state.
Figure 17:
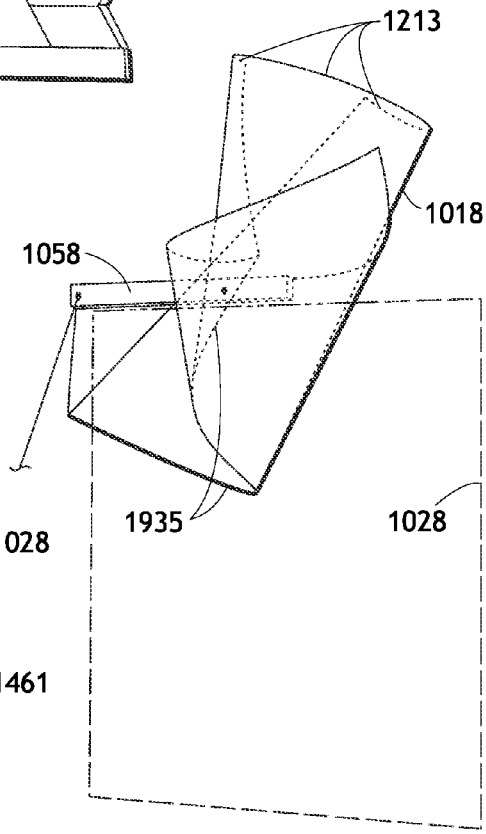
FIG. 17 is a perspective view of the embodiment of FIG. 16 in its fully collapsed state, showing that an embodiment can exhibit volume in its fully collapsed state.

Description—FIGS. 16, 17

An eighth embodiment differs from previously described embodiments in that it exhibits volume in its fully collapsed (raised) state, as shown in FIG. 17. In its fully expanded (lowered) state (FIG. 16), a collapsible material 1018 is substantially spread out or level in appearance and fully covers a corresponding base area 1028, hiding it from view. A single pull cord 1078 is anchored to a panel 928 at an anchor point 1461 or rivet, eyelet, ferrule, large knot, or other such device, which can be permanently attached to the panel 928 and simultaneously to the end of the pull cord 1078 by gluing, crimping, or some other acceptable method. From the anchor point 1461 the pull cord 1078 passes in front of the material 1018 crossing over a concave fold 1935 and through a hole 1258 in a panel 927. The pull cord then passes behind the material 1018 and then through a hole 1257 in the panel 928, the hole being located near the side of the material opposite the location of the hole 1258. More precisely, the hole 1257 is located at a point on the panel 928 near its side edge and substantially opposite the fold 1935 from a hole 1312 on a top rail 1058. The holes 1257 and 1258 are optionally eyelet-reinforced. The pull cord passes across the front of the material, passes over the fold 1935, into the hole 1312 in the top rail 1058, across the top rail through a channel in its back (not shown but similarly as described above in the description of the first embodiment), back out of the top rail near the side of the embodiment at a hole 1313, and downward to a point reachable by a user's hand. The embodiment has no bottom rail because the pull cord 1078 is anchored directly to the panel 928, and because a bottom edge 1213 does not come in contact with the top rail in the embodiment's collapsed position.

Due to the orientation of the curved fold 1935, the panels 927 and 928 are not similarly shaped, and do not form a stack of panels in the embodiment's collapsed state as in all of the embodiments previously shown. In FIG. 17, the collapsible material 1018 covers a minimum portion of the base area 1028 when it is in its fully collapsed state, even though it occupies a greater volume than in its expanded state. The collapsed fold line 1935 has a roughly helical shape. The bottom edge 1213 has a curved, three-dimensional shape at a position above the top rail 1058.

The material 1018 can be a relatively stiffer and heavier material than may be required by previously described embodiments.

Operation of the Eighth Embodiment—FIGS. 16, 17

The eighth embodiment is operated, as in all previously described embodiments, by pulling the cord 1078. However, as the cord's length shortens between its anchor point 1461 and the top rail 1058, the fold 1935 collapses and simultaneously the panels 927 and 928 begin to bend elastically, more or less perpendicularly to the fold. Forces on the panels due to the shortening of the pull cord 1078 act at an angle to the fold 1935. Because of this nonperpendicular angle, the forces act both across the fold (collapsing the fold) and also along the fold (bending the panels perpendicularly to the fold). When the anchor point 1461 reaches its nearest possible position to the top rail 1058, the embodiment is in a fully collapsed position (as in FIG. 17). The weight of the panels 927 and 928 plus the elastic forces in the bent panels are enough to cause the embodiment to expand at the curved fold 1935 when the pull cord 1078 is released, and the embodiment arrives at a fully expanded position as in FIG. 16.

Detailed Description of the Design Method

A method for designing any number of alternative embodiments of the collapsible screen is disclosed. Abstract patterns and specific, real world spatial constraints are worked into tangible embodiments by this design method. The method will be made apparent by example applications of the method using several of the disclosed embodiments as hypothetical end-products.

In order to direct a possible embodiment towards feasibility and practicability as an embodiment, the design method represented by the flowchart of FIGS. 70-70A draws on the following basic sources, sets, lists, or databases of information: a set 220 of geometric patterns that can form the basis for a possible embodiment, a set 221 of criteria by which the possible embodiment is evaluated for functionality, and a set 222 of transformations by which the possible embodiment can be improved with respect to the functional criteria.

The design method allows for its own evolution by a process of amendment of the above-stated sets. The sets are incomplete sets of entities, and are subject to change. The sets of criteria and transformations form a body of knowledge that create strategies for developing specific embodiments which achieve functional constraints specific to a particular range of applications (broad or narrow) such as "windows 90 to 1200 cm wide, 90 to 200 cm in height, having no obstacles within 10 cm to either side of the collapsible material", or "ceiling mounted, 3-4.5 m in height, having minimum clearance 2.25 m when raised".

Further, the method can be used for two overall design scenarios: A) to create a wholly new embodiment, or B) merely to alter the design, measurements, proportion of a previously designed embodiment so as to suit different environments (as in a production scenario). For a particular embodiment (scenario b), the sets 220-222 can be tailored to suit possibilities and limitations specific to that embodiment's parts and behaviors. For example, the sets of fold patterns and of transformations will probably be very limited, and the set of criteria will point to very specific behaviors and physical properties of the embodiment.

The sets of patterns, transformations, and criteria were developed in part with the assumption that the final product will be used with a conventional mounting device as described elsewhere. Another mounting device could be invented that allows the use of other types of origami folds, and another set of criteria would become relevant to these embodiments. A new folding pattern might create a new range of possible embodiments, which might be practical for use as a wall hanging rather than as a window shade. Depending on the designer's experience, preferences, and needs, he or she can develop more than one group of sets of relevant criteria, fold patterns, and transformations.

These three sets are interdependent, and together they depend on and help to shape the design goals specified before using the design method. If the design goals undergo only minor changes from one possible embodiment to another (for example, variation of base area proportion while holding the number of material sheets the same; similar panel shapes; etc.), the set 221 of criteria will need only minor variation. Large differences in design goals can encourage the use of independent, alternate sets of fold patterns 220, criteria 221, and transformations 222 in FIGS. 70-70A, in order to simplify the use of these sets. Thus, there might be a hypothetical set 220A of fold patterns based on single sheet material embodiments with linear fold lines, used with sets 221A and 222A of correlated criteria and transformations; another hypothetical set 220B of fold patterns intended for use with a mounting device that operates with entirely different mechanisms, used with sets 221B and 222B of correlated criteria and transformations based on the different motion of such a mounting device; another hypothetical set 220C of fold patterns based on curvilinear fold lines such as that of the eighth embodiment (FIG. 16), used with hypothetical sets 221C and 222C of criteria and transformations respectively; and so forth.

The main focus of the design method is the light-controlling device. However, without considering the light-controlling device's eventual combination with specific mounting devices and operating devices, the method would produce many "useless" results. Thus, during application of the design method, consideration of the mounting device and operating device is deferred while geometric patterns representing just the possible light-controlling device are manipulated.

The design method is the part of this invention which 1) directs the user of the design method to a range of theoretical geometries which could become embodiments according to the present invention; 2) relates any such theoretical geometry to its possible physical embodiments according to the present invention; and 3) creates strategies for altering the physical embodiments while retaining the functionality of the embodiments, all with respect to specified functional parameters.

As in the previous section, none of the Figs. and explanations is intended to limit the scope of the method to the specific series of steps shown therein, nor are any of the specific series of steps used to arrive at any of the embodiments shown herein intended to limit the scope of the design method to those examples. The steps need not be applied in any specific sequential order.

Description of Start Condition 201, FIG. 70

The flowchart of FIG. 70 has a start (or entrance) condition 201. The start condition assumes the need for an embodiment that satisfies a number of spatial constraints and design goals. These design goals can include any or all of the following:

a) Subjective aesthetic ideals—the overall character or "look" of the embodiment can guide the choice of general shape of the geometry while using the design method.

b) Purpose or end-use of the embodiment—the functional needs of the embodiment depend on its intended purpose. An embodiment can be used for covering a window, dividing an interior space, decorating a wall, serving as a backdrop, and serving as a part of a decorative lighting apparatus. A window covering will typically call for an embodiment that collapses to little or no volume, whereas a space divider might have almost no spatial constraints. As a wall decoration, it might not need to expand and collapse, so its pull cord might need merely to hold the bottom rail in a static position below the top rail.

c) Spatial constraints—constraints to the embodiment's range of motion are based in part on the purpose of the embodiment as explained in the previous paragraph, and more directly on its placement relative to walls, ceilings, window casements, and other nearby immovable objects. To cover a window, an embodiment will have more limiting space constraints to its movement, such as constraints to its lateral movement by the proximity of side walls of a window casement.

d) Shape and proportion—the way in which a particular embodiment works depends not only on the pattern of folds, but also to some extent on the proportion of the material in which the folds are imparted. These are reflected in an embodiment's base area dimensions. For example, if an embodiment is being designed for covering a window, its base area will have the inside dimensions of the window casing.

Once base area proportions are established, they are flexible to some extent for any given embodiment. Some fold patterns and embodiments have little flexibility in proportion, whereas others lend themselves to great variability in proportion. The dimensions of the final product are almost always greatly variable, assuming the proportions vary within the limitations of the embodiment's design.

To use the design method illustrated in FIGS. 70-70A, one can use any reasonable representation of the design being developed. The most convenient is to impart folds by hand (with or without tools) into a model sheet, which could be a relatively small flat sheet of material with fold lines imparted, having the proportion of the intended base area. Another way is to use any reasonable type of computer software to simulate the folding of the embodiment through graphical, mathematical, and/or numerical representations thereof. For the purposes of the following explanation of the design method, the hand-folded paper model sheet technique will be referred to by way of example. In the flowchart of FIGS. 70-70A, the aforementioned sets of patterns, criteria, and transformations are represented as databases. The design method flowchart could be embodied in a computer software system comprising these databases.

Description of End Condition 202, FIG. 70

In FIG. 70 an end (or exit) condition 202 represents the point at which a design has become an embodiment (a possible product). At this point a pattern of origami folds has been designed that will be imparted into a stiff sheet material with a proportion approximating that of the intended embodiment's base area, that will expand and contract with the use of pull cords, that will cover the entire base area when the embodiment is fully expanded, and that will satisfy aesthetic design goals. The choice of materials, colors, accompanying mechanical devices such as the mounting devices, final dimensions, and other aspects of the embodiment are to be considered while using the design method, but are outside its scope because they can be changed with little or no impact on the success with which the embodiment fulfills the design objectives with which it was created.

Also, at the end condition the sets 220-222 are likely to have changed. Presumably, having reached the end condition 202, a new embodiment exists, which implies that the designer has created at least one pattern of folds to use toward creating yet other new embodiments, or for manufacturing facsimiles of this new embodiment. At the very least this means that the set 220 of fold patterns has been altered by use of the design method.

Design Method—General Overview, FIGS. 70-70A

In FIG. 70, at the element 201, base area dimensions, spatial constraints, and aesthetic design goals are decided. Following the flowchart to an element 203, a logical "or" gate, the user of the design method (the designer) has a choice of either A) choosing (at an element 204) a tessellation or pattern of folds from among the existing set 220 or list or database of such patterns, or B) creating (at an element 205) a new tessellation or fold pattern not represented in the set 220. At the elements 204 and 205, the designer may generate numerous possible patterns in the interest of finding one or more that might satisfy design criteria. The set 220 of tessellations, fold patterns, and previously designed embodiments grows with the number of embodiments developed by the design method. After a pattern has been chosen or created, the pattern's position, direction, and scale are chosen (at an element 207) relative to the boundaries of the embodiment and the pattern is folded into a model sheet (a scale representation of the collapsible material, which is to become an embodiment of the present invention) whose dimensions are proportioned according to the base area's proportion decided at the element 201. Ideally, the model sheet can now be collapsed and expanded by hand. To determine its success as a possible embodiment according to the present invention, the possible embodiment represented by the model sheet is judged (at an element 208) with respect to the set 221 of criteria. Note that the possible embodiment, rather than the model sheet itself, is so judged; this distinction is important in that the realities of the embodiment are not all fully represented by the model sheet and must be projected, imagined, or foreseen by the designer. For example, the model sheet need not be sized or proportioned to include spacing panels or gluing panels, which can be present in the final embodiment; these are beyond the scope of the design method. The set 221 of criteria are kept in a list or a database. The application (at the element 208) of the criteria occurs until all criteria have been met, or until the possible embodiment fails to meet one or more criteria. If all criteria have been met, the possible embodiment is then evaluated (at an element 210) by the subjective and objective design goals decided at the start condition 201. Otherwise, if there are failed criteria at the element 208, the possible embodiment is subject to a modification subprocess 209 by which it is improved with respect to these failed criteria.

Assuming the possible embodiment meets all the criteria at the element 208, and also meets all of the start condition design goals at the element 210, a representation of it is added (at an element 206) to the set 220 of patterns, as is the pattern of folds from which it was developed at the element 205, if any such pattern was created and is not already in the database. It then becomes (at the element 202) a possible product and is taken to the prototyping stage of industrial product development. Otherwise, if the possible embodiment fails to meet the start condition design goals at the element 210, its usefulness and aesthetic appeal are evaluated (at an element 211) in more generalized terms ('Is there another design problem, existing or imagined, whose goals this possible embodiment could satisfy?'), and the possible embodiment is either discarded (at an element 213) or added (at an element 212) to the set 220 of patterns, with the base pattern from which it was developed at the element 205, for possible future use or development.

Subprocess 209, FIG. 70A

If at the decision element 208 (represented in FIG. 70A by a circle to indicate its presence elsewhere in the process, namely within FIG. 70 as previously described) there are criteria that the possible embodiment does not meet, an "improvement cycle" is entered, represented by one or more repetitions of the action 208 and the subprocess 209. The possible embodiment is subject to a decision 223, which allows the designer either to continue to improve the possible embodiment at a decision 214 or to discard it at the action 213 if it has gone through several rounds of modification (passing between the decision 208, FIG. 70, and the subprocess 209 several times) without success. If at the decision 223 (FIG. 70A) the designer chooses to improve the possible embodiment, the set 221 of criteria is evaluated at the decision 214 with respect to the design goals created at the start condition 201. If at the decision 214 irrelevant criteria are found, an action 215 is taken either to ignore the irrelevant criteria or to eliminate them from the set 221, and then the possible embodiment is once again evaluated (at the element 208), this time against the updated (or temporarily fewer) criteria.

If instead at the decision 214 no criteria are deemed irrelevant, either an action 216 or an action 217 may be taken; by the action 216, a transformation may be chosen from the set 222 of transformations, or by the action 217, a new type of transformation may be created. If the action 217 is chosen, the new transformation can be added (at an action 219) to the set 222 of transformations. After either the action 216 or the action 217 is taken, the chosen transformation is applied (at an action 218), and the possible embodiment is once again evaluated (at the action 208) against the set 221 of criteria.

The ability to revise the criteria, fold patterns, and transformations available to the designer is an integral part of the design method. The decision 214, an evaluation of the set 221 of criteria, is needed because, for example, a new embodiment can sometimes obviate the need to meet certain criteria (in which case these criteria may be temporarily ignored), or a new design problem—that is, a set of design goals as specified in the start condition 201—can cause one or more criteria of the set 221 to be overly restrictive or no longer relevant with respect to the new design problem, and those criteria may need to be ignored, revised, or deleted. Updated sets 220 of fold patterns (FIG. 70) and, to a lesser extent, sets of transformations 222 (FIG. 70A) are inseparable from the purpose of the design method: the creation of new patterns of folds.

During use of this method, a designer may go through many different model sheets and/or possible embodiments before finding a suitable design. In practice, the cycle of actions 208⇆209 can occur rapidly and repeatedly, in the designer's imagination, with one or more model sheets, or by mathematical or computational representations, etc.

The following is a possible set of basic patterns on which to base a pattern of origami folds. This list may constitute the set 220 of tessellation cells, tessellations, fold patterns, model sheets, and possible embodiments in FIG. 70:

F1. Any geometric shape useful as a tessellation cell, module, or collapsible material F2. Two or more geometric shapes with contiguous edges F3. A series of lines radiating from a point F4. A series of parallel lines F5. Any curved line F6. Any of the above, repeated in one direction F7. Any of the above, repeated in more than one direction F8. Two or more of any of the above in combination The following is a possible list of criteria by which the design being worked on is judged with respect to functionality. These criteria may constitute the set 221 of criteria in FIG. 70:

C1. Can any edge(s) of the possible embodiment be used to anchor to a top rail?

C2. Depending on the spatial constraints in the possible embodiment's environment, does the possible embodiment interfere with these constraints at any point in its movement?

C3. Does the scale of the pattern of folds relative to the possible embodiment lend itself to an aesthetically pleasing effect?

C4. In general do the overall shapes of the possible embodiment satisfy aesthetic goals/demands/constraints?

C5. Is there a place on the possible embodiment for a bottom rail where A) the bottom rail would be brought into superposition with the top rail in collapsed state, and B) the bottom rail would serve to lift or support enough of the material so that it would not sag, thereby causing the embodiment to fail to operate?

C6. Are there enough points in common on overlapping panels in the possible embodiment's fully collapsed state between possible bottom and top rail locations for pull cord hole(s) to be located?

C7. Will a pull cord move freely through all pull cord holes in the panels it passes through as the possible embodiment collapses and expands?

C8. Is the overall convexity of the possible embodiment such that it would hide the base area at its edges in its fully expanded state?

The following list of transformations may constitute the set 222 of transformations in FIG. 70A. They are selectively applied to a design to help it meet the functional criteria used in the design method:

T1. Change the scale of the fold line pattern relative to the model sheet

T2. Reposition (translate) the fold line pattern relative to the model sheet T3. Re-orient (rotate) the fold line pattern relative to the model sheet T4. Add fold(s) to the fully collapsed model sheet T5. Add fold(s) to the (fully expanded) pattern
T6. Change the scale of the pattern (or a part thereof) nonuniformly (x- and y-directions differently)
T7. Vary the model sheet's dimensions and/or shape relative to the pattern
T8. Trim or truncate the expanded or collapsed model sheet and pattern
T9. Increase or decrease the number of lines that make up a pattern or a subset of a pattern
T10. Reverse the convexity of the folds in a pattern or a subset thereof
T11. Mirror the pattern, or a part thereof, with respect to an axis (x, y, or oblique)
T12. Additively combine a fold pattern (or subset thereof) with another pattern
T13. Add limiting panel(s) to the model sheet or possible embodiment
T14. Adjust direction of fold(s), i.e. change the angle(s) of fold(s)
T15. Add a fold or pattern to the fully collapsed model sheet
T16. Add a fold or pattern to the fully expanded model sheet
T17. Remove added fold line(s) or pattern(s)
T18. Cross-link model sheets at common points which could move unitedly
T19. Divide base area into many smaller model sheets, and resolve these individually or collectively
T20. Cross-link model sheets by overlapping or joining common fold line segments
T21. Limit travel of a panel or series of panels by cross-linking another panel or series of panels of different module height
T22. Cross-link panels of 2 or more model sheets having equal module heights

Application of the Design Method

Embodiment 1—FIGS. 1-6, 18-45, 70, 70A

The fold patterns, criteria, and transformations of the sets 220, 221, and 222, respectively elaborated above, will now be explained in the context of applying the disclosed design method to the eight embodiments already described.

The first embodiment (FIGS. 1-6) might represent an outcome at the end condition 202 (FIG. 70) that may result from a designer's use of the design method. The "inputs" or design goals at the start condition 201 might include, for example, the window casement 1031 as shown in FIG. 1, and the desired solution might be an embodiment that could be mounted thereon.

Figure 18:
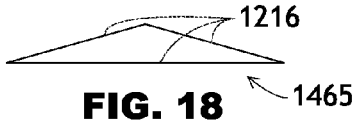
FIG. 18 is a single cell of a tessellation.

FIG. 18 shows a geometric shape 1465 or tessellation cell that is bounded by three line segments or tessellation lines 1216. When repeated, FIG. 19 represents a tessellation 800, or pattern, of the tessellation cell 1465 of FIG. 18. The tessellation 800 could extend indefinitely in all directions on a geometric plane. The tessellation 800 is based on patterns F1 and F6, listed above, in the set 220 of patterns (FIG. 70). In FIG. 19 the tessellation 800 has a rectangular boundary 1480 that truncates it. In the design method, the boundary may or may not be proportioned similarly to a base area chosen at the start condition 201 (FIG. 70). In FIG. 19, the boundary has a different proportion than the base area 1021, FIG. 1. The ratio of the width to the height of the boundary 1480 can be similar to the ratio of width and height of a hypothetical real location for the eventual embodiment, such as a window, wall, ceiling in a room, etc. but the actual dimensions and proportion can be altered to suit the needs of the embodiment without changing the embodiment's adherence to the design intent or the relationships of panels and folds in the possible embodiment. The boundary 1480 has a width 3 times the width of the tessellation cell 1465 and a height of 12 times the height of the same tessellation cell. At this point in the design method, actual dimensions are not yet relevant; only the scale and proportion of the tessellation cell relative to the boundary. Twenty-four tessellation cells 1466 are "halves" of the original tessellation cell 1465 shape as a result of combining the tessellation with the boundary 1480. These tessellation cells 1466 are different elements with respect to the theoretically infinite tessellation of the cells 1465. Thus, the tessellation 800 is better described as a repeating pattern of tessellation modules 1500, each consisting of five tessellation cells 1465 (labeled b, c, d, e, and f) and two tessellation cells 1466 (a and g). Alternatively, the tessellation 800 can be described as an indefinitely repeating pattern of tessellation modules 1501, where each module 1501 consists of 10 tessellation cells 1465 (*b, c, d, e, f, i, j, k, l,* and *m*) and 4 tessellation cells 1466 (*a, g, h,* and *n*). The tessellation module 1500 is repeated 12 times within the boundary 1480. The tessellation module 1501 is repeated 6 times within the boundary 1480. Both tessellation modules 1500 and 1501 are repeated only in a vertical direction.

In practice, the embodiment could function equally well if module 1501 occurred any reasonable number of times. The precise dimensions of the collapsible material and the angles between its folds can vary greatly, as long as the relative positions and angles of the folds and the panels remain the same. Thus, the terms tessellation, module, pattern, origami fold, and so forth as defined above are intended to demonstrate a relationship between the geometric representation and a range of actual, physical embodiments that correspond to the same geometry. FIGS. 22-42, explained below, illustrate several applications of the design method which give rise to various physical embodiments based on the same tessellation.

FIG. 19 has so far been described as a representation of abstracted geometries. Relative to the design method action 207 (FIG. 70), FIG. 19 also represents a model sheet 1400. Throughout the following Figs., schematic views of model sheets will be shown only in elevation view because they are substantially planar. In schematic representations such as FIG. 19, dashed lines such as lines 1900 correspond to concave folds in a model sheet, and solid lines such as lines 1800 correspond to convex folds in a model sheet. The rectangular boundary 1480 is a graphical representation of the edges of the model sheet 1400 of stiff material imparted with fold lines that correspond to the tessellation 800. The tessellation cells 1465 and 1466 are embodied in multiple triangular panels 916 and 917, respectively, and the lines of the tessellation 800 are embodied in folds 1800 and 1900 which surround and define the triangular panels 916 and 917.

The convexity of folds in a model sheet helps to define the functionality of a possible embodiment. In order for two or more convergent folds and panels to collapse in a particular way, the convexities of the folds must follow geometric and physical behaviors and rules that are best explained by mathematical texts such as Robert Lang's Origami Design Secrets, Wellesley, M A, A K Peters, 2003, and other references cited in the Origami Mathematics section above. Typically, the determination of fold line convexity will be made intuitively and experimentally, as is the norm in the field of origami, but could also be made computationally or mathematically. Furthermore, the optimum convexities of the fold lines is often apparent only after exercising the strategies of the design method.

Figure 20:
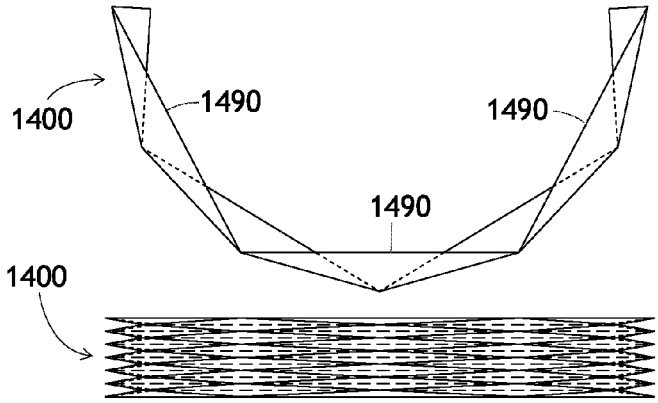
FIG. 20 shows plan and elevation views of a material folded according to the tessellation of FIG. 19 and fully collapsed along the fold lines.

When the model sheet 1400 is collapsed to the fullest extent possible (bent along all the folds 1800 and 1900 until all folds are fully collapsed), the result is a compressed, substantially flat stack of panels that is shown in plan and elevation views in FIG. 20 (for clarity, the elevation view is shown in a state near fully collapsed). In plan view FIG. 20, three segments 1490 of the material's top edge form a C-shape, whereas in FIG. 19, the same edges 1490 are collinear when the model sheet is fully expanded or flat. The model sheet is shown partially collapsed in perspective view FIG. 21 (prior art).

In design method FIG. 70, the designer has arrived at the decision 208. The model sheet, or possible embodiment, shown in FIGS. 19-21 will be difficult to use as an embodiment. At the decision 208, the possible embodiment fails criterion C1 of the set 221 of criteria. The top edge is straight when the possible embodiment is fully expanded (FIG. 19), and C-shaped when collapsed (FIG. 20). Given the assumed standard mounting device (top rail, etc.), this possible embodiment is not useful, because its top edge will be difficult or impossible to attach to a single stable surface in a way that will hold the embodiment stably and functionally. Because the possible embodiment fails criterion C1, the designer passes to the subprocess 209. Here, the designer decides at the decision 223 to attempt to resolve the design, at the decision 214 decides the criteria are still relevant (lacking a new mounting device to support this possible embodiment), and at the action 216 chooses two transformations from the set 222: T1 and T2, changing scale and position of the pattern relative to the model sheet.

In schematic (elevation) views FIGS. 22 and 24, a rectangular boundary 1481 is smaller in scale than the original boundary 1480 of FIG. 19, relative to the original tessellation 800 so that its width is equal to the width of one tessellation cell 1465, resulting in a tessellation module 1503, each module comprising four half tessellation cells 1466 (*q, r, s,* and *t*) and two tessellation cells 1465 (u and v). Thus a new model sheet 1411 contains 6 tessellation modules 1503 repeated vertically.

In FIG. 22 the tessellation has been positioned so that a top edge 1482 of the model sheet 1411 is positioned on a horizontal tessellation line; it forms an edge of a single panel 918. By contrast, FIG. 24 shows the tessellation 800 imparted as folds into a model sheet 1412 of equal dimensions to the model sheet 1411, but the tessellation 800 is positioned so that a top edge 1483 coincides with two edges of two panels 919. Consequently the top edge 1483 consists of two segments and is not straight when it is fully collapsed, as shown in top view FIG. 25 in fully collapsed state. By contrast, the top edge 1482 remains unbroken, as shown in top view FIG. 23 of the model sheet 1411 in fully collapsed state. Attaching the top edge 1483 to a stationary surface would be more difficult than attaching the top edge 1482 to a stationary surface.

Therefore, at the action 216 (FIG. 70) the designer would choose the transformation represented by the model sheet 1411 of FIGS. 22-23. At the action 218 the designer would apply the transformations, thus completing the subprocess 209 and returning to the decision 208 to evaluate the model sheet 1411.

Although it now meets criterion C1, the model sheet 1411 still has a shortcoming. In collapsed plan view FIG. 23, notice that rearward parts 1421 of the collapsed material 1411 lie behind (above) the top edge 1482, and the rest of the material lies in front of the top edge. In practice, this means that in any collapsed state the rearward parts 1421 of the folded material would not allow the top edge 1482 to be brought into proximity to a wall, for example. Thus, the possible embodiment fails criterion C2 (FIG. 70, set 221). Returning to the action 216 (FIG. 70A), the designer chooses to resolve the problem by applying transformation T4 from the set 222, adding a fold 1521 (shown in plan view FIG. 26) to the fully collapsed material 1411, which results in a model sheet 1413 having a pattern of additional folds 153 shown in expanded elevation view FIG. 28. Approaching the solution from a different perspective, these folds, or any others, could also have been added directly to the tessellation module; this alternative (FIG. 70) is the transformation T5 in the set 222. When the model sheet 1413 is fully collapsed according to the convexity of the fold lines in FIG. 28 the resulting collapsed plan view is FIG. 27. (In FIG. 28, the concavity of the added fold lines 153 and several segments 1807 of previously-existing horizontal fold lines are changed in accordance with conventional origami folding methods to integrate the additional folds so that the model sheet 1411 may collapse properly.) When collapsed (FIG. 27), the edge 1482 can now be brought substantially nearer to a wall, and the possible embodiment 1413 can be collapsed and expanded without any significant interference from a wall and without undue protrusion from a wall on the part of the mounting device.

The location of the additional fold line 1521 in FIG. 26 is subjective and arbitrary. The fold line could have been made askew to the top edge 1482, for example. Locating it on the plane of the top edge 1482 allows the top edge to lie substantially on a wall, whereas locating it slightly behind (above) the top edge would result in a different position for several additional folds 1532 shown fully expanded in FIG. 30 (a schematic view of one tessellation module of the resulting collapsible material) and fully collapsed in plan view FIG. 29, and a top edge 1484 could lie relatively near a wall but not adjacent to it.

When fold lines are added to a material in its fully collapsed state, the resulting pattern of fold lines can be a distinct tessellation having a distinct tessellation module. In FIG. 28, the material 1413 has a tessellation 813, which differ from the material 1411 and the tessellation 800 (FIG. 22) in that a module 1504 (FIG. 28) consists of ten tessellation cells rather than six (identically shaped cells w, x, y, and z, cells aa, ab, ac, and ad, and cells ae and af). However, the modules 1504 in FIGS. 28 and 1503 in FIG. 22 still share the same width, height, and direction of repetition, and they both have top and bottom edges that occupy the width of a single tessellation cell.

After the transformation (the action 218, FIG. 70A) resulting in the model sheet shown in elevation view FIG. 28, the designer returns to the decision 208 (FIG. 70). The criterion C4 of the set 221 is a general qualitative judgment: "In general do the overall shapes of the possible embodiment satisfy the aesthetic goals, demands, and constraints?" This is a repetition of the question to be posed at the decision element 210 in the design method flowchart (FIG. 70); however as a criterion used at the decision 208 its purpose is slightly different. The criterion C4 is a basis for evaluating several alternative possible embodiments through the design process before selecting one worthy of prototyping and eventual production.

Alternative Possible Embodiments

FIGS. 26, 28, 31-42, 70, 70A

Some alternate possible transformations achievable at the subprocess 209 are briefly described. The proportion of a given pattern can vary within a given range and still yield functional embodiments; some patterns may have a narrow range of proportion and others may have a practically infinite range of proportion. In schematic FIG. 31, the tessellation 813 is shown with the vertical dimension of the module 1504 increased with respect to the embodiment shown in FIG. 28, so that a possible embodiment contains only five instead of six tessellation modules 1504; in FIG. 32 the possible embodiment is shown with seven instead of six modules 1504 (vertical dimension decreased). A non-proportional change of scale of the tessellation is conveyed by the transformation T6 in the set 222. The decision of which scale is appropriate to the design is conveyed in the criterion C3 of the set 221.

FIG. 33 shows the tessellation 800. Cutting, cropping, or trimming the tessellation at long-dashed boxes 154, 155, and 156 results in three alternative model sheets shown in FIGS. 34, 35, and 36 respectively. The width dimensions of the model sheets have been changed to less than one tessellation cell width (FIG. 34), more than one tessellation cell width (FIG. 35), and one-half tessellation cell width (FIG. 36). The variation of the model sheet's dimensions relative to the pattern is conveyed by the transformation T7 in the set 222. FIGS. 37, 38, and 39 show the respective model sheets in their fully collapsed states in plan view and reflect possible alternatives created as a result of repeated use of the design method as described above. These model sheets could require the addition of folds in their collapsed states in a fashion similar to that shown in FIG. 26. Each of their proportions could also be altered, similarly to FIGS. 31 and 32 as described above, in height or in width, or selectively, according to various transformations in the set 222, the results of which would be subject to functional scrutiny by the criteria of the set 221 at the decision 208 of the design method. Similarly, FIG. 40 shows the plan view of the model sheet of FIG. 33 when fully collapsed, which if trimmed at a long-dashed box 157 would result in the possible embodiment shown in FIG. 41 in fully collapsed plan view and in FIG. 42 in fully expanded elevation view. The trimming of a possible embodiment is conveyed by the transformation T8 in the set 222.

Physical and mechanical considerations are also addressed more fully at the decision 208. These considerations reflect criteria C5, C6, and C7, which encompass location and dimension of the top and bottom rails, and the location thereon of pull cord holes. These design considerations sometimes have an impact on shape, scale, and other aspects of the fold pattern itself, and are thus taken into consideration in a general way within the "improvement cycle" 208 ⇆209 before a possible embodiment reaches the end condition 202 and may enter a prototyping stage. However, specific locations can depend on minute changes in shape and dimension within the possible embodiment; thus they are considered in greater detail when these dimensions are well established.

After creating each of the possible embodiments of FIGS. 28, 31, 32, and 34-42, assuming that the possible embodiment satisfies all of the criteria at the decision 208 (FIG. 70), the designer passes to the decision 210 where he or she evaluates the possible embodiment against predefined physical constraints and the base area size and proportion that were determined at the start condition 201. A "yes" here means that the possible embodiment will be developed further, and a "no" means it will be set aside. For example, the designer might choose at first to answer "no" for the possible embodiment of FIG. 28, then at the action 212 might add its pattern to the set 220, and return to either action 204 or 205 to create another of the aforementioned possible embodiments. After having created each of them, and perhaps any number of other possible embodiments based on different tessellations, the designer will once again approach the decision 210 and will consider all of these possible embodiments together finally to choose one of them as the most appropriate or satisfactory with respect to the design goals established at the start condition 201.

Assuming the designer chooses the model sheet 1413 of FIG. 28 as the most appropriate solution, the designer arrives at the action 206 (FIG. 70) where the model sheet 1413 is added to the set 220 of patterns. (Other significant patterns created during application of the design method are also added to the set 220, if they have not already been added in the action 212.) Finally, at the end condition 202, the model sheet becomes a possible product. All elements of the model sheet are given relative and/or absolute ranges of dimensions and locations, in the interest of production for various particular, customized end uses. Range(s) of maximum and minimum tessellation module proportions might be given, relative locations and sizes of the top and bottom rails, pull cord holes, module heights, critical fold lengths, maximum overall height, and so forth.

For example, in locating pull cord holes on the top and bottom rails 1051 and 1061 in FIG. 1, the shape and movement of intervening panels must be considered. FIG. 43 shows half of a fully collapsed plan view of the symmetrical possible embodiment of FIG. 28 with a top rail 1059 and two prospective pull cord positions 158 and 159. Expanded elevation view (cutaway) FIG. 44 shows where holes might result by propagation of holes 158 and 159 through the panels while the panels are fully collapsed and stacked beneath the top rail 1059. Choosing the location 158 would result in a series axial holes 1254 and a series of offset holes 160 lying outside the vertical axis of motion of a pull cord 1076. This would cause resistance between the cord 1076 and the edges of the offset holes 160, and the embodiment would not function properly. Therefore the position 159 is a better choice, as it results in a series of fewer holes 1255, all of which travel parallel to the direction of collapse and do not resist a cord 1077. An alternative might be that shown in FIG. 45. In this case elongated cord holes 1259 have replaced the offset cord holes 160 of FIG. 44 thereby accommodating the horizontal travel of skew panels 923 as the embodiment expands and collapses and a pull cord 1079 moves from one end of holes 1259 to the other.

Application of the Design Method

Embodiment 2—FIGS. 9-9C, 46A-54, 70, 70A

A second embodiment (FIGS. 9-9C) represents an outcome at the end condition 202 (FIG. 70) that may result from a designer's use of the design method. The "inputs" or design goals at the start condition 201 might include, for example, a typical window frame such as that shown in FIG. 46A, wherein the window is recessed into a wall, and the desired solution might be an embodiment that could be mounted to a window frame ceiling 1032. The embodiment cannot extend beyond a fixed width at any point during its operation, and if a base area 1022 is close in size to the window frame recess, the resulting embodiment can have a very limited range of dimensions.

An appropriately sized and proportioned replica of embodiment 1 (FIG. 1) would fulfill these objectives. By using the design method and selecting (at action 204, FIG. 70) the pattern of embodiment 1, choosing appropriate vertical and horizontal scales at the action 207 for both the collapsible material and the pattern of fold lines, the decision 208 is easily met and the designer quickly satisfies the decision 210, records the final design at the action 206, and has a viable solution at the end condition 202.

However, it has been stated above that a desirable aspect of the design method is its ability to produce multiple solutions for any given set of design goals. Assume, for example, that a hypothetical client dislikes the appearance of embodiment 1. In this case, the designer returns to the design method action 204, and chooses from the set 220 a combination of patterns F3 (a radial series of fold lines) and F6 (a pattern repeated in one direction). FIG. 46B shows such a pattern of fold lines 815 comprising a tessellation module 1505 repeated ad infinitum along a vertical axis, the module 1505 consisting of a series of lines 1621-1625 that radiate from a center point 1631 and a series of lines 1625-1629 that radiate from a center point 1632.

At the action 207 (FIG. 70), relating a model sheet 1414 and the base area 1022 to the pattern 815 as in FIG. 46B, it is convenient to locate at least a top edge 1485 of the model sheet on a fold line of the pattern 815 (transformation T2, "reposition the fold pattern relative to the model sheet"). The resulting possible embodiment is shown in FIG. 47 in expanded elevation view, with convex folds 1808-1811 and concave folds 1923-1925.

At the decision 208, the designer sees that criterion C2 yields a "no" result, which leads to the subprocess 209. This is because in collapsed plan view FIG. 48, all the material to the right of an edge 1206 would be obstructed by the side of the window recess of FIG. 46A as the possible embodiment were raised. The designer decides at the decision 223 (FIG. 70A) to attempt a solution, at the decision 214 decides that criterion C2 is relevant, and at the action 216, chooses transformation T4 from the set 222 to apply to the possible embodiment. As shown in collapsed plan view FIG. 49, the transformation is applied (at the action 218, FIG. 70A): a fold 1522 is added to the collapsed model sheet 1414 of FIG. 48. Resulting propagated folds 1533 are shown in expanded elevation view FIG. 50, and some folds in a new model sheet 1415 are changed in convexity according to standard origami practice. Returning to the decision 208 (FIG. 70), the designer re-evaluates the possible embodiment against other criteria.

Criterion C8 deals with the convexity of the model sheet as a whole. At this stage of development as shown in perspective view FIG. 50A, a series of panels 1512 of the possible embodiment 1415 extends away from the base area 1022 and toward the viewer, i.e. the model sheet as a whole is concave across the folds 1533 from the viewer's perspective. The panels 1512 could tend to lift away from the hypothetical window of FIG. 46A, even when fully expanded, and fail to obscure the base area 1022. Therefore, the possible embodiment fails criteria C8 at the decision 208. Furthermore, the model sheet 1415 in collapsed state (FIG. 49) has a large cantilever perpendicular to its base area, which would most likely sag under its own weight, thereby impeding expansion and collapse of the possible embodiment.

The designer once again returns to the subprocess 209 (FIG. 70A). Transformation T4 can be applied again to reduce the dimension of the model sheet's cantilever, as in collapsed plan view FIG. 51 by the addition of a fold 1523 to the fully collapsed model sheet, which when expanded as in elevation view FIG. 52 results in propagated folds 1534 (the convexities of the folds have been adjusted according to typical origami practice) which result in a new model sheet 1416. Returning once again to the decision 208 (FIG. 70), the convexity problem criterion C8 is also satisfied by this transformation.

Further criteria are considered at the decision 208. The dimensions of the top rail 1052 and the bottom rail 1062 in FIGS. 53 and 54 are considered, as well as the position of a pull cord hole (or holes) 1311 in the top rail 1052. The pull cord holes' locations depend on the top rail 1052, its relative position to the bottom rail 1062, and the superposition of a lower panel 921 and a series 920 of panels folded between them (refer to FIGS. 53-54). In collapsed plan view FIG. 53, the position of the hole 1311 in the top rail 1052 was chosen to coincide with approximately the center of gravity of the relatively short bottom rail 1062 in the embodiment's fully collapsed state. This allows the possible embodiment 1416 to meet criterion C6 in the set 221. Each hole in the pattern 1253 of propagated pull cord holes (FIG. 54) is positioned below and directly in line with the hole 1311 when the possible embodiment is fully collapsed.

Because the bottom rail 1062 is much narrower than the width of the base area, and the possible embodiment exhibits a cantilever beyond the support of the bottom rail, criterion C5 might not be met without slight changes to the proportion and placement of the fold lines. For example, the original pattern 815 shown in FIG. 46B has five lines converging to each point 1631 and 1632, but the number of these lines could be changed for the points 1631 or 1632 independently. Transformation T9 reflects these adjustments: to change the number of lines that make a pattern or a part thereof.

Having satisfied all criteria at the decision 208 (FIG. 70), the designer passes to the decision 210, wherein the possible embodiment is accepted or rejected as a whole. Once again, it could be put aside temporarily in order to develop alternative possible embodiments, and re-evaluated at the decision 210 to determine which of the possible embodiments best satisfies the design goals set forth at the start condition 201. Assuming the possible embodiment 1416 (FIGS. 53-54) is accepted, the designer carries out the action 206, adding the various patterns developed in FIGS. 52, 50, 47, and 46B to the set 220. At the end condition 202, the possible embodiment is made into the embodiment shown in FIGS. 9-9C.

Application of the Design Method—An Undeveloped Embodiment—FIGS. 56-58C

Given a set of design goals at the start condition 201 (FIG. 70), a designer chooses two fold patterns at the action 204 and imparts them successively into a model sheet at the action 207. For example, FIG. 56 shows a model sheet 1417 that has two parallel folds imparted on a relatively large scale; on the sheet 1417 appear just one convex 1825 and one concave 1926 fold. The pattern can also be regarded as a tessellation of squares 1467 equal in width to the that of the model sheet 1417 (patterns F1 and F6 in set 220). As shown in FIG. 57, a set of radial folds 814 (pattern F3 in set 220) is superimposed over the collapsed material 1417. Alternating concave and convex folds are imparted, by standard origami practice, where the lines of the pattern 814 coincide with all three layers of the model sheet. When the model sheet is unfolded, the convexities of some of the folds are reversed according to standard origami practice. The resulting pattern of folds yields the possible embodiment of FIG. 58, which is shown in various states of collapse in FIGS. 58A-58C.

Unfortunately, this possible embodiment is not suited to any standard device for mounting and operating it. At the decision 208 (FIG. 70), it would fail criteria C1, C5, C6, and C7 because there is no place on the material sheet for a bottom rail, and in any direction from a most likely fixed edge 1208 (FIG. 58) there is no continuous series of panels through which a pull cord could pass to arrive at a bottom rail. The motion of this possible embodiment is complex, and would require some way of holding a point 1463 so that it would travel horizontally toward the fixed edge 1208 as the embodiment would collapse (FIGS. 58-58A). To satisfy the criteria, a designer could develop a mounting and operating mechanism involving such movements and multiple pull cords, but the development of such a non-standard mechanism is beyond the scope of the design method. Therefore, this embodiment would fail to reach the end condition 202 of the design method flowchart (FIG. 70), until which time such a mechanism would exist.

The invention or discovery of alternate mounting devices would obviate certain criteria and require the addition of still other criteria to a hypothetical new set 221D of criteria for use with the design method. Although this possible embodiment fails to reach the end condition of the design method flowchart, its pattern of fold lines could be added to the set 220 in the hope of future development.

Application of the Design Method

Embodiment 8—FIGS. 16, 17

The embodiment in FIGS. 16-17 represents a possible product at the end condition 202 in the design method (FIG. 70). Given some set of design goals at the start condition 201, the designer has chosen at the action 204 to create a possible embodiment with two panels and one curved fold placed (action 207) in a position diagonally downward, more or less at the position of the fold 1935 in FIG. 16. At the decision 208, the designer assesses the various criteria and finds that this possible embodiment represents a departure from the assumptions behind criteria C5, C6, and C7: these criteria all presume the existence of a bottom rail. The possible embodiment fails these criteria due to at least two factors: the panels curl as the fold 1935 is collapsed, and the bottom edge of the material does not come to rest near the top rail when the material is fully collapsed. Furthermore, the possible embodiment might fail criteria C8, because the single fold is concave.

The designer studies the possible embodiment and realizes that the panels can be brought into proximity with the top edge. The points 1461, 1258, and 1257 overlap when they are placed substantially over the point 1312 as the possible embodiment is collapsed. This leads the designer to attempt to resolve the possible embodiment at the decision 223 (FIG. 70A), and to deem criteria C5-C7 irrelevant at the decision 214. At the action 215 the designer makes a note to ignore these criteria, and creates a new criterion C9 relative to the operation of the possible embodiment: "Is there a point on a panel where a pull cord could be anchored so that it will be brought into proximity with a top rail?" The designer returns to the decision 208 (FIG. 70). By the modification of these criteria, the designer can create a new set 221E of criteria which may pertain to curvilinear fold lines such as this.

At the decision 208, one more criterion must be met, C8. Because there is only one fold, the designer decides to satisfy this criterion by documenting a stipulation that the embodiment may require ample dimensions with respect to the base area to obscure the base area sufficiently. For example, the embodiment might carry a condition that its width and height be at least 30 centimeters wider and taller than the base area it covers. By this solution, criterion C8 is satisfied.

Having satisfied all criteria, the possible embodiment meets the design goals at the decision 210, it is added to a new set 220E of patterns (intended for use with set 221E of criteria) and becomes a model for a possible product (end condition 202). After the design method is completed, details such as the exact locations of the points 1461, 1258, 1257, and 1312 (FIG. 16), length of the top rail 1058, material of the panels 927 and 928, and others are decided. A new set 222E of transformations could be created based on the set 222, tailored specifically to corresponding new sets 220E and 221E of curved fold patterns and criteria.

CONCLUSION, RAMIFICATIONS, AND SCOPE OF INVENTION

The disclosed embodiments may have the following advantages:

a) To provide a method by which a designer can create any number of embodiments of a light-controlling device
b) To block the passage of light or obscure an observer's view across an area
c) To allow deployment and storage of a light-controlling device
d) To provide an aesthetically pleasing effect in both raised and lowered states not known in the prior art Visual appeal is an important quality in any interior décor object, and the method allows a designer to create many embodiments with a very wide range of visual effects. A further consequence of the embodiments' unique appearance is that the embodiments can be used for many more purposes than the most relevant prior art. If "window shade" is the most closely related prior-art category, it falls short of describing the possible applications of the embodiments. Whereas almost all window shades are aesthetically and/or psychologically confined to the space immediately in front of a window, the embodiments exhibit sculptural and visual dimension which may enable them to serve as room dividers, wall hangings with or without diffuse lighting between them and the wall, decorative backdrops, space-dividing elements for rooms, shop and restaurant window backdrops, or other such uses. Furthermore, the embodiments can be associated with other interior-design elements (such as lamps, wall decorations, wallpaper, sculptures, furniture, etc.) of a space to a much greater extent than can traditional window shades, i.e., the inventive embodiments "tie in" aesthetically with these other elements more fully.

The primary advantages of prior-art window coverings (including curtains) in general are: A) to block light and view to some extent, and B) to adorn windows in an aesthetically pleasing way. It can be argued that most window shades address only functional needs and leave the aesthetic needs to be fulfilled by the superficial (in the sense of "surface-related") textile effects of the material from which they are made. The disclosed embodiments successfully address aesthetic and functional advantages more integrally. From the perspective of a not-yet-existing market niche, they are more aesthetically pleasing than any window covering heretofore created. Furthermore, as there are no other products currently on the market that resemble them, they are expected to present a wholly new range of aesthetic choices to a new market segment.

The embodiments of the light-controlling device are aesthetically very different from the prior art. Their sculptural and visual beauty allow them to have many more uses in decorated interiors than the relevant prior art, including but not limited to the following:

l) as a window shade;

m) as a room divider, installed for example on a ceiling;

n) as a decorative wall hanging, with or without incorporated lighting;

o) as a backdrop for a shop or restaurant window;

p) as a sound-absorbing device where its aesthetic qualities are also important, as in for example a restaurant interior.

A well-studied design method is disclosed which allows someone practiced in the relevant arts to design an endless variety of embodiments of light-controlling devices. The method comprises strategies for determining and refining patterns of origami folds for specific structural applications. These embodiments can vary greatly in form and proportion, maximizing their marketability and appeal in very diverse interior design and décor applications. In addition, the disclosed design method allows for its own improvement and evolution over time, growing with the practitioner's experience and familiarity with unforeseen future design goals, applications, materials, mounting devices, and operating devices.

The manufacture of the embodiments may include any of several methods:

q) Two possible processes allow a repeated pattern to be folded into a continuous web or sheet of material in a very efficient manner: US Patent application 2005/0113235 by B. Basily and E. Elsayed entitled "Technology for continuous folding of sheet materials" and US Patent application 2002/0094926 by D. Kling titled "Patterning technology for folded sheet structures";

r) The use of steel-rule-die presses, common in the printing and packaging industries;

s) Digital scoring or perforation techniques with laser or laser-guided water jet technologies, in combination with a plastic or any plastic-laminated or impregnated substrate for the embodiments;

t) A large-scale adaptation of the manufacturing technique used in U.S. Pat. No. 4,917,405 by R. Muth, et al., issued 1990 entitled "Sheet folding method and apparatus" by which a pair of templates are used to impart folds into a sheet material placed between the templates.

Several ramifications of the design method pertain to manufacturability or commercial practicability of embodiments of the screen. These include but are not limited to the following:

u) Using repetitive tessellation modules yields an opportunity to create steel-rule-die templates (of select proportions of fold patterns) for repeated use to make customized embodiments quickly and efficiently;

v) Combining patterns of folds or parts thereof additively to create an embodiment of the inventive screen allows the additive combination of separate steel-rule-die templates to allow customization of the resulting embodiments;

w) Using more than one collapsible material sheet can effectively minimize the amount of work necessary to customize an embodiment's dimensions by modifying or limiting the fully-expanded height of a given collapsible material, which can be achieved through a change in the module height of the secondary (limiting) collapsible materials;

x) Overlapping of cross-linked sheets to varying degrees to increase the adaptability of standardized sheets;

y) Trimming prefabricated tessellated sheets to adjust the embodiment's dimensions to increase the flexibility and efficiency of the manufacture of standardized sheets;

z) Employing tessellation cell sizes much smaller than the intended base area allows custom-sized embodiments to be made from one standard collapsible material wherein the number of cross-links determines an embodiment's width, and the vertical repetition of tessellation modules determines its height;

aa) Superimposing a second pattern by machine onto a first prefabricated collapsible material sheet can efficiently allow a range of dimensions of the final product by varying the distance between the preexisting pattern (or part thereof) and the second pattern (or part thereof);

bb) Using cross-linking relationships between some panels in an embodiment can enhance the embodiment's aesthetic appeal;

cc) Using cross-linking relationships can allow the embodiment to collapse more easily from its fully expanded state;

dd) Using cross-linking relationships can effectively transform an embodiment in such a way that its operation and arrangement of panels is virtually unchanged (such as the embodiments of FIGS. 10 and 15), yet the embodiment is more easily manufactured;

ee) Incorporating cuts or perforations in panels of a collapsible material or model sheet, which serve decorative purposes and do not affect the function of the embodiment;

ff) Generating equivalent embodiments by any transformations, or by creating additional transformations, as in the alternatives of FIG. 66 can substantially increase the number of options for making any embodiment more easily manufactured and thus more practicable.

While the description above illustrates many specificities, these should not be construed as limitations on the scope of the embodiment, but as exemplifications of several embodiments thereof. Many other variations and embodiments are possible. For example, use of separate, individual rigid material panels with hinges attached between them (in the place of folds), a hingedly-folded or creased material, a thermoplastic material with "living hinges", or any combination of these to create a structurally equivalent embodiment to an embodiment of a screen; use of a series of members interconnected by hinges, with panels attached to parts thereof, in imitation of or structurally equivalent to an embodiment; the addition of stiff or flexible rib(s) or lever(s) that would guide or control the motion of certain panels of an embodiment; lever(s) that would act unitedly with the hinge action of the folds or hinges of any embodiment; or an embodiment intended as a sound-reflecting or -absorbing device rather than a visual or light barrier.

Accordingly, the scope of the embodiment should be determined by the appended claims and their legal equivalents rather than by the examples given.

What is claimed is:

1. An article, comprising:

a first means for mounting said article comprising at least a top rail, a second means for operating said article, comprising one or more pull cords, and a third, tight-controlling means for modifying the passage of light through a base area by its covering and uncovering of said base area, said top rail being fixedly and removably connected to a stable surface, and said top rail being hingedly connected to at least one edge of said tight-controlling means, said pull cords passing slidably through one or more apertures in or near said light-controlling means, each said aperture substantially fixed in position relative to a point on said light-controlling means, said pull cords passing slidably through one or more apertures substantially fixed in position relative to said stable surface, each said pull cord comprising at least a filament, an anchored end of each said filament being fixedly attached to an anchor point, each said anchor point either being substantially fixed in position relative to a predetermined point on a said panel, or being hingedly connected at a fixed distance from a predetermined point on said light-controlling means, a free end of said pull cords being located substantially near an opposite end of said filaments to said anchored end of said filaments, said light-controlling means comprising a plurality of panels and one or more origami folds, said panels being hingedly interconnected by said origami folds, said origami folds being either linear or nonlinear, said light-controlling means and said origami folds thereon having a position, a scale, and an orientation predetermined and resolved with respect to said first and second means whereby said base area is substantially covered and uncovered by the operation of said light-controlling means, each point on said origami folds having a pivot axis around which two adjacent said panels may rotate, any two said pivot axes having an angle between them, at least one said angle being substantially between zero and 180 degrees, said rotation about said pivot axes occurring substantially interdependently by a transmission of forces from one said pivot axis to its adjacent said pivot axes due to said angle(s), or by a transmission of bending forces in said panels to rotational forces about their adjacent pivot axes due to said nonlinear origami folds, wherein the variation of a pulling force on said free end of said pull cords causes said rotation of said panels about said origami folds, thereby expanding or collapsing said light-controlling means, thereby revealing or concealing said base area.

2. The article of claim 1 wherein said apertures and said anchor points comprise any combination of features selected from the group consisting of holes, loops, rings, grommets, eyelets, stitches, wires, tubes, gaps, sleeves, elbows, helices, slots, jogs, and clips, and said anchor points further comprise fasteners for attaching said anchored end to said anchor point, said fasteners comprising knots, ferrules, glue, rivets, and stops.

3. The article of claim 1 wherein forces applied to said second means create a range of bending forces acting tangentially to said origami folds and a range of folding forces acting perpendicularly to said origami folds, said ranges of forces determined by changes in direction of the axis of said origami folds and by the stiffness or stiffnesses of said panels.

4. The article of claim 1 wherein said panels and said origami folds consist of one or more sheets of a stiff material, said material having a predetermined stiffness at any point on said panels and forming a hinge at any point on said origami folds.

5. The article of claim 4 wherein said sheets of material are interconnected at one or more corresponding points, said corresponding points being selected from the group consisting of a region of a panel, a part of an origami fold, and a point at which an origami fold meets an edge of said material.

6. The article of claim 1 wherein said panels consist of one or more predetermined materials and said origami folds consist of a material capable of constituting a hinge.

7. The article of claim 1 wherein said substantially fixed apertures as a group are fixed in relation to said stable surface, though two or more said apertures may move relative to one another in proportion to said sliding motion of said pull cords.

8. A method for substantially covering and uncovering a base area, comprising:

providing a top rail, said top rail being fixedly and removably connected to a stable surface, providing a plurality of panels, at least a first subset of said plurality of panels being hingedly interconnected by one or more linear or nonlinear origami folds, at least said first subset constituting a light-controlling device, each point on said origami folds having a pivot axis around which two adjacent said panels may rotate, any two said pivot axes having an angle between them, at least one said angle being substantially between zero and 180 degrees, providing a hinged connection between said top rail and at least one edge of said plurality of panels, providing at least one substantially fixed point above said base area, providing at least one filament, each said filament having a fixed end and a free end, said fixed end being attached to an anchor point, said anchor point having a predetermined fixed position relative to one said panel, or said fixed end being attached to one said origami fold, or said fixed end being attached to an object hingedly attached to one said panel or one said origami fold, said filament passing slidably through said at least one substantially fixed point above said base area, pulling said free end to uncover said base area, thereby collapsing said origami folds and said panels, releasing said free end to cover said base area, thereby expanding said origami folds and said panels, said pulling and releasing of said free end causing a rotation about said pivot axes, said rotation occurring substantially interdependently by a transmission of forces from one said pivot axis to its adjacent said pivot axes due to said angle(s), or by a transmission of bending forces in said panels to rotational forces about their adjacent pivot axes due to said nonlinear origami folds, and providing said light-controlling means and said origami folds thereon with a position, a scale, and an orientation predetermined and resolved with respect to said top rail and said filament(s) whereby said base area is substantially covered and uncovered by said pulling and releasing.

9. The method of claim 8 wherein each said filament passes slidably by at least one substantial point, said point substantially fixed in position relative to one said origami fold or one said panel.

10. The method of claim 8 wherein one or more distinct series of said panels are interconnected by origami folds, said series being either cross-linked, interwoven, or hingedly interconnected.

11. A method for designing a collapsible screen, comprising:

[201] establishing a set of design goals, said set of design goals comprising physical and functional characteristics to be met by said collapsible screen, establishing a base area and the proportion, position, and size of said base area,

[204, 205] establishing a first pattern either by selecting one or more elements from among a first set of patterns, or by creating a pattern not an element of said first set, said pattern and said elements comprising one or more geometrical lines, line segments, or curves,

[207] positioning, shaping, and proportioning said first pattern relative to said base area

[207] creating a model sheet by imparting one or more origami folds into a sheet of stiff material disposed according to said first pattern, said model sheet being substantially a scale representation of said base area, said model sheet having one stationary edge,

[208] providing an evaluation of said model sheet with respect to one or more criteria in a set of criteria, said set of criteria comprising tangible functional and structural evaluations of said model sheet with respect to a prospective operating device and a prospective mounting means,

[208] taking a first action if said evaluation is positive, or taking a second action if said evaluation is negative,

[210] said first action comprising creating one or more panels, said panels having hinged interconnections disposed according to said origami folds, said hinged interconnections being proportionate to said base area as said origami folds be proportionate to said model sheet, providing a mounting means to allow an uppermost edge to be attached to a stable surface at least two points, said uppermost edge substantially corresponding to said stationary edge of said model sheet, providing a means of operation to allow said panels and said hinged interconnections to be collapsed and expanded, thereby covering and uncovering said base area,

[209] said second action comprising choosing one or more elements from among a set of possible transformations of said model sheet or said pattern, applying said chosen one or more transformations to said model sheet, substituting said model sheet with a new model sheet when necessary to achieve said chosen transformations, repeating said evaluation, and taking said first action if said evaluation is negative, or taking said second action if said evaluation is positive.

12. A collapsible and expandable product formed by the method of claim 11.

13. The product of claim 12 wherein said base area may have a range of possible dimensions.

14. The product of claim 12 wherein said model sheet may represent a portion of said product, said portion tessellated or repeated so that dimensions of said product bear the intended scale relationship to said base area.

* * * * *